US007654336B2

(12) United States Patent
Matsumoto et al.

(10) Patent No.: US 7,654,336 B2
(45) Date of Patent: Feb. 2, 2010

(54) WORK MACHINE BLADE DEVICE AND WORK MACHINE INCLUDING THE SAME

(75) Inventors: Norihisa Matsumoto, Hirakata (JP); Tatsuo Wada, Hirakata (JP)

(73) Assignee: Komatsu Ltd., Tokyo (JP)

( * ) Notice: Subject to any disclaimer, the term of this patent is extended or adjusted under 35 U.S.C. 154(b) by 14 days.

(21) Appl. No.: 12/065,959

(22) PCT Filed: Aug. 24, 2006

(86) PCT No.: PCT/JP2006/316627

§ 371 (c)(1),
(2), (4) Date: Mar. 6, 2008

(87) PCT Pub. No.: WO2007/032191

PCT Pub. Date: Mar. 22, 2007

(65) Prior Publication Data

US 2009/0101372 A1 Apr. 23, 2009

(30) Foreign Application Priority Data

Sep. 14, 2005 (JP) ..... 2005-267098
Sep. 15, 2005 (JP) ..... 2005-268443

(51) Int. Cl.
*E02F 3/76* (2006.01)

(52) U.S. Cl. ..... 172/811; 37/266

(58) Field of Classification Search ..... 37/214, 37/206, 231–234, 253, 266; 172/810, 811, 172/815; D15/10, 11, 25, 23, 32
See application file for complete search history.

(56) References Cited

U.S. PATENT DOCUMENTS 5,392,864 A 2/1995 Lindenmuth
D477,610 S * 7/2003 Matsumoto et al. ..... D15/11
6,938,701 B2 9/2005 Matsumoto et al.

FOREIGN PATENT DOCUMENTS

JP 05-42344 U 6/1993
WO WO-93/22512 11/1993
WO WO-03/091504 A1 11/2003
WO WO-2004-044337 A1 5/2004

* cited by examiner

*Primary Examiner*—Robert E Pezzuto
(74) *Attorney, Agent, or Firm*—Global IP Counselors

(57) ABSTRACT

A blade has an overall blade width of W, and includes a central front portion, interposition front portions, and side front portions. A straight first edge section is arranged on the lower end of the central front portion. Each of the front surfaces of the central front portion, the interposition front portions, and the side front portions is formed in an arc-shaped surface that has a prescribed radius R2. The radius R2 satisfies the following formula: R2=(0.7 to 1.0)×H, where H is the height from the edge of the first edge section to the top end of a soil retaining plate in side view in a digging posture when the edge angle α of the edge sections is an angle of 40° to 55°.

8 Claims, 31 Drawing Sheets

A–A

D–D

WORK MACHINE BLADE DEVICE AND WORK MACHINE INCLUDING THE SAME

CROSS-REFERENCE TO RELATED APPLICATIONS

This U.S. National stage application claims priority under 35 U.S.C. §119(a) to Japanese Patent Application No. 2005-267098, filed in Japan on Sep. 14, 2005, and Japanese Patent Application No. 2005-268443, filed in Japan on Sep. 15, 2005. The entire contents of Japanese Patent Application Nos. 2005-267098 and 2005-268443 are hereby incorporated herein by reference.

TECHNICAL FIELD

The present invention relates to a blade that is attached to various types of work machines such as a bulldozer and a wheel dozer, and in particular to a blade device that is suitable for work such as digging, soil carrying, and leveling, has excellent working efficiency, and improves the fuel efficiency, the economical efficiency and the like of a work machine, and to a work machine including this blade device.

BACKGROUND ART

In various types of construction sites such as construction work and civil engineering work, various types of work machines such as a bulldozer and a wheel dozer are often used. These types of work machines include a blade as a working implement. This type of blade is widely used for dozer work such as for digging soil carrying, banking, compaction and leveling.

In order to maximize working efficiency in these types of work machines, it is important for a blade to satisfy various requirements. Exampled of the requirements can be provided by increase of the amount of soil carrying per one cycle (blade capacity) as much as possible, reduction of resistance in digging and soil carrying, suitability for various types of soil for prevention of stick of the soil on a blade in digging, and the like. Also, banking, compaction, and leveling are preferably performed by one blade that satisfies above requirements. The reason is that such a blade can extremely improve working efficiency. If the structure, shape, width, height, position and digging angle of edge section (cutting edge) and the like of a blade are determined to satisfy these requirements, it is possible to provide advantages that improve the working efficiency of a work machine, reduce fuel consumption, and shorten the total construction time, for example. Also, to optimize the working performance of a bulldozer, in the power balance in the soil carrying work, it is necessary that the traction force of the bulldozer is higher than soil carrying resistance, and the driving force of the machine is higher than the traction force of the bulldozer.

The engine power that is required for digging and soil carrying work in a bulldozer is mostly consumed for the driving force of the machine, the traction force in digging and soil carrying, and the like. Accordingly, it is important to reduce the amount of energy loss in power transmission to improve fuel efficiency. Also, it is strongly required to reduce resistance in digging and soil carrying, and the like. Generally, medium-sized and small bulldozers are used for soil carrying in a short distance as compared with a large bulldozer. If the aforementioned requirements are satisfied, the engine power in digging and the soil carrying can be effectively used even in the case of a blade with the same capacity as a conventional blade or conventional traction force.

The present applicant has been already proposed a novel and unique structure of a blade in WO2004/044337A1 as one example of a blade device that increases the working amount of this type of work machine, for example.

The blade that is disclosed in WO2004/044337A1 includes a central front face section, interposition front portions that extend to be bent and inclined rearward from the right and left ends of the central front face section, and side front portions that extend to be bent and inclined frontward from the interposition front portions. In addition to this, the lower end of the central front face section has a predetermined blade width that extends in right and left directions perpendicularly to a digging direction, and a first edge section is arranged on the lower end of the central front face section. Second and third edge sections are arranged on the lower ends of the interposition front portions and the side front portions. In addition to this, an intersection line between each interposition front portion and each side front portion, and an intersection point between edges of each second edge section and each third edge sections are located rearward of the edge of the first edge section in top view. Thus, the front surface of each of the central front face section, the interposition front portions and the side front portions forms a unique shape that is defined by a curved surface that is continuously recessed from the top ends to the bottom ends.

Examples of work machines to which the blade in WO2004/044337A1 is adopted are provided by construction and earthmoving machines, for example. Typical examples of the construction and earthmoving machines are provided by a bulldozer, a wheel dozer, a motor grader, and the like. Note that "in front view", "in top view", and "in side view" used in the present specification refer to in front view, in top view, and in side view in the case where the blade touches the ground at an edge angle of high digging efficiency.

The aforementioned blade is similar to conventional blades from the viewpoint that the aforementioned blade includes the central front portion that composes a part of front surface of the blade, and the left and right side front portions that extend to be inclined frontward in the both, left and right sides of the blade. However, the aforementioned blade is very different from conventional blades from the viewpoint that the aforementioned blade includes the interposition front portions that are arranged between the aforementioned central front portion and the aforementioned side front portions and extend to be bent and inclined rearward from the left and right ends of the aforementioned central front portion, and the aforementioned left and right side front portions that extend to be bent and inclined frontward from the rear end edges of the interposition front portions.

A blade device is disclosed that has a relatively similar shape to a blade shape of the present invention but is used for work different from various types of work such as digging, soil carrying, and leveling in International Publication WO93/22512. The blade device disclosed in WO93/22512 is applied to a landfilling compacting machine that spreads and compacts trash in a landfill site or the like. The blade includes end blade portions, one plate of flat central blade portion, and a rectangular protruding portion. The end blade portions are arranged in left and right sides of the blade to protrude to be bent and inclined in a wing shape toward a traveling direction of the machine similar to a conventional U-shaped blade. The central blade portion is coupled between the left and right end blade portions. The protruding portion is arranged in the central part of the central blade portion and is inclined downward at the middle of the central blade in the vertical direction to protrude toward the traveling direction of the machine. In the case where the lower surface of the aforementioned protruding portion is placed along the machine traveling surface, the lower ends of the aforementioned end blade portions and central blade portion are also placed along the machine traveling surface.

Also, driving units of the aforementioned compaction machine use steel wheels, and compact trash or the like by means of these wheels. Here, a posture in that the lower ends of the aforementioned end blade portions and central blade portion in the blade device are orientated parallel to the traveling surface of the wheels is referred to as a first position, and a posture in that the blade is moved upward and inclined frontward is referred to as a second position. In the first position, the compacting machine travels to spread trash and soil in the horizontal direction. In the second position, the aforementioned protruding portion in the central part of the blade controls the amount of trash and soil that are brought into space between left and right wheels. In other words, the aforementioned protruding portion restricts the height of trash that is brought into the aforementioned space. In addition to this, in the second position, trash and soil are brought to compaction areas by the wheels through the space between the lower ends of the aforementioned side blade portions and the central blade portion, and the aforementioned traveling surface to control the amount of trash and soil.

As stated above, the blade device that is disclosed in WO93/22512 is developed mainly to provide function that spread trash and the like, and function that control the compaction amount of trash and the like, and prevent damage to the lower surface of the machine caused by an excess amount of trash that is brought into the space that is formed between the left and right wheels as compacting members by controlling the amount of trash that is brought into the aforementioned space. Accordingly, it can be understood that the blade shape of the present invention and the blade that is disclosed in this publication have the following large differences based on comparison between the blade shape and the blade that have essentially different function from each other.

That is, (1) in order that the central front portion of the blade that is disclosed in the foregoing WO2004/044337A1 can gather and hold a large amount of excavated soil, the blade have a continuous surface from the upper end to the lower end of the central part of the blade. On contrary to this, since the central protruding portion of the blade in the foregoing WO93/22512 corresponding to this central front portion mainly serves to prevent an excess amount of trash, the central protruding portion protrudes from the middle to the lower end of the central blade portion in the vertical direction. (2) In WO2004/044337A1 the intersection line between each of the pair of, left and right interposition front portions and each of the pair of, left and right side front portions is located rearward relative to the central front portion in top view, and the front ends of side front portions extend in proximity to the elongation line of the lower end of the central front portion. On contrary to this, although not described in WO93/22512, with reference to the drawings in WO93/22512, the front ends of the pair of, left and right side blade portions that protrude frontward from the central blade portion are positioned frontward relative to the protruding lower end of the central protruding portion.

As stated above, these differences result from the difference of essential function between the blade device of the invention and the blade device that is disclosed in the publication.

In the aforementioned blade that is proposed in WO2004/044337A1, the first edge section of the central front portion and the front ends of the third edge sections of the aforementioned side front portions are substantially aligned, or the third edge sections are positioned slightly rearward of the first edge section. As a result, the aforementioned first edge section excavates earth prior to the third edge sections that are arranged on the lower end of the side front portions. Accordingly, the digging power of the interposition front portions and the side front portions is reduced, and this reduction can facilitates digging. However, in actual use, the front end of the aforementioned third edge section may protrude slightly frontward of the first edge section in some cases. In such cases, the front end of the third edge section will excavate earth prior to the first edge section. But, the amount of protrusion is very small. The substantial digging power of the whole third edge section of the aforementioned side front portion is very small as compared with the digging power of the aforementioned first edge section. Such protrusion has no effect.

Accordingly, in the blade that is disclosed in the foregoing WO2004/044337A1, the traction force that acts on the aforementioned third edge section is greatly reduced as compared with conventional blades. Also, the resistance such as digging resistance and soil carrying resistance acts substantially uniformly on the aforementioned first edge section and the aforementioned third edge sections. Also, the traction force effectively acts on both the aforementioned first edge section and the aforementioned third edge section. As a result, soil that is excavated by the aforementioned third edge sections and soil that is excavated by the aforementioned first edge section are smoothly gathered through the second edge sections. Also, an intersection area that is interposed between the interposition front portion and the side front portion serves as a soil holding portion. Accordingly, it is possible to effectively hold a large amount of carried soil.

The synergistic effect by these actions can reduce the aforementioned resistance, and can greatly increase the amount of soil per traction force. In addition to this, the consumption power in digging and the soil carrying can be greatly reduced. The amount of digging and soil carrying can be maximized with a minimum energy amount in a short time. The fuel efficiency of the aforementioned work machine is remarkably improved. As a result, it is possible to reduce cost per earthwork amount.

In the most cases, in this type of blade, the front surface of a blade is formed in an arc-shaped surface that continuously extends at a predetermined curvature radius in the vertical direction and is recessed rearward.

SUMMARY OF THE INVENTION

In the blade that is disclosed in the foregoing WO2004/044337A1, the unique structure can provide operation and effect that cannot be expected from conventional blades. However, in the case where a blade to which the front shape of the blade that is disclosed in WO2004/044337A1 is adopted has a radius similar to conventional semi-U-shaped blade and a rearward inclination angle of about 10°, and the radius of the blade is 0.5 to 0.7 time the height of the blade from the lower end of the edge section that is fixed on the lower end of the blade to the upper end of the blade in case where the digging angle of the blade corresponds to a digging posture, soil sticks on the front surface of the blade, and does not drop off in digging. Thus, it is found that, in such configuration, digging efficiency is greatly reduced. Also, in some design cases of the central front portion, the interposition front portion and the side front portion, although the design cases are not many, blades have digging efficiency lower as compared with conventional semi-U-shaped blades with the same blade capacity. Also, there is a disadvantage in that, in soil carrying, when soil is carried in turning operation, the soil that is loaded on the blade slides down the blade from the central front portion to the outside interposition front portion in a short time in the turning operation, so that all the soil immediately flows out from the side front portion.

The present invention has been made to solve such a disadvantage. Specifically, it is a main object of the present invention to provide a work machine blade device that reduces the aforementioned resistance, greatly increases the amount of soil per traction force, greatly reduces consumption power in digging and soil carrying and maximizes the amount of digging and soil carrying with a minimum energy amount in a short time similar to the foregoing WO2004/044337A1, and additionally facilitates removing soil from the surface of a blade in digging, surely provides digging efficiency higher than conventional semi-U-shaped blades and prevents carried soil from dropping off when soil is carried in turning operation. Other objects will be understood in the following detail description of the preferred embodiments.

The foregoing object can be effectively attained by basically providing a work machine blade device according to one aspect of the present invention that is attachable to various types of work machines. The blade device includes a blade that includes a central front portion; interposition front portions, and left and right side front portions. The interposition front portions are bent and connected to the left and right ends of the central front portion. The side front portions are connected to the central front portion through the interposition front portions. The lower end of said central front portion has a blade width W1 that extends in the left-and-right direction perpendicular to a digging direction, and is provided with a first edge section. The lower ends of each of said interposition front portions and each of said side front portions are provided with second and third edge sections, respectively. An intersection line between each of said interposition front portions and each of said side front portions, and an intersection C between the edges of each of said second edge sections and each of said third edge sections are positioned rearward relative to the edge of said first edge section in top view. The front surface of each of said central front portion, said interposition front portions, and said side front portions is formed in a curved, recessed surface that continuously extends from the top end to the lower end of each front portion and has a radius R2. Each of said edge sections extends in the tangential direction from the lower end of each of said front portions. Said radius 12 satisfies an equation (I): R2=(0.7 to 1.0)×H, where H is the height from the edge of said first edge section to the top end of said central front portion in side view in a digging posture in that the edge angle α of each of the edge sections is in a range of 40° to 55°. In addition to this, the blade device can include a soil retaining plate that is composed of a steel plate member that extends in the tangential direction from the top end of the central front portion. In this case, the height H is substituted by the height from the edge of the first edge section to the top end of the soil retaining plate.

A preferable blade device is effectively provided by the blade device, in the case where W1 is a blade width of said central front portion that is determined by a blade capacity, Wt is an interval between the elongation line of said first edge section and a straight line that is parallel to this elongation line and pass said intersection of the edges of the each of said second edge sections and each of said third edge sections, δ is the rearward bending angle between the edge of said first edge section and that of said second edge section, in that said interval Wt and the rearward bent angle δ satisfy the following equations (II) and (III), respectively.

$$Wt>0.65\times(W1/10) \quad \text{(II)}$$

$$14°<\delta<30° \quad \text{(III)}$$

Note that Wt and W1 can be actual values (mm), or reference values (dimensionless number).

More preferably, the intersection angle θ between the respective elongation lines of edge sections of said central front portion and said side front portion is $0°<\theta\leqq 25°$.

Thus, said right and left interposition front portions are arranged to be continuous to said central front portion and to be inclined rearward in a range of said rear bending angle δ in top view, and said left and right side front portions are arranged to be continuous to said interposition front portions and to be inclined frontward at said intersection angle θ similarly in top view. That is, said interposition front portion and said side front portion are connected to form a V or U shape, and said second edge section and said third edge section are connected to form a V or U shape.

Also, in the present invention, it is preferable that at least the first edge section of said central front portion is substantially equal to the blade width W1 of the lower end of the central front portion, and said central front portion is formed in a curved surface that is recessed reward and becomes gradually wider from the lower end toward the top end of the central front portion. Also, the blade width W1 of the lower end of said central front portion is preferably larger than the inside width between left and right tractor units. The blade width W1 of the lower end of said central front portion is more preferably substantially equal to the gauge width of interval between centers of the left and right driving units.

Also, it is preferable that said second edge sections are arranged to be inclined slightly downward toward the left and right sides relative to the first edge section, and said third edge section are arranged to be inclined slightly upward toward the left and right sides relative to said second edge sections. It is preferable that blade front surfaces of said interposition front portions and said side front portions have the same curved surface as said central front portion.

A work machine blade device according to one aspect of the present invention includes a central front portion, left and right interposition front portions, and left and right side front portions. The lower end of the central front portion has a blade width W1 that extends in the left-and-right direction perpendicular to a digging direction. The central front portion includes a first edge section that extends from the lower end of the central front portion along the tangential direction of an arc-shaped surface of the central front portion. The interposition front portions are bent and connected to the left and right ends of the central front portion. The interposition front portions include second edge sections that extend from the lower ends of the interposition front portions along the tangential direction of an arc-shaped surface of the interposition front portions. The left and right side front portions are farther connected to left and right through the interposition front portions. The side front portions include third edge sections that extend from the lower ends of the side front portions along the tangential direction of an arc-shaped surface of the side front portions. In addition to this, an intersection line between each of said interposition front portions and each of said side front portions, and an intersection between the edges of each of said second edge sections and each of said third edge sections are positioned rearward relative to the edge of said first edge section in top view. In addition to this, the front surface of each of the central front portion, the interposition front portions, and the side front portions has the arc-shaped surface that continuously extends from the top end to the lower end of each front portion and has a radius R2. In addition to this, in the case where H is the height from the edge of the first edge section to the top end of the central front portion in side view in a digging posture, the radius R2 satisfies the following equation (I)

$$R2=(0.7 \text{ to } 1.0)\times H \quad \text{(I)}$$

A work machine blade device according to one aspect of the present invention includes a central front portion, left and right interposition front portions, and left and right side front portions. The lower end of the central front portion has a blade width W1 that extends in the left-and-right direction perpendicular to a digging direction. The central front portion includes a first edge section that extends from the lower end of the central front portion along the tangential direction of an arc-shaped surface of the central front portion. The interposition front portions are bent and connected to the left and right ends of the central front portion. The interposition front portions include second edge sections that extend from the lower ends of the interposition front portions along the tangential direction of an arc-shaped surface of the interposition front portions. The left and right side front portions are connected to the central front portion through the interposition front portions. The side front portions include third edge sections that extend from the lower ends of the side front portions along the tangential direction of an arc-shaped surface of the side front portions. In addition to this, an intersection line between each of said interposition front portions and each of said side front portions, and an intersection between the edges of each of said second edge sections and each of said third edge sections are positioned rearward relative to the edge of said first edge section in top view. In addition to this, the front surface of each of the central front portion, the interposition front portions, and the side front portions has the arc-shaped surface that continuously extends from the top end to the lower end of each front portion and has a radius R2. In addition to this, the blade device comprises a steel plate member that extends substantially in the tangential direction at least from the top end of said central front portion. In addition to this, in the case where H is the height from the edge of the first edge section to the top end of the steel plate member in side view in a digging posture, the radius R2 satisfies the following equation (I)

$$R2=(0.7 \text{ to } 1.0)\times H \quad \text{(I)}$$

Operation and Effect

The outline shape of loaded soil on a blade according to the present invention is a shape that greatly protrudes frontward from the top end to the lower end of said central front portion exceeding the angle of repose in the central part of the blade similar to the blade that is disclosed in WO2004/044337A1. On contrary to this, in the conventional blades, the outline shape of carried soil is a straight, flat shape that has an inclination angle substantially equal to the angle of repose from the top end to the lower end of the blade. That is, similarly to the foregoing WO2004/044337A1, in the present invention, the amount of digging and soil carrying can be also maximized with a minimum energy amount in a short time, and the fuel efficiency of a work machine is remarkably improved. As a result, it is possible to reduce cost per earthwork amount.

After the blade that is disclosed in WO2004/044337A1 has been proposed, various types of experimental operation are repeatedly performed, and the problems stated above are found. For this reason, various types of experimental operation and redesign are repeatedly performed. As a result, it is found that a unique and complicated blade shape according to the present invention causes that soil is less likely to remove from the surface of a blade in digging, that variation occurs in digging efficiency, and that soil drops off from the blade when soil is carried in turning operation. Specifically, examples of reasons that cause these problems are provided that the front curved surface of the blade and the rearward inclined posture of the whole blade are configured similarly to conventional, exemplary semi-U-shaped blades, and that indices are not defined to objectively determine the optimal shapes of the central front portion, the interposition front portion and the side front portion in accordance with the capacity of a blade, and the relative ratio of the blade widths of the front portions and the like.

In the present invention, the blade front surfaces of said central front portion, said interposition front portion, and said side front portion are preferably inclined rearward similarly to conventional blades. But, if the blade front surfaces are inclined rearward too much, carried soil sticks on the blade and does not slide down in soil dumping. This results from the unique blade shape according to the present invention. In order to avoid this, it is conceivable that the edge angle is designed similar to conventional blades, and the front surface of each edge section extends along the elongation line of the front surface of the blade lower end. In the case where the whole blade is inclined rearward, on condition that the inclination angle of the surface of soil that stands on and is held by a blade, i.e., the angle of repose is fixed, it is possible to reduce the ground-touch length of the soil that stands on the ground, but it is possible to load a large amount of soil on the blade. For this reason, also in the case where the front surface of each edge section is arranged on the elongation line of the front surface of each blade lower end, it is necessary to devise a method of inclining the whole curved surface of the blade rearward. If this devisal is attained, in addition to ensuring conventional digging capability, it is possible to increase the amount of carried soil and to greatly reduce soil carrying resistance and the like, and it is possible to greatly reduce consumption power per traction force, and as a result it is possible to provide excellent, low fuel consumption performance.

In the blade device according to the present invention that has the aforementioned unique whole shape, in the state where the edge angle $\alpha$ of the edge section is the same as the edge angle in the foregoing WO2004/044337A1, and the rearward inclination angle $\gamma$ is 0°, the top end of the edge section is secured to the lower end of the front surface of the blade that is formed in an arc-shaped surface with a predetermined curvature radius in the tangential direction of said arc surface. According to the result of experiment, in the case where the edge section is secured to the lower end of the front surface of the blade that is formed in an arc-shaped surface with the same curvature radius (=0.5 to 0.7×H, where H is the height from the ground surface to the blade top end) as WO2004/044337A1 to extend in the tangential direction of the arc-shaped surface, the rearward inclination posture of the blade rises. As a result, the amount of soil loading decreases. For this reason, the edge angle $\alpha$ is designed in a range of 40° to 55° similar to WO2004/044337A1, which is smaller than a typical angle not less than 50° in conventional blades, in order to maintain the rearward inclination posture of the whole blade. If the edge angle $\alpha$ is smaller than this range, digging efficiency greatly decreases. However, it is found that, if the edge angle $\alpha$ is simply designed small, a force becomes weak that presses soil that already stands on the blade upward of the blade by soil that is being excavated. In particular, in digging, soil is likely to stick on the blade, and soil is less likely to remove from the blade, and as a result the resistance of soil increases. Consequently, a desired loading amount cannot be provided.

Therefore, in the present invention, in order to avoid the deterioration of digging performance, the edge angle α of the blade is designed in range of 40° to 55°, and the curvature radius of the arc-shaped surface is greatly increased relative to the radius of the aforementioned arc-shaped surface of the front surface in conventional blades with the same blade capacity. That is, typically, such a curvature radius is designed in a range of not less than 0.5 and not more than 0.7 time the blade height H that is calculated based on the blade capacity, on contrary to this, the curvature radius according to the present invention is designed in a range of not less than 0.7 and not more than 1.0 time the blade height H. In the case where the radius of the arc-shaped surface is thus increased, soil that is loaded on the blade in digging is unlikely to stick on the front surface of the blade, and the resistance of soil becomes low, and as a result soil is smoothly moved upward. Consequently, it is possible to provide a desired amount of soil carrying. Also, even in the case where the rearward inclination angle γ that is the difference between the edge angle α and the digging angle β, dissimilar to the case where digging is performed by using simple design with the digging angle β, soil removal is improved. Note that the rearward inclination angle γ preferably falls within a range of 0° to 15°.

Also, in a blade device that has the aforementioned unique blade shape according to the present invention, it is found that the digging efficiency of the blade device is determined by three parameters of the blade width W1 of the central front portion, the interval Wt (hereinafter, referred to as a recessed amount), and the bending angle δ. The interval Wt is an interval between the intersection of the edge of the interposition front portion and the edge of the side front portion, and the elongation line of the first edge of the central front portion. The bending angle δ is an angle of the edge of the second edge section of the interposition front portion that is bent rearward relative to the edge of the first edge section of the central front portion. The above equations (II) and (III) show the correlation among the three parameters. In addition, said rearward bending angle δ has the upper and lower limits. The lower limit specifies the lower limit (%) of said digging efficiency. For example, the lower limit ensures that the digging efficiency in the present invention exceeds the digging efficiency in semi-U-shaped blades. Also, the upper limit of the rearward bending angle δ ensures that carried soil is prevented from dropping off when soil is carried in turning operation.

When the value of the aforementioned recessed amount Wt is determined suitably for the blade capacity in design, the optimal rearward bending angle δ can be selected based on the above range suitably for the blade capacity. Generally, the blade width W1 of the central front portion is preferably designed substantially equal to the distance between the center lines of the left and right tractor units of a work machine (gauge width). Also, the overall width W of a blade is determined by the blade capacity, and similarly the blade width W1 of the central front portion, which is equal to the gauge width WG, is determined. However, said blade width of the whole blade, the gauge width WG, and the blade width W1 are changed in accordance with the blade capacity. For example, with reference to the overall blade width W of a blade with the blade capacity of 45 m3, if the blade capacity is smaller than 45 m3, the actual overall blade width of the central front portion is shorter than said blade width W. If the blade capacity is greater than 45 m3, the actual overall blade width of the central front portion is longer than said blade width W.

In the present invention, the relative value Wt of the recessed amount of the intersection between the edges of the interposition front portion and the side front portion relative to the edge of said central front portion is determined by multiplying the thus-obtained actual blade width W1 by 0.65/10 as a constant that is obtained in the experiment. After the recessed amount Wt is determined, when the rearward bending angle δ is selected from the foregoing range of rearward bending angle δ to provide the most excellent digging efficiency and suitable for soil carrying in turning operation based on a correlation diagram, since the overall width W of the blade is already determined, the dimension W4 between the lower end bending point between the central front portion and the interposition front portion, and the outside end surface of the side front portion in top view is automatically determined.

However, the intersection angle θ between the elongation line of the edge of the central front portion and the elongation part of the edge of the side front portion is not yet determined. The intersection angle θ specifies a soil holding portion that is formed between the front surfaces of said interposition front portion and side front portion in the front surface of a bent part. Therefore, in addition to the aforementioned rearward bending angle δ, the intersection angle θ is also an important factor. Additionally, the intersection angle θ has an influence on the magnitude of the digging performance of the side front portion, which varies depending on soil properties in construction sites. The intersection angle between said interposition front portion and said side front portion in said soil holding portion can be calculated by 180°−(δ+θ). In order to hold soil, θ is preferably as large as possible. However, in the case of a semi-U-shaped blade that has a simple shape relative to the blade according to the present invention, if soil in a construction site is soft, and only leveling function is required, for example, θ can be designed closer and closer to 0°.

Also, if soil is hard, and side cut function is required, θ is necessarily designed to a large extent. Thus, although it is difficult to independently determine θ, θ can be determined in accordance with function that is required for the side front portion taking said rearward bending angle δ into consideration. In order to ensure side cut function, it is said that the maximum value of θ is an extent of about 25°.

If the intersection angle θ exceeds 25°, a load is concentrated on the edge of the third edge section of the side front portion. In this case, an excess load is applied in digging, and such a load is not uniformly applied over the whole edge section. This may cause damage to the edge or the like. Also, as stated above, a blade device to which the present invention is applied is also often used for leveling. From this viewpoint, said intersection angle θ is required to be closer and closer to 0° in some cases. From these viewpoints, it is preferable that the intersection angle θ is designed more than 0° and not more than 25°. Depending on determination of the rearward bending angle δ and the intersection angle θ, the ratio between the lengths of the blade widths of said interposition front portion and said side front portion correspondingly varies. The reason is that the total length of said interposition front portion and said side front portion is already determined. Accordingly, the ratio between the lengths of the blade widths of the interposition front portion and the side front portion also cannot be independently determined.

Also, in the present invention, the reason that the blade width of the lower end of said central front portion is greater than the inside width between the left and right tractor units is that, in the case where a machine travels forward for leveling, this blade width is the minimum width required for leveling without leaving the tracks of the tractor units on the ground. In particular, in the case where the central front surface blade width of the lower end of the central front portion is designed equal to the gauge width of the distance between the centers of the left and right tractor units, it is possible to provide the most excellent balance among digging, soil carrying, and leveling.

Generally, examples of work by the aforementioned work machines are mainly provided by digging, soil carrying, leveling. It is important for the machines to be equipped with a blade that has function for different work. The blade according to the present invention has leveling function in addition to digging and soil carrying.

Generally, in this type of leveling work, two factors are required for a machine. One of the factors is, when excavating earth and leveling ground with moving soil frontward, to embed the soil in a recess on the way of moving the soil. Another is to uniformly level ground. In the present invention, in the case where the blade width of said central front portion is large, so-called leveling function is improved. In blades to which the present invention is adopted, said central front portion protrudes frontward relative to the aforementioned left and right interposition front portions and side front portions in top view in most cases. Although said interposition front portions and side front portions according to the present invention also have leveling function, the leveling function is mainly performed by said central front portion. From this viewpoint, also in the present invention, the blade width of said central front portion can be wide.

In the present invention, the front ends of the third edge sections of the side front portions are not always positioned rearward relative to the elongation line of the first edge section of the central front portion. The front ends of the third edge sections may protrude forward relative to the elongation line. That is, as long as the front ends of the third edge sections of said side front portions are positioned in proximity to the elongation line of the edge of said first edge section, similar to the blade according to WO2004/044337A1, the first edge section and the third edge section can excavate soil substantially simultaneously with each other so that the soil that is excavated by the edge section of said side front portions and the soil that is excavated by the first edge section of said central front portion are smoothly gathered through the interposition front portions. In this case, it is possible to greatly increase the amount of soil carrying. Also, in the present invention, as the blade width of the central front portion increases, it is necessary to reduce the width that is occupied by the interposition front portions and the side front portions in top view.

In the case where the width that is occupied by the interposition front portions and the side front portions is reduced, and resistances such as a digging resistance and a soil carrying resistance are reduced to greatly increase the amount of soil carrying, the length along the lower ends of the interposition front portion and the side front portion is preferably constant. That is, in order to increase the blade width of the central front portion, and to surely provide the required length along the lower ends of the interposition front portion and the side front portion, it is necessary to decrease the intersection angle between the interposition front portion and the side front portion in top view. As a result, it is necessary to increase the distance between the edge section position of the central front portion, and the supporting point of a straight frame that supports the blade.

If the distance between the edge section position of the central front portion and the supporting point of the straight frame that supports the blade is increased, unevenness of ground affects a machine much in digging so that the machine is likely to have pitching moment in front-and-rear direction. As a result, the blade rolls much upward and downward. The central front portion cannot stably excavate earth. The digging surface is likely to be uneven. Ground cannot be uniformly leveled. If these viewpoints are taken into consideration, it is necessary to determine the blade width of said central front portion taking the blade width of the interposition front portion and the side front portion into consideration in top view as stated above. In the present invention, since the blade width of said central front portion is designed substantially equal to the gauge width as the distance between the centers of the left and right tractor units, the effective digging performance per edge width is increased. Therefore, it is possible to effectively excavate earth and to effectively carry soil, and additionally to uniformly level ground.

Also from this viewpoint, as compared with the blade that is disclosed in International Publication WO93/22512, it can be understood that the configuration of the blade in WO93/22512 is very different from the blade according to the present invention. That is, according to the foregoing Publication, in the blade that is disclosed therein, the effective width of said central protruding portion is substantially equal to the distance between the left and right wheels as compacting devices, i.e., the distance between the opposed surfaces of the left and right wheels. This configuration is natural for the function of the central protruding portion that prevents a large amount of trash from entering space that is formed between the left and right wheels.

In a preferable blade in the present invention, said left and right interposition front portions are connected to said central front portion and inclined rearward at a predetermined angle, and include the second edge sections on the lower ends of the left and right interposition front portions, and additionally said left and right side front portions are connected to said interposition front portions and inclined frontward at a predetermined angle, and include the third edge sections on the lower ends of the left and right side front portions. Also, from this viewpoint, the blade according to the present invention is different from the blade that is disclosed in the foregoing WO93/22512.

In this self-propelled work machine, typically, an engine compartment is arranged in the front central part of a machine body. An operator operates various types of operation levers behind the engine compartment. Thus, the operator's field of view is interrupted by the engine compartment. As a result, the operator cannot directly see the amount of excavated soil that stands on a central front portion.

Even in the present invention, in a posture of said blade in that the digging performance is maximized, normally, in front view when the blade touches ground with an edge angle, in the case where the edges of the edge sections of the central front portion, the left and right interposition front portions, and the left and right side front portions are aligned on one straight line, the operator can see only the amount of soil that stands between said interpositions front portion and said side front portions that are arranged on the left and right sides of the blade. The amount of soil that stands on the central front portion is increased by adding the amount of soil that stands between the interposition front portion and the side front portion as stated above. Accordingly, when operator can see soil that is held between the interposition front portion and the side front portion diagonally from above, the amount of soil that is held on the central front portion often exceeds a predetermined amount. This makes blade operation complicated.

Accordingly, in a preferable blade in the present invention, in the posture of said blade in that the digging performance is maximized, normally, in front view when the blade touches ground with an edge angle, both said left and right second edge sections are arranged to be inclined slightly downward relative to the central first edge section, and said third edge sections are arranged to be inclined slightly upward relative to said second edge sections.

In the thus-configured blade, the transition part between the second edge section and the third edge section engages ground in a normal posture. Therefore, it is possible to provide a more digging amount than conventional blades in a part between the second edge section and the third edge section in digging. Accordingly, the amount of soil that stands between the interposition front portion and the side front portion increase as the amount of soil in the central front portion increases. As a result, even if the operator cannot see the amount of soil that stands on the central front portion, the operator can see the amount of soil that is held between the left and right interposition front portions and side front portions to know a proper amount of soil that stands on the central front portion. Consequently, the operator can smoothly operate the blade.

In the blade according to the present invention, said central front portion, said interposition front portions, and said side front portions can be separately formed, and can be connected to each other by welding. However, the size, thickness and the like of the blade may be suitably designed to partially substitute a casting for the front portions.

Also, in the present invention, since the width of the edge section of the lower end of said side front portion is determined based on the relative relationship between the widths of the edge sections of the side front portion and the interposition front portion, it is difficult to independently determine the width of the edge section of the lower end of said side front portion. It is preferable that the width of the edge section of the lower end of said side front portion is designed smaller than the width of the edge section of the lower end of said central front portion, and is designed substantially equal to the width of the edge section of the lower end of said interposition front portion. In the case where the widths of the front portions are designed in the above dimensional relationship, it is possible to optimize the amount of soil that arises and is held along the blade front surfaces of said interposition front portions and said side front portions, and it is possible to reduce the resistance of soil against said central front portion. For this reason, the above dimensional relationship is preferable. However, in consideration of digging efficiency, as stated above, the blade widths of the interposition front portion and the side front portion are restricted by the recessed amount Wt of the intersection between the second edge section of the interposition front portion and the third edge section of the side front portion, and the rearward bending angle δ between the first edge section of the central front portion and the second edge section of the interposition front portion. For this reason, the blade widths of the interposition front portion and the side front portion will often have a difference.

In the present invention, the intersection angle between the respective elongation lines of edge sections of said central front portion and said side front portion is designed in a range of 0° to 25°. In particular, if side cut function is considered as important, this intersection angle is preferably designed in a range of 18° to 25°. In the case where the intersection angle θ falls within a range of 18° to 25°, it is possible to surely load the optimal amount of soil on the blade front surfaces of said interposition front portion and said side front portion, and it is possible to reduce the resistance of soil that moves from said side front portion toward said interposition front portion. If intersection angle θ is smaller than 18°, the side cut function is not performed. However, as stated above, the side front portion does not have only side cut function but also leveling function. If the third edge section of the side front portion is required to perform leveling function, said intersection angle θ can be closer and closer to 0°. Also, in the present invention, in the case where the edge angle between the front surface and the ground falls within a range of 40° to 55° in the state where the edge of each edge section is placed on the ground, it is possible to effectively provide the minimum amount of digging and soil carrying energy, and the maximum amount of soil.

A guard member according to a first aspect of the present invention is arranged on the top end of a work machine blade that is mounted to a work machine. The guard member has a soil contact surface that is inclined frontward relative to the elongation line of the work machine blade front surface in the top end of the work machine blade in side view.

For example, the guard member is arranged on the top end of the work machine blade that is mounted to the front part of a work machine such as a bulldozer. The guard member is fixed to be inclined at a mount angle of the soil contact surface in side view so that the guard member is inclined frontward relative to the elongation line of the front surface of the work machine blade in the top end of the work machine blade.

The guard member is fixed to the top end of the work machine blade in order to increase the amount of soil carrying, and includes a plate-shaped member and a plurality of ribs that are mounted on the back surface side of the plate-shaped member, for example. The soil contact surface of the guard member refers to a surface that comes in contact with soil to push the soil frontward in a soil carrying work, and the like.

Generally, in the case where a guard member is fixed to a work machine blade, the guard member is fixed so that the soil contact surface extends along the elongation line of the front surface of the work machine blade in the top end of the work machine blade to which the guard member is fixed, or is inclined rearward relative to said elongation line in side view. Accordingly, when soil that is gathered in the front part of the work machine blade reaches the position of the guard member on the top end of the work machine blade in soil carrying work, the soil may ride over the guard member and may flow out rearward. In particular, when soil is pushed in the state where the work machine blade is inclined rearward, the angle of the soil contact surface of the guard member is further inclined rearward. As a result, the amount of soil that falls rearward is increased.

For this reason, in the guard member according to the present invention, the guard member that is mounted to the top end of the work machine blade is attached to be inclined so that the soil contact surface is inclined frontward relative to the elongation line of the front surface of the work machine blade in the top end of the work machine blade in side view.

Accordingly, even when soil that is gathered in the front part of the work machine blade reaches the position of the guard member on the top end of the work machine blade in a soil carrying work, the soil contact surface of the guard member can provide a flow that returns the soil frontward. Therefore, it is possible to greatly reduce the amount of soil that flows out rearward in a soil carrying work. Consequently, in the case the guard member is fixed to the top end of the work machine blade to adjust the fixation angle of the guard member, this simple configuration can provide efficient carry soil work.

A guard member according to a second aspect of the present invention, in the guard member according to the first aspect of the present invention, the frontward inclination angle of the guard member falls within a range of more than 0 degrees and not more than 50 degrees relative to the elongation line of the front surface of the work machine blade.

In this configuration, the guard member is fixed to the work machine blade so that the frontward inclination angle of the soil contact surface of the guard member on the top end of the work machine blade falls within the above predetermined range.

This configuration provides a flow that moves soil that is gathered in the proximity of the guard member frontward in soil carrying work. Therefore, it is possible to effectively reduce the amount of soil that flows out rearward as compared with a work machine blade with a conventional guard member mounted thereto.

In the above value range, the lower limit of an angle more than 0 degrees is specified to incline the soil contact surface of the guard member frontward relative to the elongation line of top end of the front surface of the work machine blade at an even small angle to reduce the amount of soil that flows out rearward in soil carrying work. Also, the reason that the upper limit of 50 degrees is specified is that, if said frontward inclination angle is too large, such a too large angle disturbs a flow that returns soil in the front part of the work machine blade frontward in a soil carrying work.

Accordingly, in order to effectively reduce the amount of soil that flows out rearward in the upper part of the work machine blade, and to effectively provide a flow that returns soil frontward, the inclination angle of the guard member preferably falls within a range of 5 to 30 degrees relative to the work machine blade.

In a guard member according to a third aspect of the present invention, in the guard member according to the first or second aspect of the present invention, front viewing openings are formed on the both ends of the soil contact surface.

In this configuration, the openings through which an operator of the work machine sees frontward of the work machine blade are arranged on the both ends of the guard member that is arranged on the top end of the work machine blade. Typically, it is known that, when seeing the state of soil in the front part of the work machine blade, the operator sees parts in proximity to the both ends of the work machine blade.

Accordingly, even in the case where the guard member, which interrupts the operator's field of view, is fixed on the top end of the work machine blade to which the operator turns operator's eyes when seeing frontward of the work machine blade, since the viewing openings are arranged on the both ends of the guard member, it is possible to prevent reduction of the front visibility of the operator in the work machine blade. Consequently, it is possible to reduce the amount of soil that flows out rearward, and to ensure the front visibility of the operator in the work machine blade.

A work machine blade according to a fourth aspect of the present invention includes the guard member according to any of the first to third aspect of the present invention, a mount portion that is mounted to a work machine, and a front portion that has a surface that is connected to the soil contact surface of the guard member.

In this configuration, this aspect of the invention is defined by the work machine blade that includes the guard member that is arranged on the top end of the work machine blade.

Accordingly, the guard member that is arranged on the upper end of the work machine blade can reduce the amount of soil that flows out rearward.

Note that the guard member can be fixed to the top end of the work machine blade by welding, or can be formed as an extending part of the upper part of the work machine blade.

In a work machine blade according to a fifth aspect of the present invention, in the work machine blade according to the fourth aspect of the present invention, recessed parts are formed on the both ends of the front portion.

In this configuration, in order to reduce the ground contact area of the front end of the work machine blade in digging, the recessed parts are formed on the both side portions of the front portion of the work machine blade.

Accordingly, the work can be efficiently performed in the state where the ground contact area of the front end of the work machine blade in digging is reduced and, therefore, the ground touch resistance is less. In addition to this, since the recessed parts can also hold soil, it is possible to increase the amount of carried soil as compared with conventional work machine blades.

DETAILED DESCRIPTION OF THE PREFERRED EMBODIMENTS

First Embodiment

Figure 1:
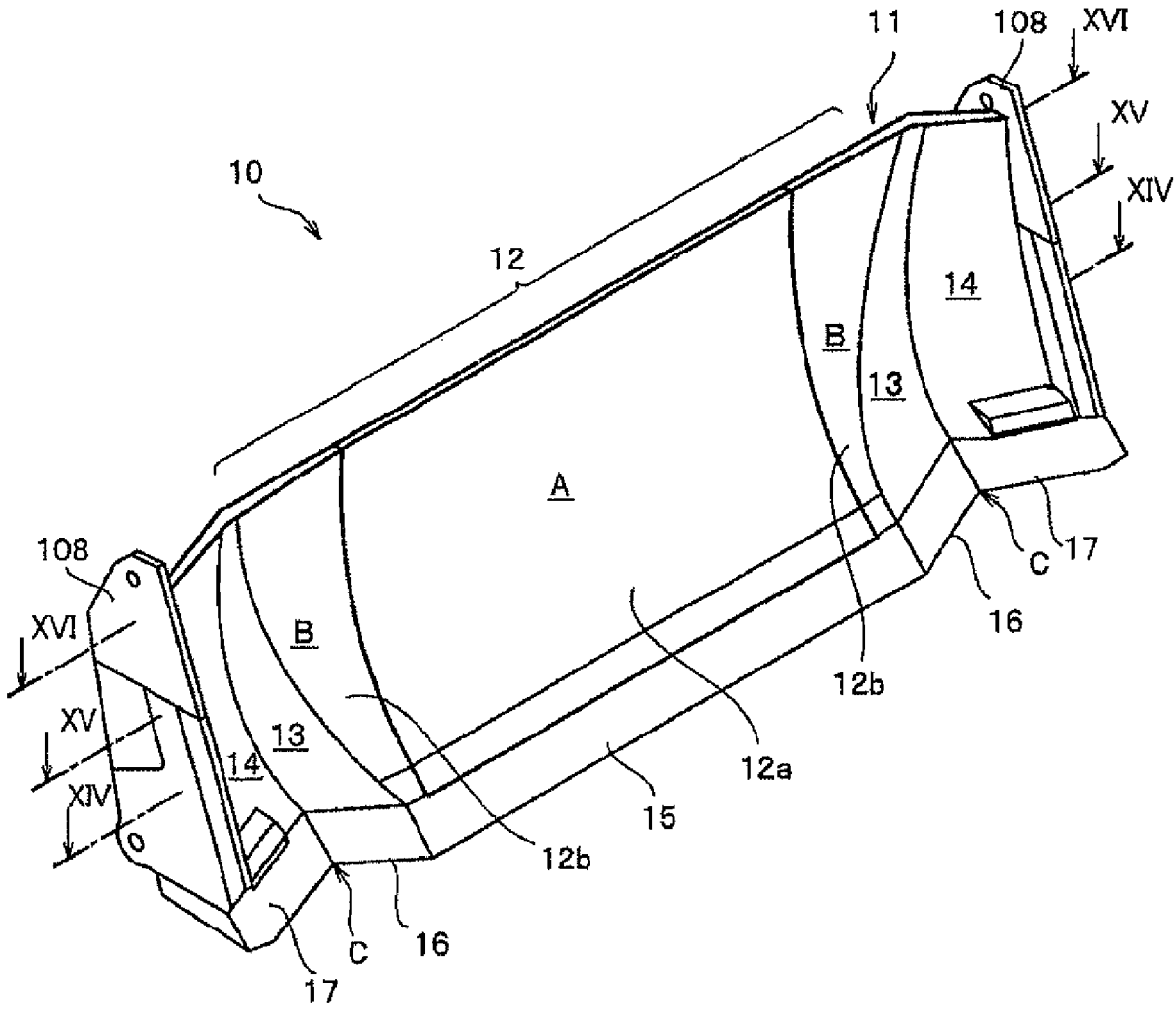
FIG. 1 is a perspective view schematically showing the overall configuration of a typical blade device to which the present invention is adopted as viewed diagonally from the front side.

Embodiments according to the present invention will be specifically described with reference to the drawings. A blade device according to the present invention can be used as a work implement that is attached to various types of work machines. Examples of work machines to which the present invention can be applied are provided by construction and earthmoving machines, for example. Although a bulldozer (not shown) is illustratively described as one of construction and earthmoving machines in this embodiment, the present invention is not limited to this. For example, work machines such as a wheel dozer and motor grader can be used.

A blade device 10 to which typical exemplary example according to the present invention is adopted includes a curved blade 11 that is curved in the vertical direction in a concave shape, as shown in FIGS. 1 to 5. In this embodiment, an integrated casting structure is applied to parts of the blade device, and a plate metal structure is applied to other part. This configuration is one of preferred embodiments. Note that the present invention includes a blade that is proposed in the foregoing WO2004/044337A1 and is made of plate metal as a whole.

The blade device 10 according to the present invention has a front portion based on a basic shape of a front surface portion of the blade device that is disclosed in the foregoing WO2004/044337A1. Accordingly, the operation and effect based on the basic shape are similar to the operation and effect that are described in the Document 1, as stated above. Therefore, the operation and effect are only briefly explained, and the unique configuration according to the present invention and corresponding operation and effect are mainly described in detail. The blade 11 of the blade device 10 according to the present invention has a basic structure shown in FIG. 1. That is, the blade 11 has a front surface that is formed a curved surface that is curved in the vertical direction in a concave shape. The blade 11 includes a central front portion 12, a pair of, left and right interposition front portions 13, and a pair of, left and right side front portions 14. The central front portion 12 includes a straight first edge section 15 that is arranged on the lower end of the central front portion 12. The pair of, left and right interposition front portions 13 include second edge sections 16. The second edge sections 16 are connected to the first edge section 15, and extend to be inclined rearward at a predetermined rearward bending angle δ. The pair of, left and right side front portions 14 include straight third edge sections 17. The third edge sections 17 are connected to the outside ends of the second edge sections 16, and extend to be inclined frontward at predetermined intersection angle θ relative to the elongation line of the first edge section 15.

Figure 5:
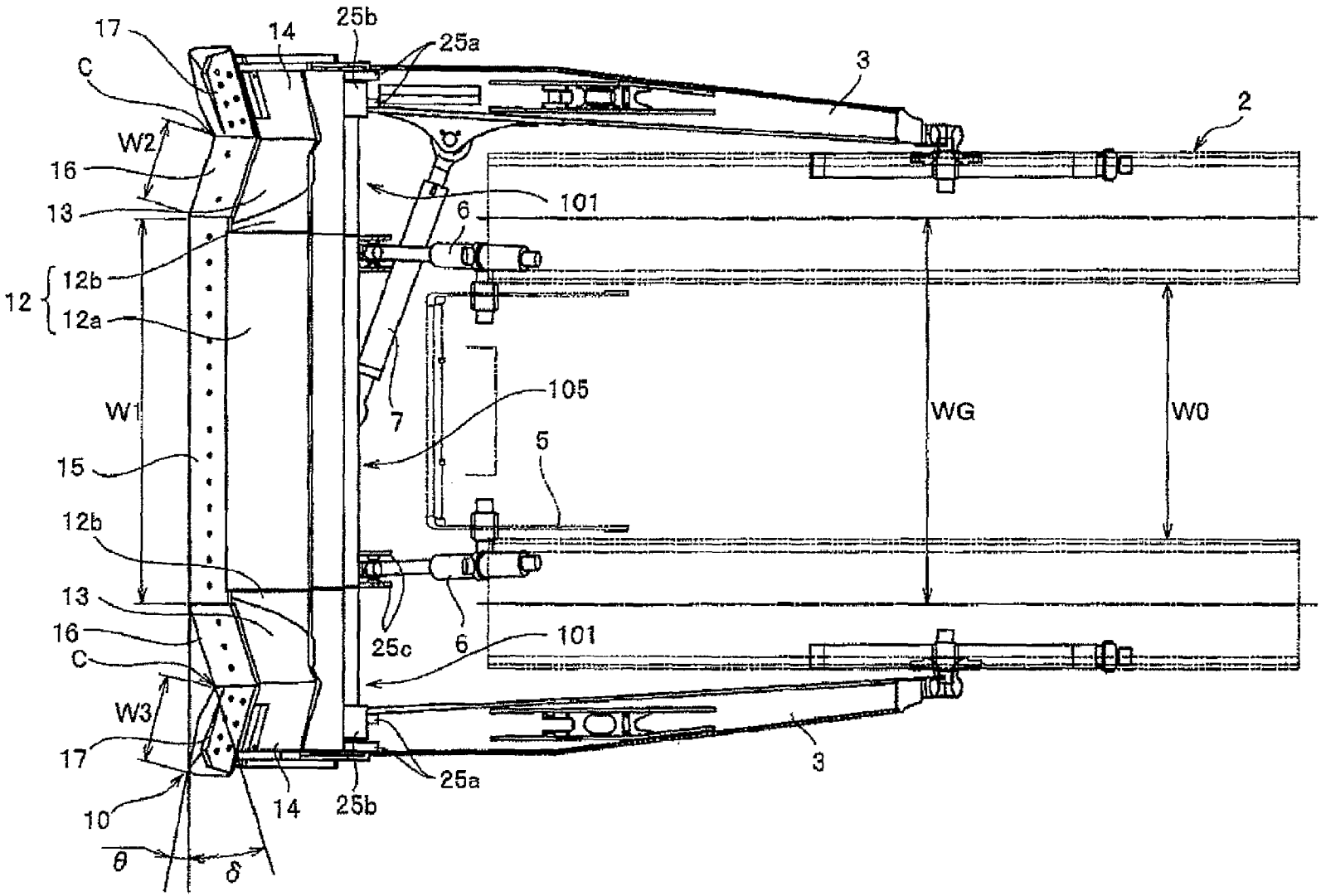
FIG. 5 is a top plan view showing principal parts of an exemplary configuration of said work machine.

In the blade device 10 according to the present invention, as shown in FIG. 5, the front end of the third edge section 17 of said side front portion 14 is arranged on the side edge of the central front portion 12 and substantially on the elongation line of the first edge section 15 as viewed from top side. However, the front end of the third edge section 17 may be positioned rearward relative to the elongation line, or may protrude slightly frontward relative to said elongation line. That is, the position of the front end of the third edge section 17 is not specifically limited as long as the interposition front portions 13 are connected to the left and right side edges of the central front portion 12 and extend to be inclined rearward, and the side front portions 14 are connected to and extend to be inclined frontward from the both outside edges of the left and right interposition front portions 13. However, the intersection lines between said interposition front portions 13 and the side front portions 14, and the intersections C between the second edge sections 16 and the third edge sections 17 should be positioned in a rearward position relative to the left and right side edges of the central front portion 12 and the first edge section 15.

One difference between this embodiment and the foregoing WO2004/044337A1 is that each of left and right, both side areas B of said central front portion 12, each of said interposition front portions 13, and each of said side front portions 14 are integrally formed into an integrated casting part together with the respective rear parts of each of the left and right both side areas B of said central front portion 12, each of said interposition front portions 13, and each of said side front portions 14. Another difference between this embodiment and the foregoing WO2004/044337A1 is that a central main area A of said central front portion 12 is composed of a front plate 106 and a rear supporting member 107 discussed later that are separately formed, and are integrated by welding. At least the central main area A of said front plate 106 of the central front portion 12 according to this embodiment is composed of plate metal of rolled steel. A part of the rear supporting member 107 corresponding to the front plate 106 is made of plate metal. A part of the rear supporting member 107 that is required to be reinforced is composed of a casting part specifically designed for the rear supporting member that is formed by casting separately from other integrated casting parts.

Also, in order to carry more soil, in this embodiment, a trapezoid-shaped steel plate member 18 is fixed by welding or the like as soil stopper plate that extends along the top edge of said central front portion as a whole including the casting part of the central front portion in the tangential direction of the central front portion in side view. The central rectangular section of the steel plate member 18 is a planar soil contact section. Left and right triangular sections of the steel plate member 18 are grating sections that include a plurality of grating bars 18*a*. The grating sections are arranged so that an operator sees the amount of soil that stands on the front left and right sides of the blade device when operating the work machine. In this embodiment, although the steel plate member 18 is fixed in the tangential direction of the central front portion in side view, the steel plate member 18 may be inclined frontward or rearward relative to the tangential direction in side view. Note that in the case where the steel plate member 18 extends in the tangential direction of the central front portion or is inclined frontward relative to the tangential direction of the central front portion in side view, the height H of the blade device includes the height of the steel plate member 18, but in the case where the steel plate member 18 is inclined rearward relative to the tangential direction of the central front portion, the height H of the blade device does not include the height of the steel plate member 18.

Figure 2:
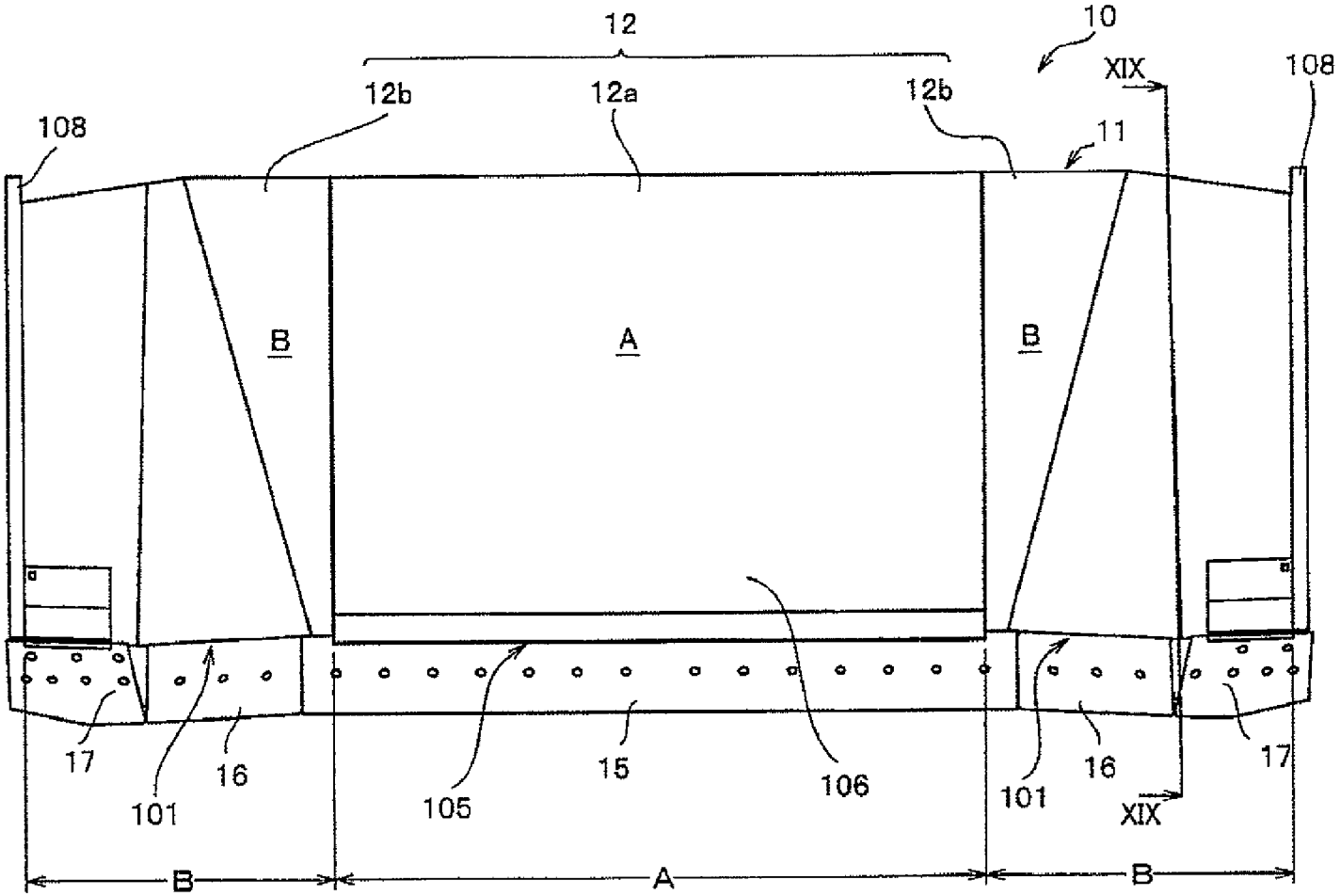
FIG. 2 is a front view of said blade device.

In this embodiment, the central front portion 12 has an inverted trapezoid shape as a whole in front view is divided into three sections of a rectangular central division section 12*a* as the central main area A, and substantially inverted triangular side division sections 12*b* as left and right both side areas B, as shown in FIGS. 1 and 2. The side division sections 12*b* are connected to the interposition front portions 13 (described later) that are inclined rearward in a V or U shape at a required rearward bending angle δ. The interposition front portions 13 are connected to the side front portions 14 that are inclined frontward in a V or U shape at a required intersection angle θ relative to the elongation line of the lower end edge of the central front portion 12. In this case, the front surfaces of said central front portion 12, said interposition front portions 13, and said side front portions 14 are entirely or partially curved in a concave shape with the same curvature in the vertical direction.

Also, in this embodiment, as stated above, an integrated casting part 101 is composed of each of said side division sections 12*b* of the central front portion 12, each of said interposition front portions 13, and each of said side front portions 14 that have laterally bent surfaces and vertically curved surfaces on the front surfaces of them that are integrally formed together with the rear supporting member 107 into the integrated casting part 101 by casting. Also, the front plate 106 as a main element of the rectangular central division section 12*a* of the aforementioned central front portion 12 is composed of a plate-shaped portion 105 made of plate metal.

Said rectangular central division section 12*a* includes said front plate 106 and the rear supporting member 107 (discussed later). The front plate 106 is a laterally elongated rectangular plate metal in front view, as shown in FIG. 2. The front plate 106 is a plate-shaped member that composes a central rectangular part that is obtained by cutting the central front portion 12 with a substantially inverted trapezoid shape as stated above from the both ends of the top base toward the bottom base in the vertical direction, that is, the front plate 106 composes the rectangular central division section 12*a*. The side division sections 12*b* are composed of the both side inverted triangular parts as the other cut parts of the central front portion. Each of the side division sections 12*b*, each of said interposition front portions 13, and each of said side front portions 14 are integrally formed together with the rear supporting member 107 corresponding to each of the side division sections 12*b* by casting. In this specification, an area that includes said front plate 106 of said central front portion 12 that is composed of plate metal, said steel plate member 18 that extends along the top edge of the front plate 106, and the rear supporting member 107 corresponding to the front plate 106 and the steel plate member 18 is referred to as the plate-shaped portion 105. Also, areas that are integrally formed by casting are referred to as the integrated casting parts 101. The integrated casting parts 101 are the areas of blade portions except for the plate-shaped portion 105 but including rear portions 103 (discussed later). In the case where the central front portion 12 is divided along vertical lines into three sections of the rectangular central division section 12*a* and the triangular side division sections 12*b* as stated above, the front surfaces of the rectangular central division section 12*a* and the triangular side division sections 12*b* are formed in a curved surface to be connected smoothly to each other, and the connection lines linearly extend in the vertical direction on the curved surface in front view. Accordingly, in assembling, automatic welding can be used by using a welding robot that does not require manual welding.

Figure 4:
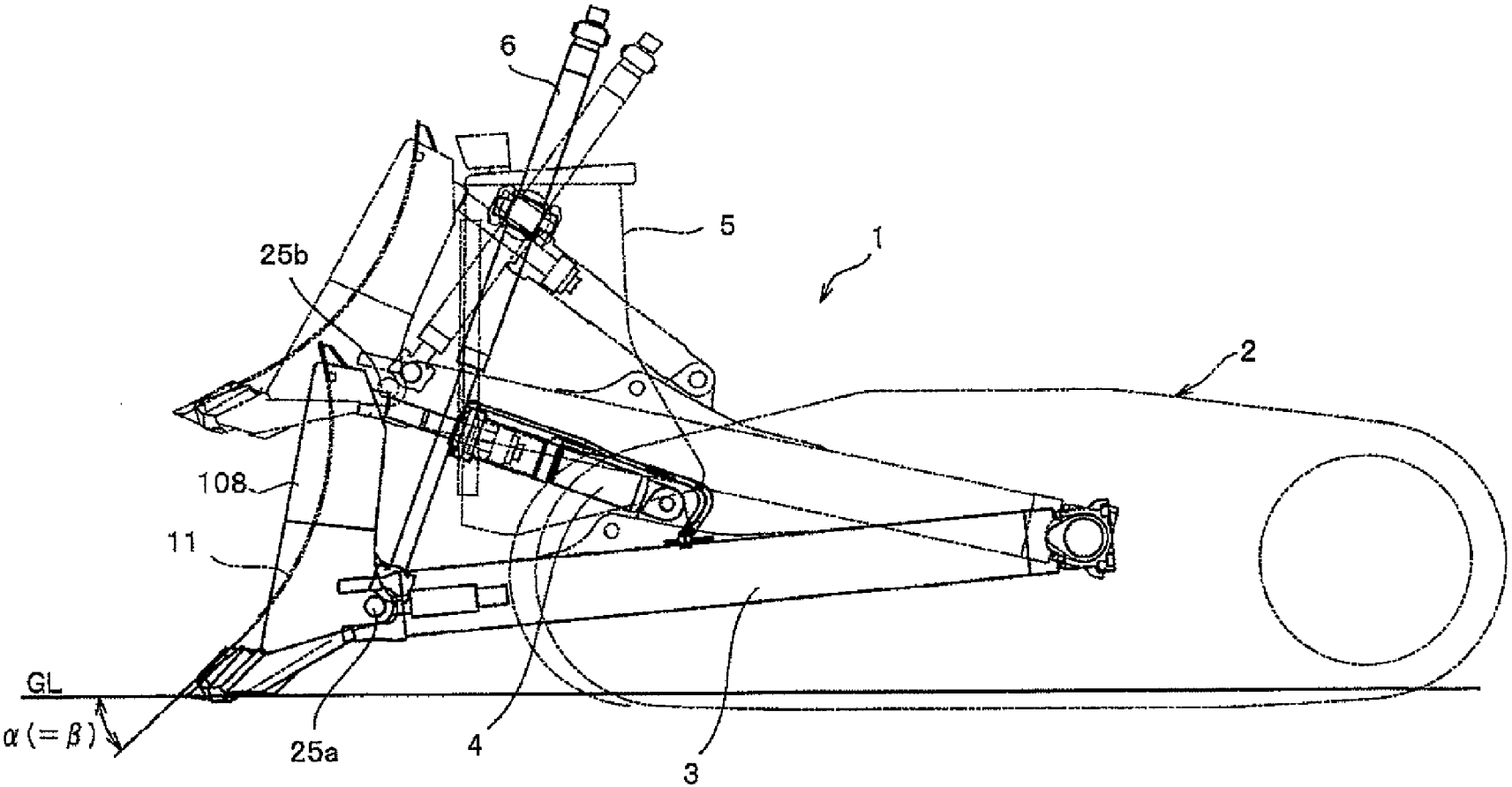
FIG. 4 is a side view entirely showing a work machine for explanation of upward and downward movement of a blade of said blade device.

FIGS. 4 and 5 schematically show the configuration of a bulldozer 1 that is equipped with said blade device 10 according to this embodiment. The blade device 10 is arranged in the front part of the bulldozer 1. The front ends of pairs of lift frames 3, tilt cylinders 4, lift cylinders 6, and a strut arm 7 are articulately coupled to the blade device 10. The base ends of the pair of lift frames 3 are pivotally supported on the central parts of track type drive units 2. The pair of lift frames 3 extend frontward from the central parts of the track type drive units 2. The base ends of the (hydraulic) tilt cylinders 4 are pivotally supported on the central parts of the lift frames 3. The tilt cylinders 4 extend frontward from the central parts of the lift frames 3. One end of a cylinder unit of each of the (hydraulic) lift cylinders 6 is pivotally supported on a side wall portion of an engine compartment 5 that is arranged in front of an operator's cab. The base end of the strut arm 7 is pivotally supported on said lift frame 3. The strut arm 7 diagonally extends to the central part of the rear of said blade 11 as viewed from top side. Typically, a bracket is formed on the rear supporting member of the blade by welding to protrude rearward in order to support the lift frame or the like.

Figure 17:
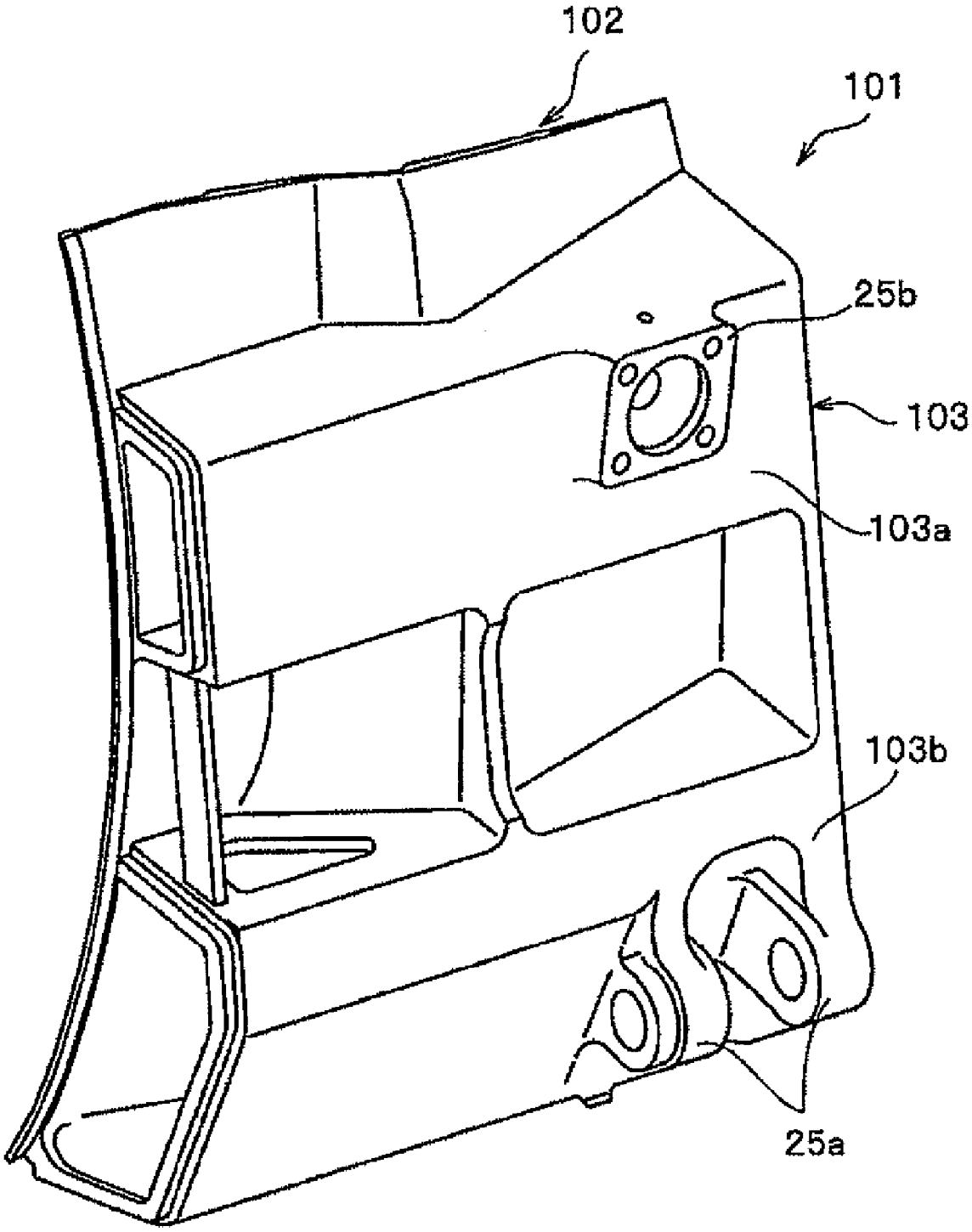
FIG. 17 is a perspective view showing a left integrated casting part of said blade device as viewed diagonally from rear left side.
Figure 18:
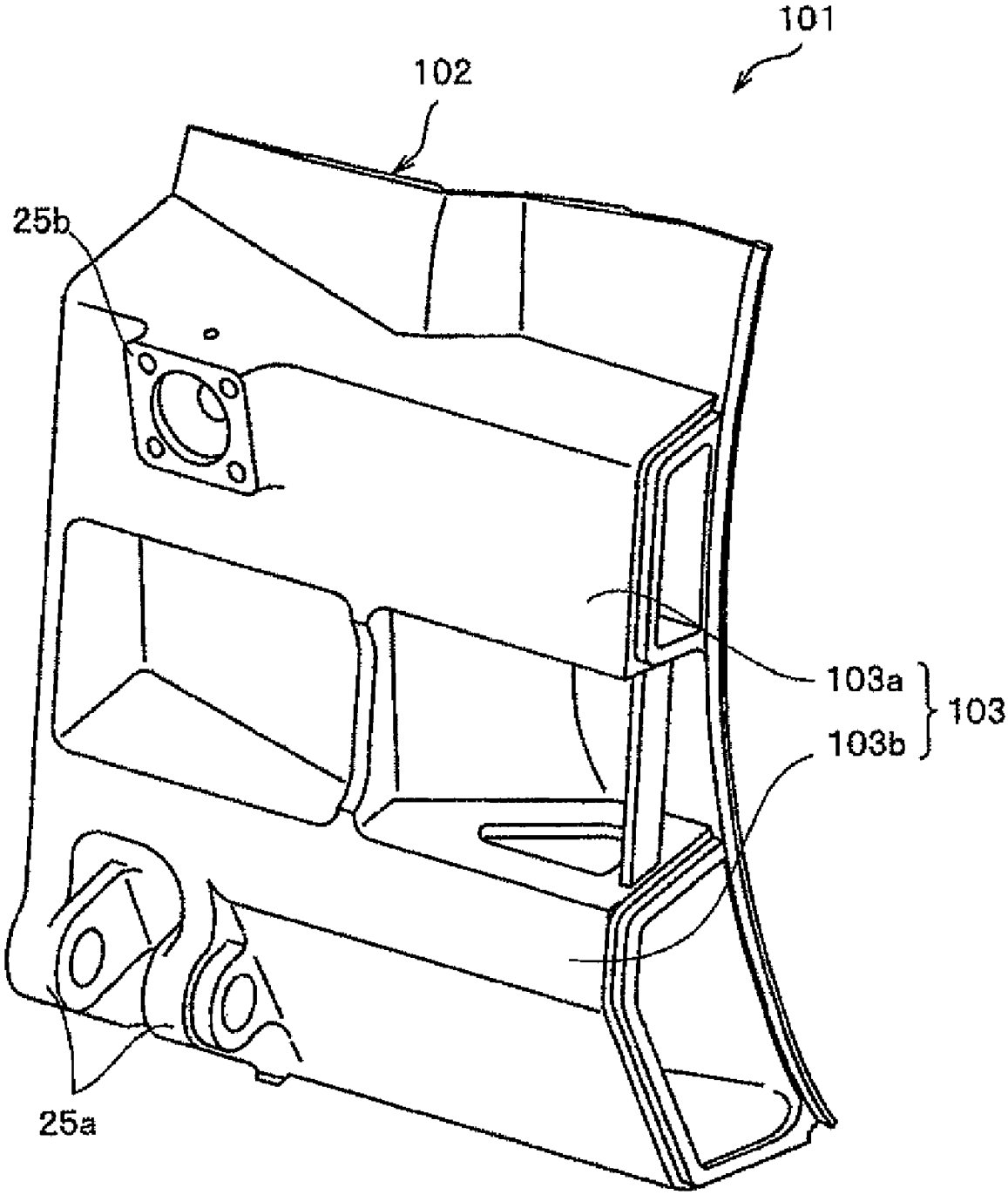
FIG. 18 is a perspective view showing a right integrated casting part of said blade device as viewed diagonally from rear right side.

In this embodiment, as shown in FIGS. 17 and 18, left and right first brackets 25*a* are integrally formed in a pair of, left and right integrated casting parts 101 of said blade 11 by casting to protrude rearward from the outside lower end corners of the rear portions 103 in order to support the front ends of said lift frames 3. Also, second brackets 25*b* are integrally formed in parts of said rear portions 103 above said brackets 25*a* by casting to protrude rearward in order to support the front ends of the aforementioned (hydraulic) tilt cylinders 4.

In this embodiment, the front surface of said interposition front portion 13 has a substantially triangular or trapezoid shape that is getting wider downward from the top end on contrary to the central front portion 12. As stated above, one side edge of the interposition front portion 13 is integrally formed with the connection side edge of said central front portion 12 to form one line in front view as shown in FIG. 2. Also, the front surface of said side front portion 14 has a constant width from the upper end to the bottom end in front view, and is formed in a substantially vertically elongated rectangular shape that is curved in a concave shape with the same curvature as the central front portion 12 and the interposition front portion 13.

In this embodiment, the front end of the side front portion 14 is positioned substantially on the elongation line of the lower end of said central front portion 12. The blade 11 has a laterally elongated rectangular shape as a whole in front view.

In the front portions 12, 13 and 14, as shown in FIG. 1, the interposition front portions 13 are connected to the both ends of the central front portion 12 to be greatly outspread rearward from the both ends of the central front portion 12 in a V shape, and the left and right side front portions 14 are greatly outspread frontward from the outside ends of the interposition front portions 13 also in a V shape. Although a V shape is shown in the illustrated example, the present invention is not limited to this shape. For example, an opening end may widely open to form a U shape. Note that "in front view" refers to in front view in the case where the edge section touches the ground at an edge angle α relative to the ground that provides the highest digging efficiency (equal to the digging angle β in this embodiment) as shown in FIG. 4.

Figure 3:
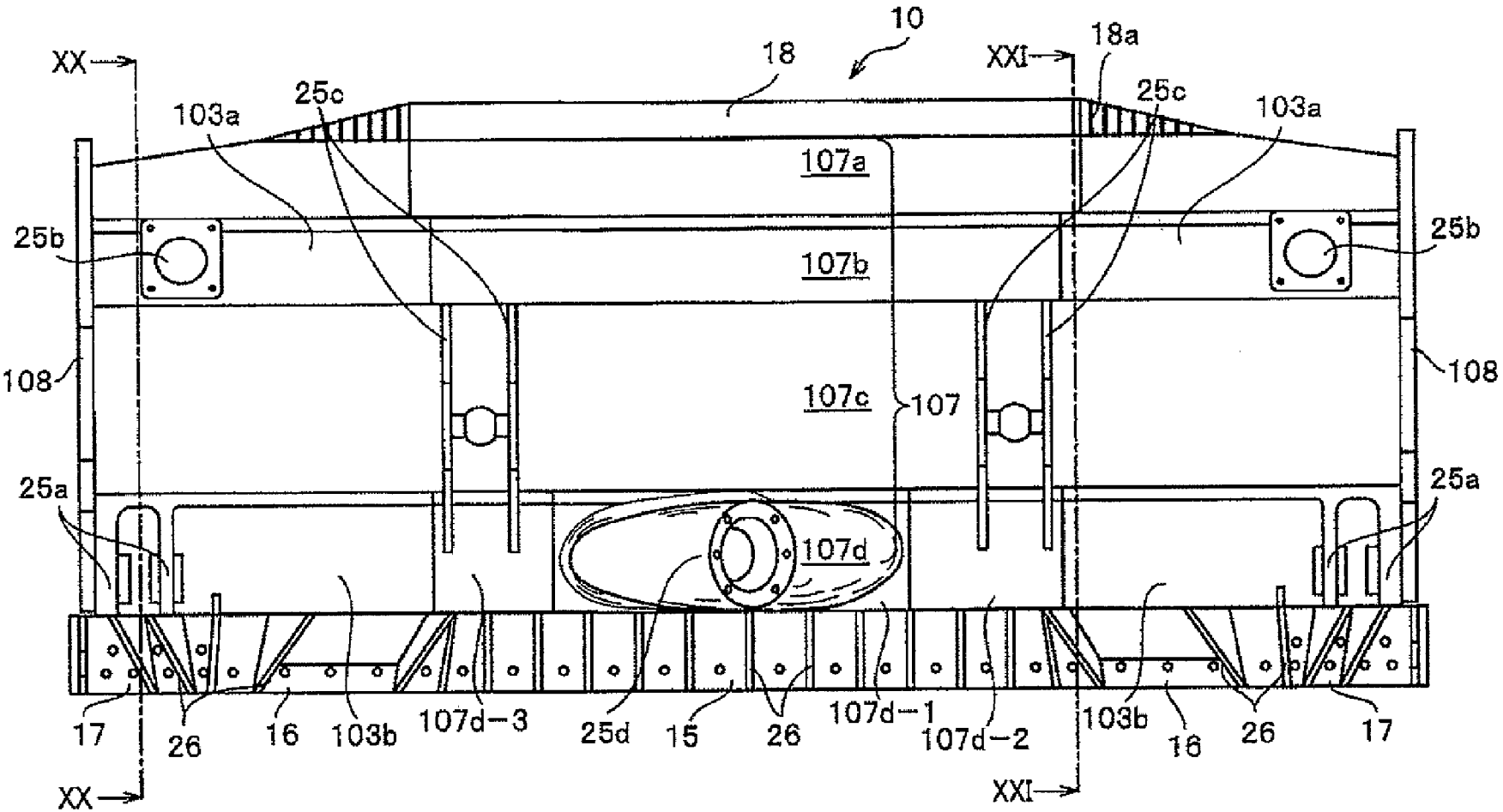
FIG. 3 is a rear view of said blade device.

The first edge section 15, the second edge section 16, and the third edge section 17 are made of an excellent wear resistant, damage resistant and tough material such as boron steel. In arrangement of the first edge section 15, the second edge sections 16 and the third edge sections 17 according to the preferred embodiment, said first edge section 15 digs earth prior to the second and third edge sections 16 and 17. In digging, since the first edge section 15 digs earth in proximity to the second and third edge sections 16 and 17 prior to the second and third edge sections 16 and 17, actual digging power required for said second and third edge sections 16 and 17 can be smaller than the digging power of the first edge section 15, and the amount of digging by the second and third edge sections 16 and 17 can be smaller than the first edge section 15. As shown in FIG. 3, a plurality of vertical plate-shaped ribs 26 are arranged on the lower plate-shaped part of the blade 11 corresponding to said first to third edge sections 15 to 17 to extend the front-and-rear direction in order to reinforce the edge sections 15 to 17. The front ends of vertical plate-shaped ribs 26 are fixed on the rear surfaces of the first to third edge sections 15 to 17 by bolts.

Figure 6:
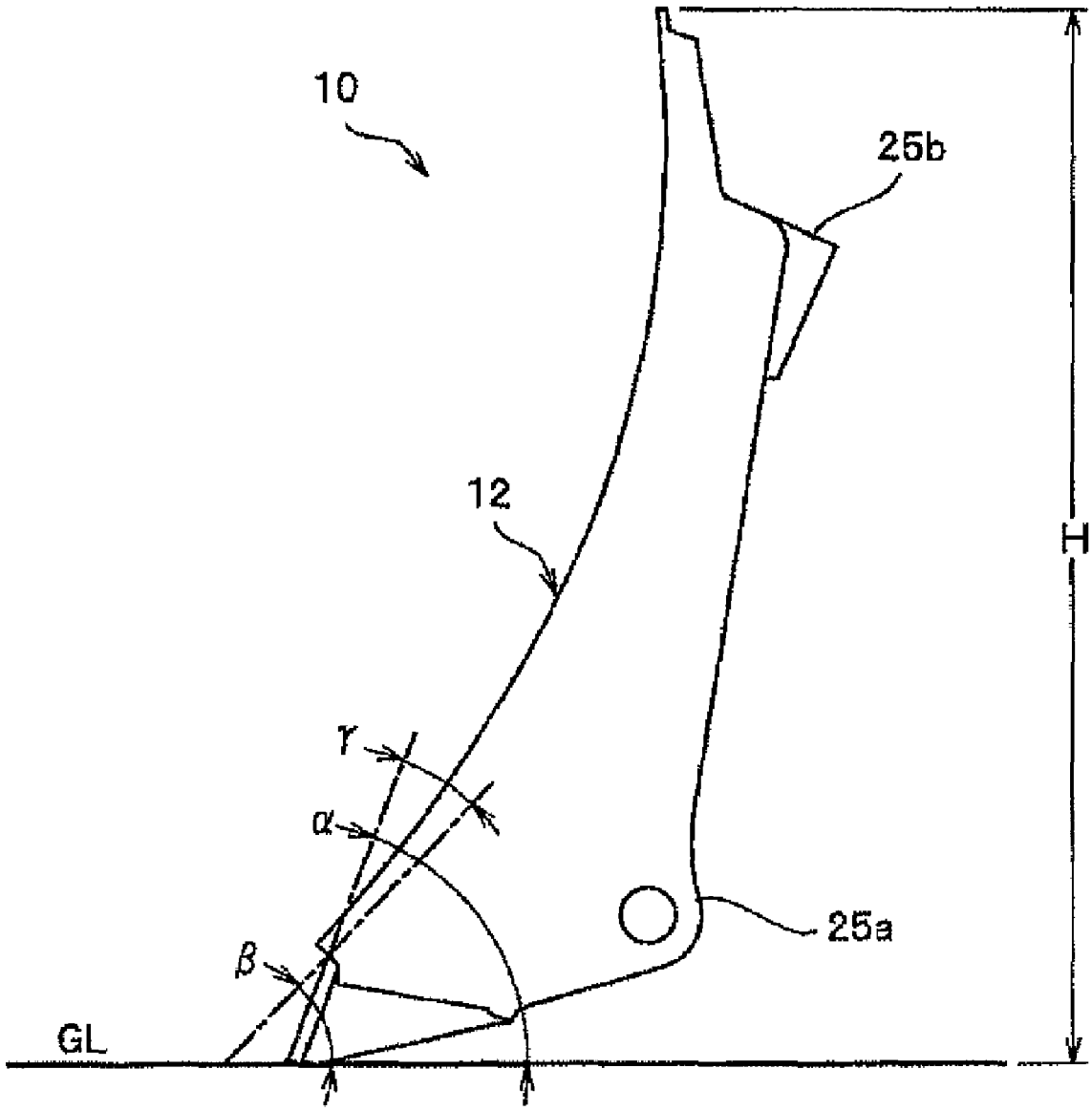
FIG. 6 is a diagram explaining the relationship of the intersection angle between a curved surface and an edge section of a front surface of a blade portion.

In the front portions 12 to 14 of the blade 10 according to the present invention, as shown in FIG. 6, the rearward inclination angle γ is designed 10° similar to the foregoing WO2004/044337A1, and the curvature radius R1 of the blade front surface is also is designed the same curvature radius as the WO2004/044337A1. The rearward inclination angle γ is the difference angle between the edge angle α and the digging angle β. The edge angle α is an angle between the front surface of said first edge section 15, and the ground. The digging angle β is an angle between the elongation line of the front surface of the lower end portion of said central front portion 12, and the ground. For information, in the blade that is described in WO2004/044337A1, the edge angle α, the digging angle β, and the rearward inclination angle γ are 46°, 36°, and 10°, respectively. For example, the digging angle of a semi-U-shaped blade is 52°. In this case, the curvature radius R1 is designed to be the blade height H×(0.5 to 0.7) similarly to this type of conventional blade. If these values similar to conventional blades are applied to a blade according to the present invention, since a blade according to the present intention has a unique and complicated blade shape, soil that is carried on the blade in digging may stick on the blade front surface and may not slide down, and the digging efficiency and the amount of loaded soil may greatly decrease.

Figure 7:
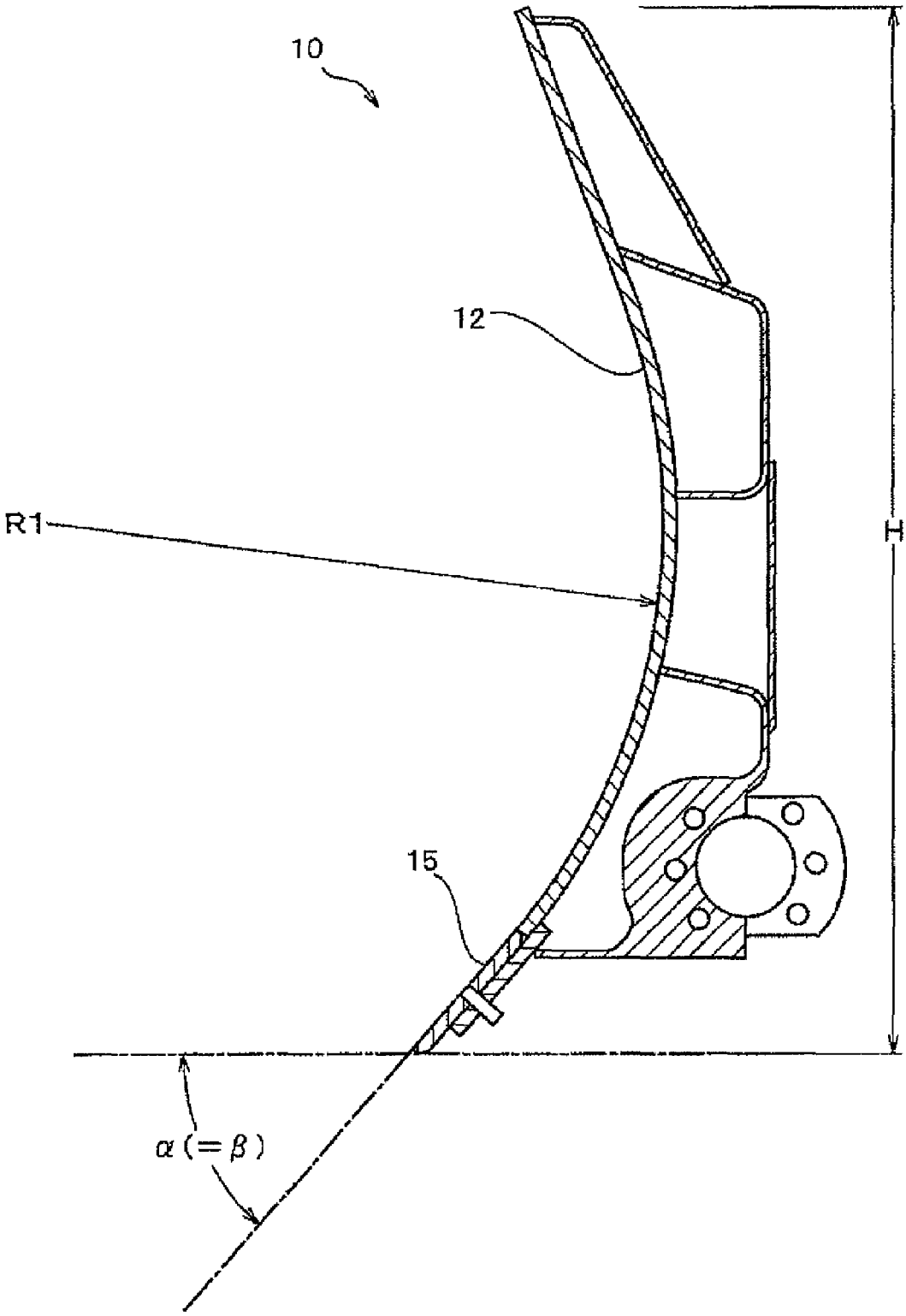
FIG. 7 is a vertical sectional view showing the rearward inclination posture of the blade in the case where an arc-shaped surface with a small diameter is formed on conditions that are the same height and the same digging angle (edge angle).

Accordingly, said rearward inclination angle γ is designed 0° without changing the edge angle α and the curvature radius R1 of the blade front surface. That is, the digging angle of a blade that is described in WO2004/044337A1 is designed equal to the edge angle, and neither the height of the blade nor the curvature radius of the whole blade surface are changed. In addition to this, the front ends of the first to third edge sections 15 to 17 that are secured to the lower ends of the central front portion 12, the interposition front portions 13, and the side front portions 14 are not positioned rearward relative to the front portions 12 to 14, but protrude along the elongation plane of the front portions 12 to 14. As a result, as shown in FIG. 7, the rearward inclination angle of the blade becomes small as a whole, and the front portion arises. It is found that soil does not move upward on the blade front surface in digging, and as a result the amount of soil carrying greatly decreases.

Figure 8:
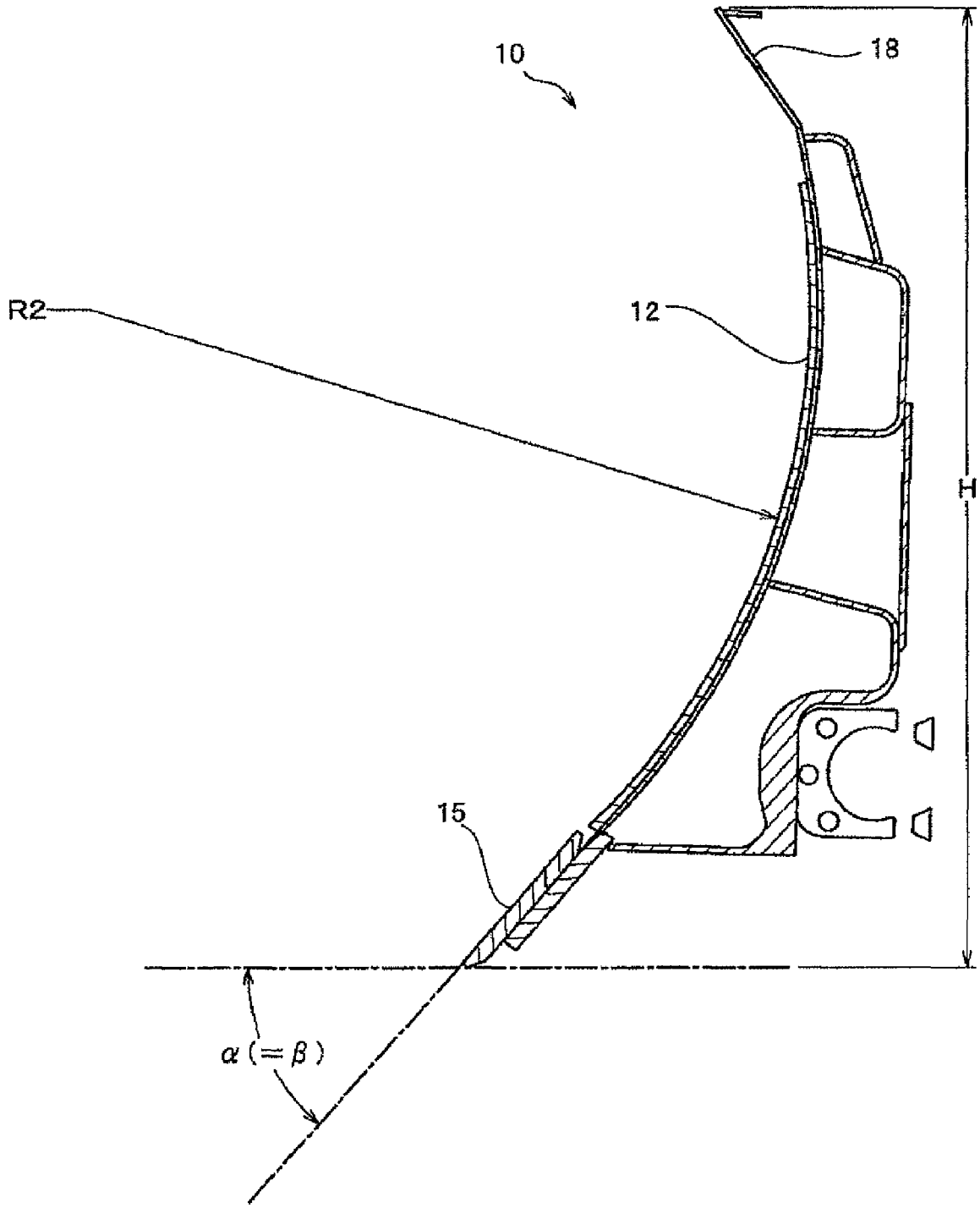
FIG. 8 is a vertical sectional view showing the rearward inclination posture of the blade in the case where an arc-shaped surface with a large diameter is formed on conditions that are the same height and the same digging angle (edge angle).

FIG. 7 shows the rearward inclination posture of the blade 11 in the case where the rearward inclination angle γ is designed 0°, and the first edge section 15 extends in the tangential direction of the lower end of the front arc-shaped surface of the central front portion 12 with the same curvature radius R1 as conventional blades as stated above. Also, FIG. 8 shows the rearward inclination posture of the blade 11 according to this embodiment in the case where the rearward inclination angle γ of each of the first to third edge sections 15 to 17 is designed 0° and the first to third edge sections 15 to 17 extend frontward from the lower end of each of the front portions 12 to 14 similarly to the case of FIG. 7. In this case, in this embodiment, the curvature radius R2 of the front arc-shaped surface of each of the front portions 12 to 14 is designed larger than the curvature radius R1 of the arc-shaped surface shown in FIG. 8, and is determined based on Equation (I): R2=(0.7–1.0)×H. Note that the blades in the both figures have the same height H from the edge of the first edge section 15 to the blade top end. As seen from these figures, even on condition that the edge angle α is constant, in the case where the curvature radius R2 of the arc-shaped surface is increased as shown in FIG. 8, this increase of the curvature radius R2 causes the blade 11 according to this embodiment to be farther inclined rearward as compared with the blade 11 with a smaller curvature radius shown in FIG. 7. As a result, as compared with a blade with a conventional and typical shape, the amount of soil that is carried on the blade greatly is increased. The soil smoothly falls from the front surface of the blade in soil dumping. The soil is unlikely to stick and remain on the blade front surface. The digging efficiency of the blade is also improved.

The aforementioned blade height H can be determined based on blade capacity Q. The blade capacity is a standard working amount per one step in the case where soil and the like is pushed on the blade, and is calculated based on an equation that is defined in a standard or the like. That is, the blade capacity Q is specified by a machine size, and has the relationship Q=W×H2 (where W is an overall blade width) between blade capacity Q and blade height H in the case of a straight blade that has the simplest shape (schematically has a laterally elongated rectangular shape). Accordingly, the blade height H can be automatically determined when the blade capacity Q and the overall blade width W are determined. Also, said blade capacity Q and the dimensions of a blade with the unique shape according to the present invention substantially have the relationship that is represented by the following equation (IV)

$$Q \approx j \times \{Wt(W1+W2\cdot\cos\delta+W3\cdot\cos\theta)\times H+2\times(1.4W-0.3W)\times H2/2\} \quad \text{(IV)}$$

where j is a coefficient based on an arc-shaped surface, H is the height of a blade, W is the overall width of a blade, W1 is the blade width of a central front portion, W2 is the blade width of an interposition front portion, W3 is the blade width of a side front portion, Wt is the distance to the rearward intersection between the interposition front portion and the side front portion, δ is the rearward bending angle of the interposition front portion relative to the central front portion, and θ is the intersection angle between the elongation line of the edge of the central front portion and the edge of the side front portion.

Figure 9:
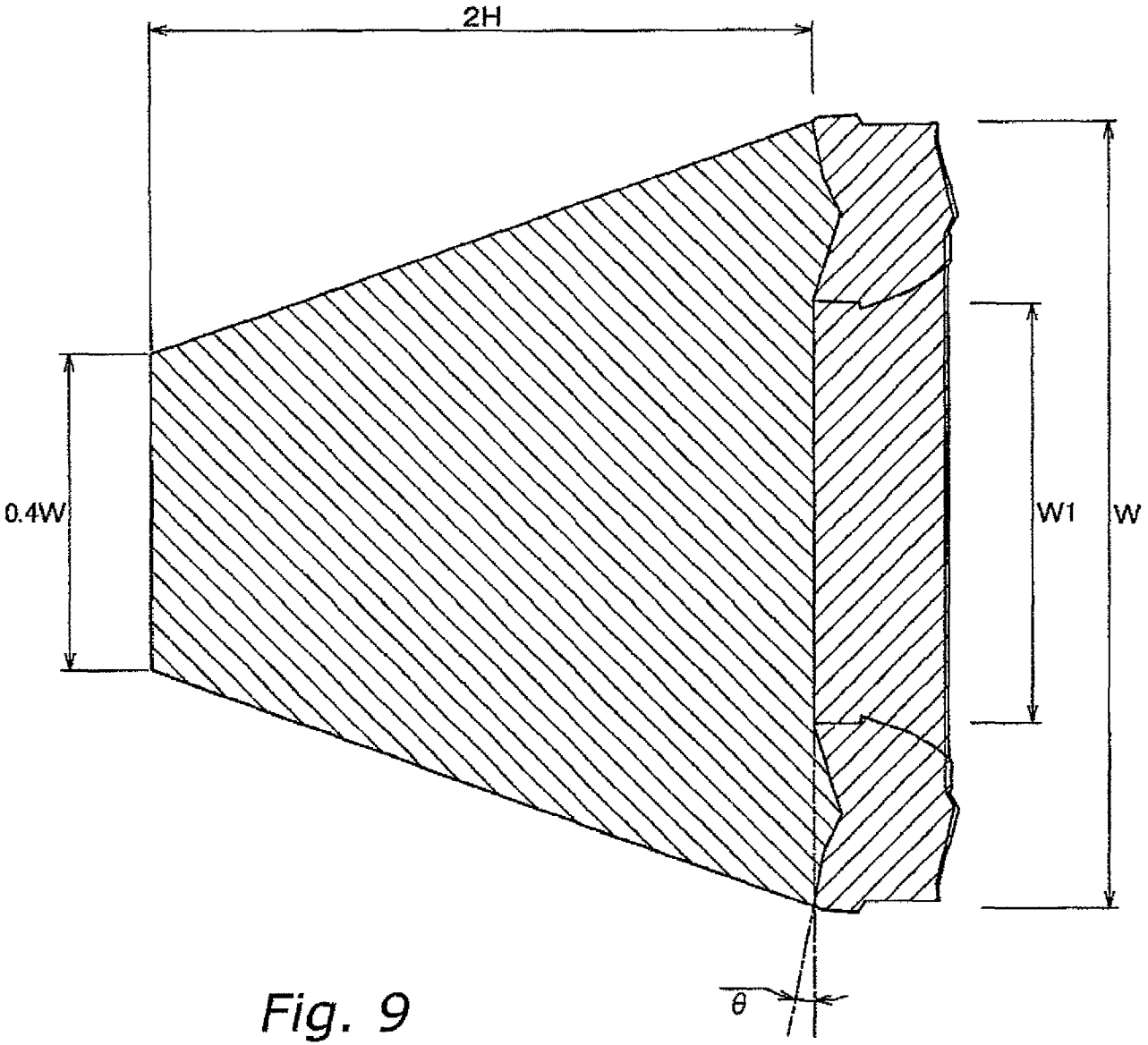
FIG. 9 is a projection showing the blade in digging and soil carrying, and carried soil in front of the blade.
Figure 10:
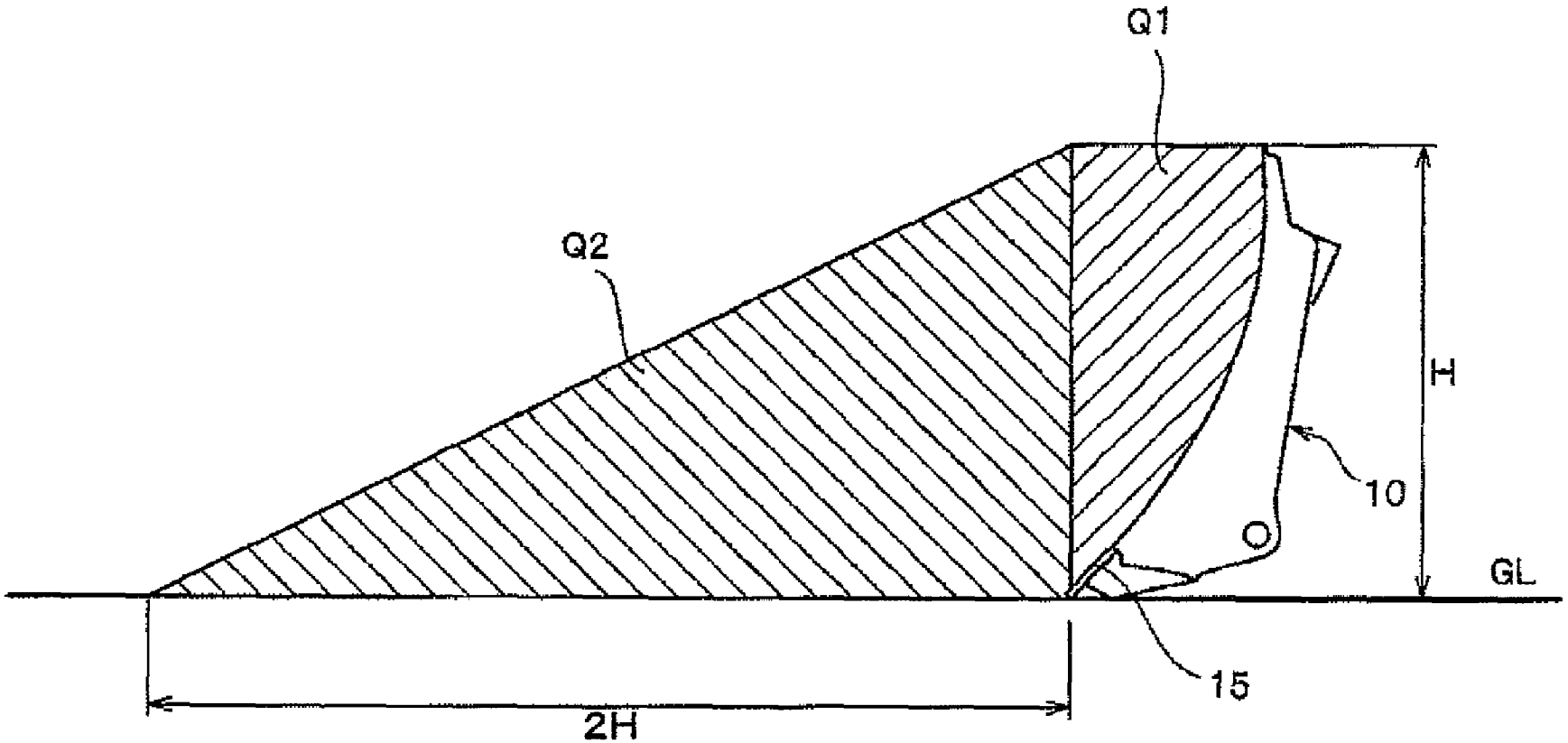
FIG. 10 is a side view showing the blade in digging and the soil carrying, and carried soil in front of the blade.

FIGS. 9 and 10 are diagrams explaining the calculation principle of the blade capacity Q of a blade device 10 according to the present invention. FIG. 9 is a projection diagram showing the blade 11 according to of the present invention, and soil that is carried frontward of the blade. FIG. 10 is a side view showing the blade 11 according to the present invention, and the soil that is carried frontward of the blade. Generally, it is said that the angle of inclination of a soil surface (angle of repose) is about 30 degrees. In SAE standard J1265MAR88, in the case of blade capacity calculation, the angle of repose is specified 26.5 degrees (the tangent of angle of repose is specified 0.5). The blade capacity Q can be obtained, in consideration of the angle of repose, by adding a capacity Q1 that is obtained by multiplying the project area of the blade 11 by the blade height to a capacity Q2 that is obtained by multiplying the project area of soil that is obtained in consideration of the amount of soil that flows frontward from the front end of the blade and flows leftward and rightward by the blade height H. In the above equation (IV), the first term corresponds to the capacity Q1 of soil that stands on the blade. The second term corresponds to the capacity Q2 of soil that is carried in front of the blade. The blade height H is automatically determined based on Equation (IV) when blade capacity is determined.

Figure 11:
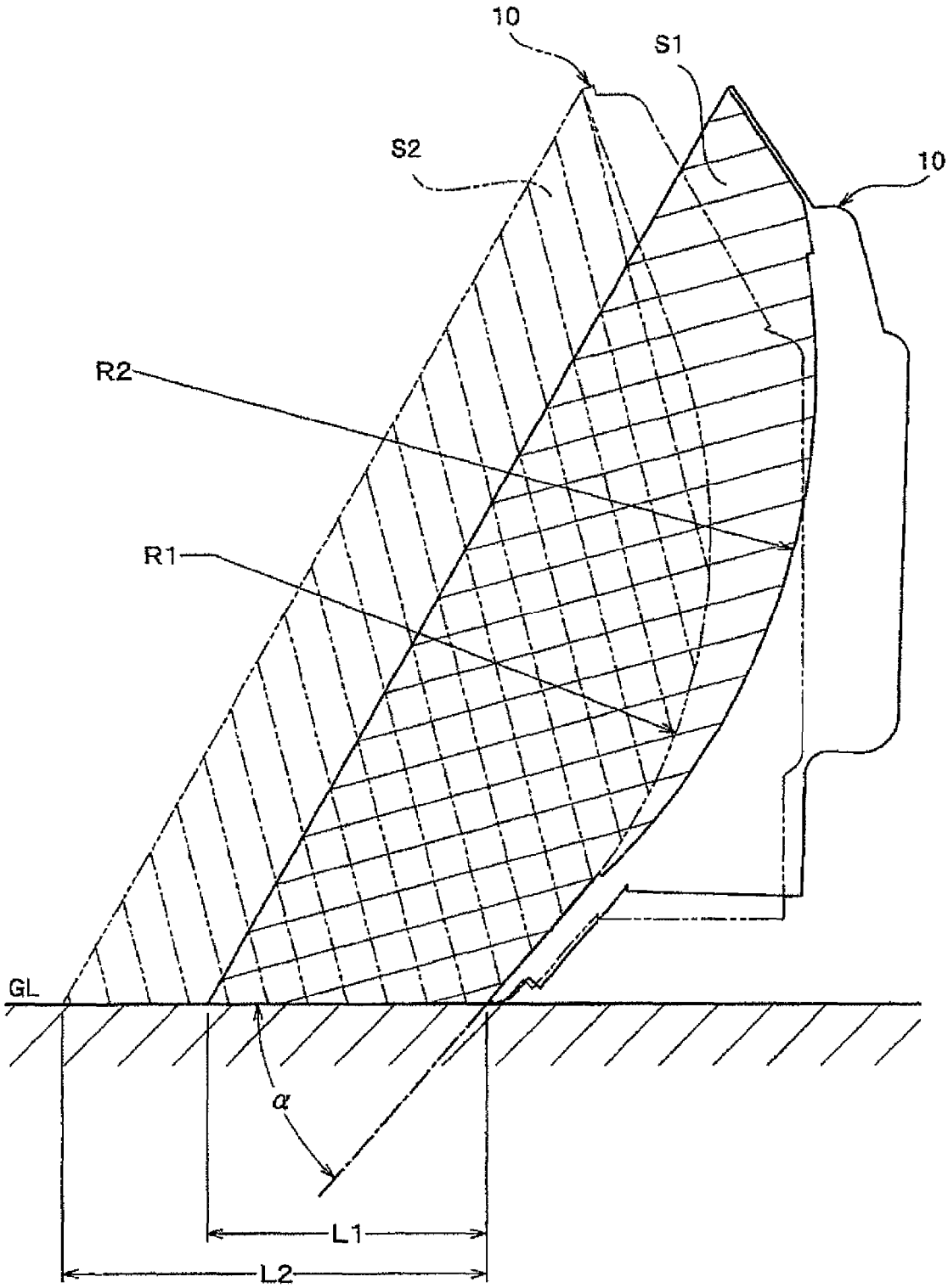
FIG. 11 is a diagram explaining the relationship of standing soil that stands in front of the blade in a normal posture and a rearward inclination posture of the blade in digging and soil carrying.

As stated above, in order to reduce slide resistance between soil that stands in front of the blade and the ground in soil carrying, this can be made by reducing the amount of soil in contact with the ground. As shown by solid lines and phantom lines in FIG. 11, the inclination angle (angle of repose) of the front surface of soil that stands and is carried by the blade device is constant. To reduce the amount of soil that is in contact with the ground, the distance between the edge and the end of the soil that is in contact with the ground is changed from L2 to L1. This can be made by bringing the end of the soil closer to the edge of the blade device 10 as much as possible. Thus, a hatched area S2 that is cut by the phantom line that diagonally extends toward bottom left side is changed to a hatched area S1 that is cut by the solid line that diagonally extends toward bottom left side shown in the figure. FIG. 11 is a diagram schematically explaining change in sliding resistance between the soil that stands in front of the blade and the ground depending on the blade postures. In the figure, the solid lines show the blade device 10 according to the present invention, and the phantom lines show a conventional blade. In this case, as for the both blades, the curvature radius of the front curved surface of the conventional blade is R1, and that of the blade according to the present invention is R2 larger than R1. The conventional blade and the blade according to the present invention have the same edge angle α (=β).

As stated above, the front surface of soil that stands on the ground has a certain, constant inclination angle depending on the type of the soil. For this reason, on condition that the edge angle α and the rearward inclination angle γ (0° in FIG. 11) are constant, in the case where the curvature radius of the blade front surface is increased, it is possible to increase the holding amount of soil that stands on the blade, and to reduce the contact area between soil that stands on the blade front surface and the ground. Note that the holding amount of soil that stands on the blade refers to the amount of soil that is included on the front surface side of the blade relative to a vertical plane that includes a contact line between the blade and the ground.

In this case, with reference to the ground contact length L2 of typical standing soil that stands on the ground in front of the edge, the ground contact length L1 of standing soil in the case of the blade device 10 according to this embodiment is reduced about 10%. Accordingly, the amount of standing soil on the ground is greatly reduced. On contrary to this, in digging and soil carrying, the blade front surfaces of said blade portions 12 to 14 will load a large amount part of standing soil that stands in front of said blade portions 12 to 14. Accordingly, the so-called holding amount will be increased. As a result, soil carrying resistance and the like can be greatly reduced. The consumption power per traction force can be greatly reduced. Therefore, it is possible to provide excellent, low fuel consumption performance.

Note that, in this embodiment, since said rearward inclination angle γ is the minimum angle 0°, the edge sections can be easily mounted. However, if the blade 11 has a curved surface similar to conventional blades and the edge angle α is not changed, since the blade 11 arises too sharply, a large amount of carried soil will slide down. For this reason, as stated above, the curvature radius of the arc-shaped surface of the blade front surface is changed from the typical value R1 to the value R2 larger than R1. Accordingly, the blade can be further inclined rearward. Therefore, it is possible to reduce a soil carrying resistance, and to provide the same or more amounts of digging and soil carrying than typical amounts.

Also, since a large amount of soil can stand on the front surface of said blade 11 as stated above, it is possible to keep good balance of ground contact pressure of the machine in the front-and-rear direction. Accordingly, power loss caused by shoe slips and the like is reduced. Therefore, it is possible to provide high traction force. Also, in this embodiment, the trapezoid steel plate member 18 is fixed to extend upward from the end of the arc-shaped surface on the top end part of the blade 11 and to be inclined frontward in a range of more than 0 and not more than 50 degrees. In addition to this, a number of grating bars 18*a* are arranged on the both sides of the steel plate member 18. Accordingly, an excess amount of soil that stands on the blade front surface flows out in the left and right of the blade through gaps among the grating bars 18*a* that are arranged on the left and right sides of said steel plate member 18. Therefore, it is possible to prevent soil from riding over the top ends of the blade portions 12 to 14 and from flowing out rearward. In addition to this, it is possible to maintain a proper amount of loaded soil in the blade top end part.

In addition to this, excavated soil is not pressed onto the blade front surface, and soil removal is improved in soil dumping. That is, soil dumping is improved. Also, the edge angle α between the front surface and the ground in the state where the edges of said edge sections 15 to 17 touch the ground preferably falls within a range about 40° to about 55°. In this case, it is possible to effectively provide the minimum amount of digging and soil carrying energy, and the maximum amount of soil.

According to the experiment by the inventors, it is found that, although said digging efficiency is also affected by the edge angle α as stated above, said digging efficiency is greatly affected by the lower end blade width W1 of the central front portion 12, the rearward bending angle δ of the second edge section 16 relative to the aforementioned first edge section 15, and the interval between the elongation line of the first edge section 15 and the intersections C between the respective edges of the interposition front portion 13 and the side front portion 14 that intersect with each other in a part rearward of this elongation line (hereinafter, referred to as a recessed amount) Wt.

Figure 12:
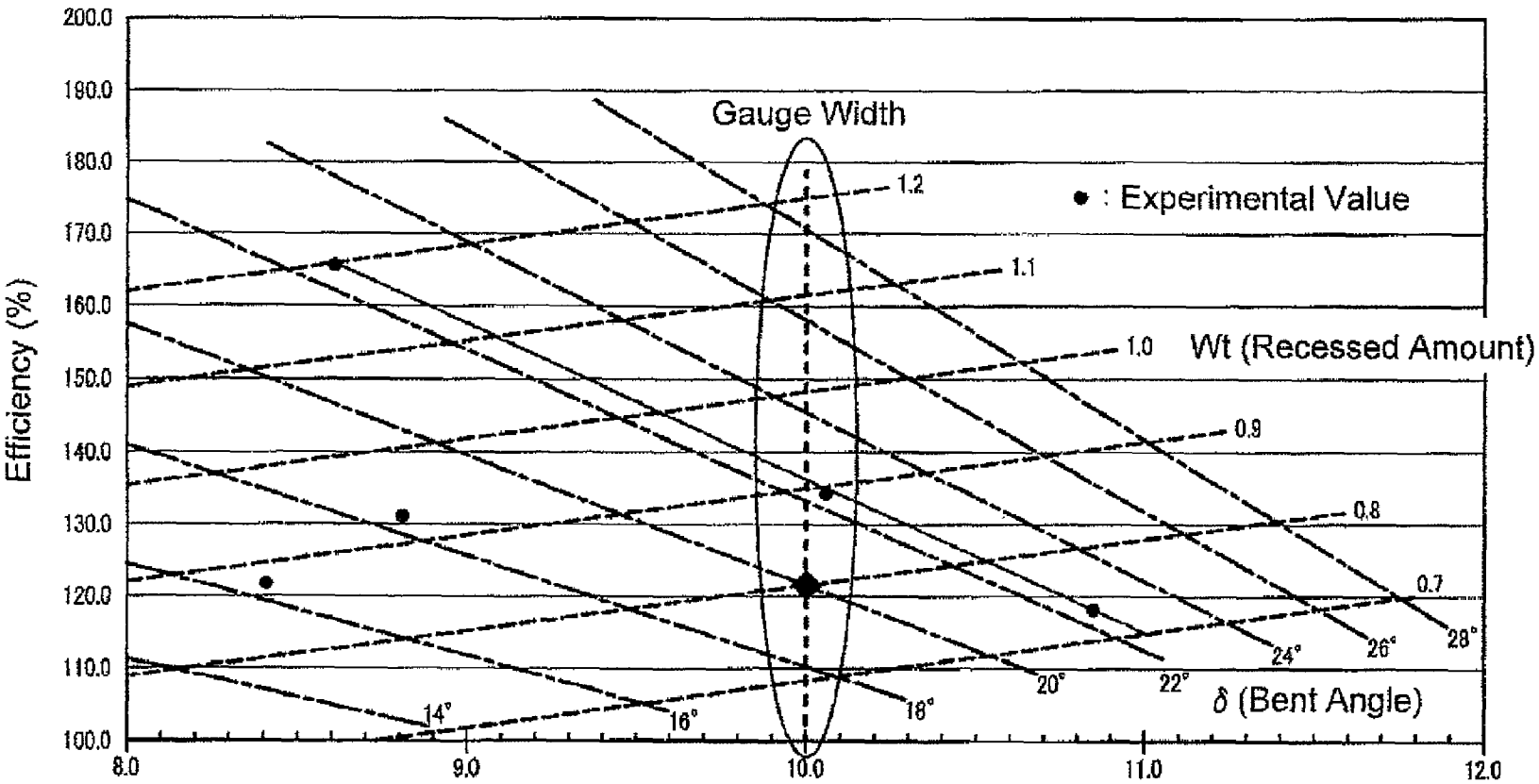
FIG. 12 is a correlation diagram showing the digging efficiency of said blade against the blade width of a central front portion in accordance with the recessed amount of an intersection and a rearward bending angle.

FIG. 12 shows the result of the experiment. According to this, it is found that the digging efficiency corresponding to the change of the blade width W1 of the lower end of said central front portion 12 is determined by the correlation between the rearward bending angle δ of said second edge section 16 that is bent rearward relative to said first edge section 15, and the recessed amount Wt between the elongation line of said first edge section 15 and said intersections C between the respective edges of said second and third edge sections (16 and 17). Note that, although FIG. 12 is based on a semi U blade with a shape that is the closest to a blade device according to the present invention, it can be said that the same goes for other types of devices in effect.

The horizontal axis of the figure represents the change of said blade width W1 with reference to the gauge width of a machine (length of the centers of belts in the case of a bulldozer) that is defined as 10 (dimensionless number). Also, the vertical axis of the figure represents the change of digging efficiency. In the figure, digging efficiency of a semi U blade that is attached to a machine with a standard gauge width is defined as 100%. The vertical axis of the figure represents the change of digging efficiency (%) of a blade according to the present invention in the case where the overall blade width of the blade according to the present invention is the same as the overall width of a semi U blade. In the figure, alternate long and short dashed curve lines show the change of digging efficiency in accordance with the change of the blade capacity in the case where the aforementioned rearward bending angle δ is changed. Also, short dashed straight lines show the change of digging efficiency in accordance with the change of the blade width W1 in the case where the recessed amount Wt between the elongation line of the aforementioned first edge section 15 and said intersections C between the respective edges of said second and third edge sections 16 and 17 is changed.

Wt is a coefficient of dimensionless number. An actual value can be obtained by multiplying Wt by a conversion coefficient. Note that values that are defined by factors of a machine other than the gauge width or factors of a blade device may be used as conversion coefficients.

Accordingly, to design the blade device 10 according to the present invention that has the blade width W1 of the central front portion 12 that is determined by a desired blade capacity, the rearward bending angle δ and the recessed amount Wt are selected that correspond the alternate long and short dashed straight lines and the short dashed straight lines that intersect with each other on a vertical line that passes the blade width W1. This selection can provide desired digging efficiency. With reference to the figure, in the case where the blade width W1 of the central front portion 12 is 10 (the center of the horizontal axis), to provide digging efficiency higher than a semi U blade with the same overall blade width, for example, the aforementioned rearward bending angle δ is designed about 16.2 degrees, and the aforementioned recessed amount Wt is designed 0.65. In this case, digging efficiency similar to a semi U blade is provided.

That is, in the case where the blade width W1 of the central front portion 12 is 10, if the rearward bending angle δ is designed 16°, and the recessed amount Wt is designed 0.65, it is possible to surely provide digging efficiency similar to a semi U blade with the same blade capacity. If the rearward bending angle δ is designed greater than 16°, and the recessed amount Wt is designed greater than 0.65, and additionally if the rearward bending angle δ and the recessed amount Wt are designed values of a point where one of alternate long and short dashed straight lines corresponding to rearward bending angle δ not less than 16 degrees and one of short dashed straight lines corresponding to recessed amount Wt not less than 6.5 intersects with each other on a vertical line that passes the blade width W1, it is possible to provide digging efficiency that corresponds to an intersection C between said one of alternate long and short dashed straight lines and said one of short dashed straight lines, and exceeds a semi U blade. That is, if both the following aforementioned Equations (II) and (III) are satisfied $$Wt>0.65\times(W1/10) \quad \text{(II)}$$

$$14°<\delta<30° \quad \text{(III)}$$

It is possible to provide a most efficient blade shape in that soil less drops off in turning operation. For example, a solid diamond symbol in the figure shows the case the rearward bending angle δ is designed 20°, and the recessed amount Wt is designed 0.8 in the case of the reference value 10 of the blade width W1. In this case, the digging efficiency is 122%. Thus, the digging efficiency is greatly increased.

However, the upper limits of the rearward bending angle δ and the recessed amount Wt cannot be determined only by the correlation diagram of FIG. 12. According to other experiment, although depending on a condition of turning radius, when soil is carried in turning operation, the soil that is loaded on the front surface of the blade flows out from the side front portion 14 through the interposition front portion 13 within several tens seconds, and the amount of loaded soil immediately becomes zero. After the cause of this problem is diagnosed, it is found that one main cause is the aforementioned rearward bending angle δ. That is, if the rearward bending angle δ is designed as not less than 30°, carried soil slides down.

Accordingly, in the present invention, said recessed amount Wt is designed larger than a value that is obtained by multiplying the blade width W1 of the lower end of the central front portion 12 that is previously determined by blade capacity by 0.65/10, and the aforementioned rearward bending angle δ is obtained in a range of not less than 16° and not more than 30° to provide the highest digging efficiency based on the correlation diagram that is previously obtained.

Figure 13A:
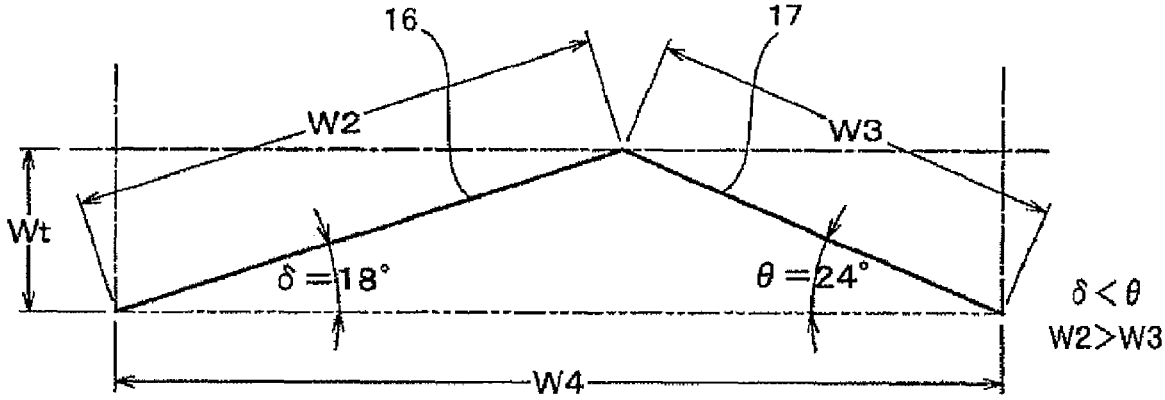
FIGS. 13(*a*) to 13(*c*) are diagrams showing the relationship of the blade widths of an interposition front portion and a side front portion in accordance with the variation of the rearward bending angle and the intersection angle.
Figure 13B:
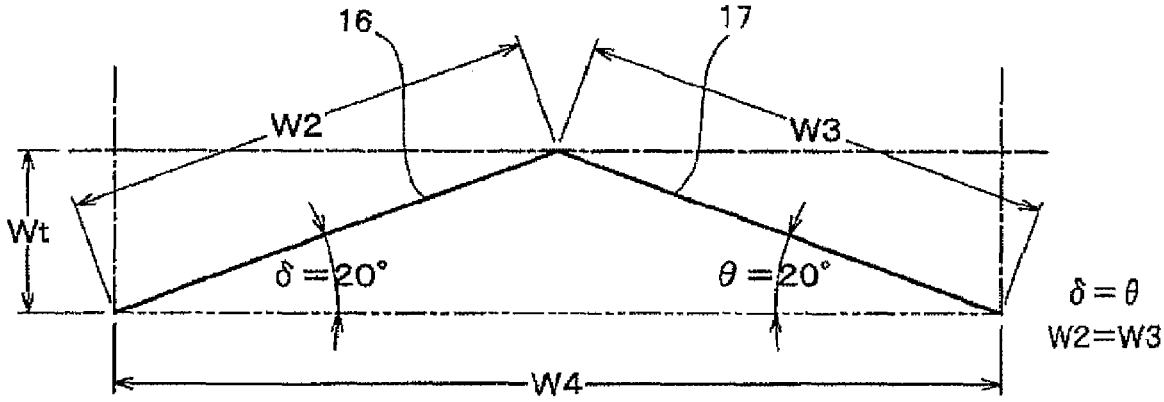
Figure 13C:
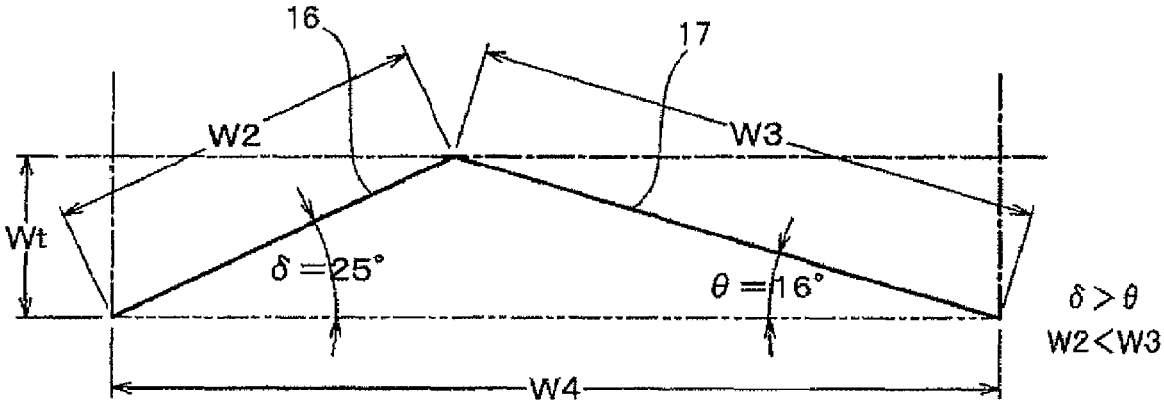

Also, in the blade device 10 according to the present invention, the overall blade width W, and the blade width W1 of the central front portion 12 are determined by blade capacity and the size of a machine. Thus, the distance of a straight line that connects the front end of the aforementioned interposition front portion 13 and the front end of the side front portion 14 that intersect with each other and are positioned in recessed positions is automatically determined. Although the distance of the straight line that connects the front end of the aforementioned interposition front portion 13 and the front end of the side front portion 14 can be determined, it cannot be uniformly determined which of the blade widths W2 and W3 of the lower ends of said interposition front portion 13 and said side front portion 14 is designed longer. FIGS. 13(*a*) to (*c*) show the interval between the elongation line of the edge of the central front portion 12, and the intersection C between the edges of the interposition front portion 13 and the side front portion 14, i.e., the recessed amount Wt, and the change of the length ratio between the blade widths W2 and W3 of the lower ends of the interposition front portion 13 and the side front portion 14, on condition that the distance W4 of a straight line that connects the front end of the interposition front portion 13 and the front end of the side front portion 14 is constant, in the case where the aforementioned rearward bending angle δ that can provide the highest digging efficiency and can reduce the amount of soil that drops off in turning operation, and the intersection angle θ are changed, for example.

As seen from the figures, the length ratio between the blade widths W2 and W3 of the lower ends of the interposition front portion 13 and the side front portion 14 cannot be determined. However, if the length of the third edge section 17 of the side front portion 14 in the blade width direction is longer than that of the second edge section 16 of the interposition front portion 13 (the figure (c)), contrary to the case of a semi U blade, the amount of side cut is large. In addition to this, the amount of soil that flows out from the side front portion 14 laterally is reduced, and the holding amount of soil that is carried by the interposition front portion and the side front portion is increased. Conversely, if the length of the third edge section 17 of the side front portion 14 in the blade width direction is shorter than that of the second edge section 16 of the interposition front portion 13 (the figure (a)), the amount of side cut is small, and the amount of soil that flows out from the side front portion 14 laterally is increased. In an ideal mode, the balance is kept between the amount of soil that is carried on the central front portion and the amount of soil that is carried on the side front portions and the interposition front portions. In an exemplary ideal mode, as shown in the figure (b), the values of the lower end blade widths W2 and W3 of the interposition front portion 13 and the side front portion 14 are equal. Accordingly, the determination of which of the blade widths W2 and W3 of the lower ends of said interposition front portion 13 and said side front portion 14 is designed longer is required to be made based on three parameters of the aforementioned recessed amount Wt, the aforementioned rearward bending angle δ, and the aforementioned intersection angle θ in consideration of balance between function that is required for the side front portion 14 and function that holds carried soil.

Figure 14:
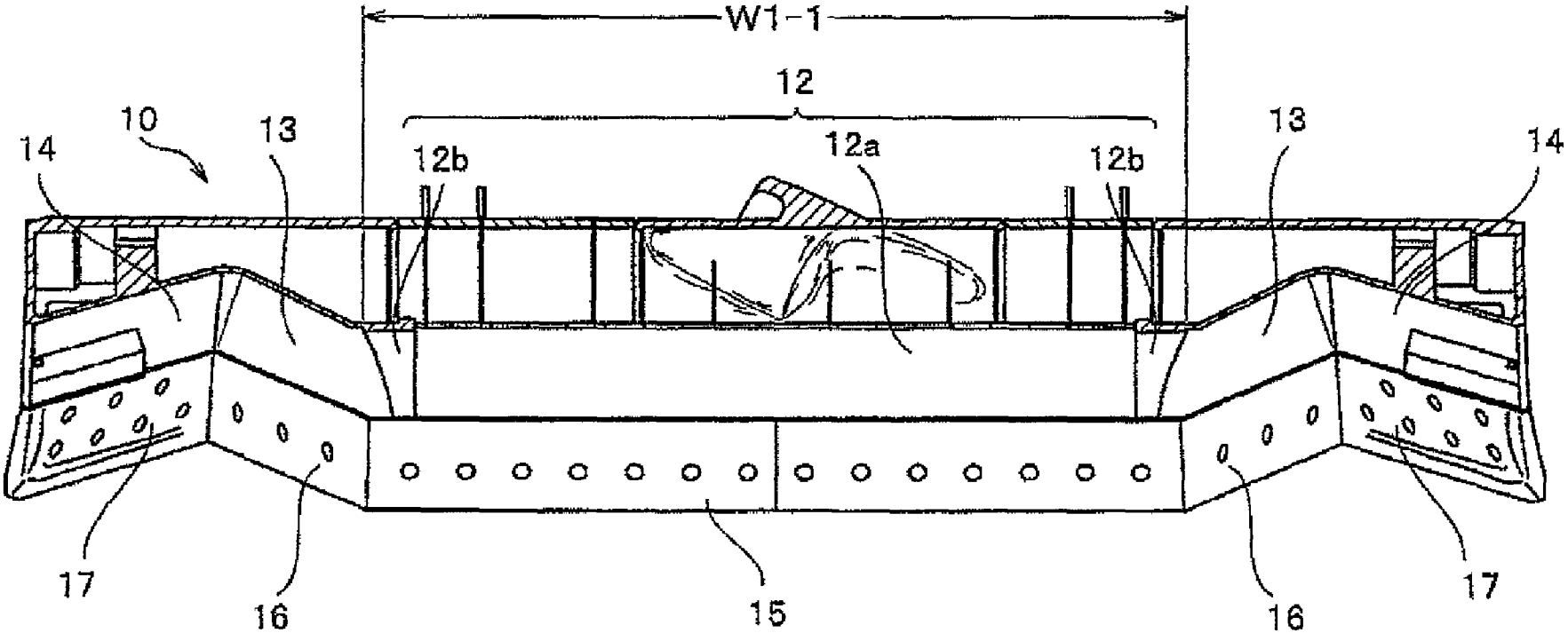
FIG. 14 is a cross-sectional view taken along the line XIV-XIV in FIG. 1.
Figure 15:
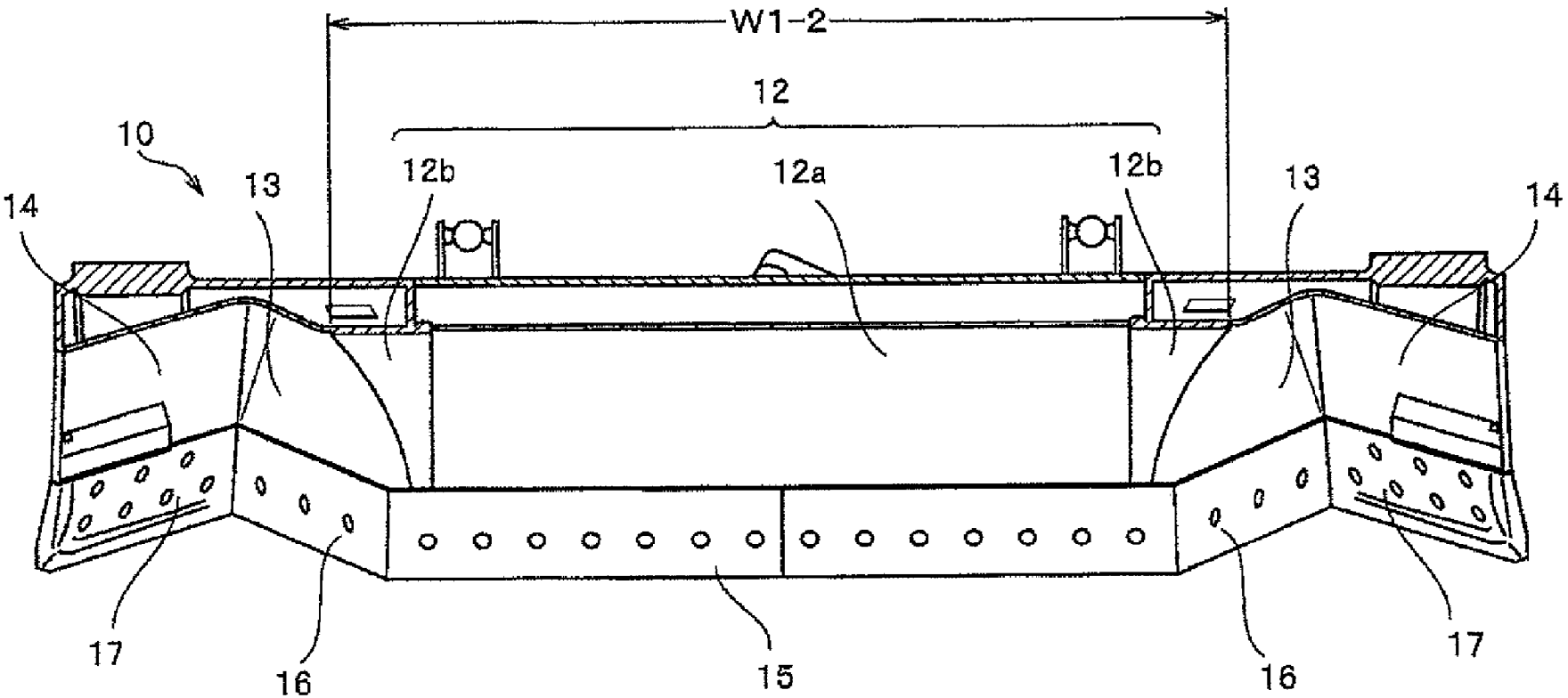
FIG. 15 is a cross-sectional view taken along the line XV-XV in FIG. 1.
Figure 16:
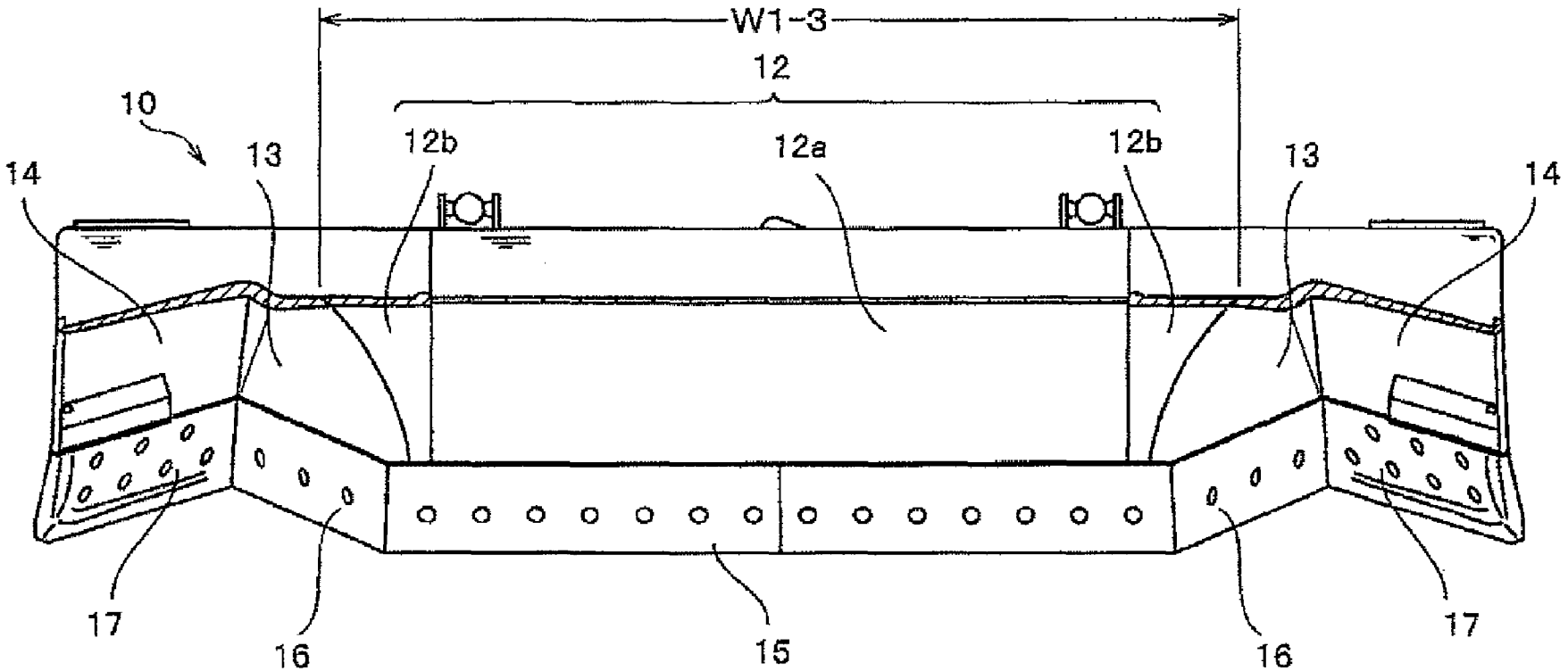
FIG. 16 is a cross-sectional view taken along the line XVI-XVI in FIG. 1.

FIGS. 14 to 16 are cross-sectional views showing the aforementioned blade 11 taken along the lines XIV-XIV to XVI-XVI in FIG. 1. As seen from these figures, the front surface of the blade 11 according to this embodiment is formed in a curved surface that is inclined rearward about the lower end edge of the central front portion 12 as the center line as a whole, and is recessed rearward. Also, the blade width of the front surface of the central front portion 12 is getting wider W1-1, W1-2 and W1-3 in this order from the lower end edge to the top end edge of the central front portion 12. In the case where the blade width of the central front portion 12 is thus gradually increased wider toward the top end edge of the central front portion 12, soil that is excavated by the first to third edge sections 15 to 17 of the central front portion 12, the left and right interposition front portions 13, and the left and right side front portions 14 is pressed toward the upper part of the central front portion 12 through the curved surface and bent surfaces. In this case, since the blade width of the central front portion 12 is gradually increased wider toward the top end edge of the central front portion 12, a large amount of carried soil can be held. As a result, as compared with a simple rectangular front portion, the thus-formed central front portion 12 can maintain a large amount of carried soil in cooperation with its curved surfaces.

FIGS. 17 and 18 show the whole shapes of said pair of, left and right integrated casting parts 101. As seen from the figures, said left and right integrated casting parts 101 are formed in shapes that are plane-symmetric. The integrated casting part 101 according to this embodiment includes the aforementioned front plate-shaped portion 102, the rear portion 103, and the aforementioned first and second brackets 25*a* and 25*b*. The aforementioned front plate-shaped portion 102 is arranged on the front surface side of the integrated casting part 101. The rear portion 103, and the aforementioned first and the second brackets 25*a* and 25*b* are arranged on the rear surface side of the integrated casting part 101. The front plate-shaped portion 102 is formed in a uniform thickness as a whole. Note that the upper part of the front plate-shaped portion 102 in the bending connection part of the side triangular section 12*b* of the central front portion 12, the interposition front portion 13 and the side front portion 14 is thicker than other parts to increase rigidity and strength (see FIGS. 17 to 21).

As shown in FIGS. 17 and 18, box-shaped, first and second rear supporting sections 103*a* and 103*b* that extend laterally as viewed from the rear side and protrude rearward are arranged in a middle upper part and a lower part of said rear supporting portion 105 of said integrated casting part 101. Reinforcement bars are arranged between the rear supporting sections 103*a* and 103*b* to reinforce the rear supporting sections 103*a* and 103*b*. The rear supporting sections 103*a* and 103*b* have hollows that are communicated in the left-and-right direction for weight reduction. The vertical sectional shape of the hollow varies in accordance with the bending connection part of said front plate-shaped portion 102. In particular, in order to ensure rigidity and strength, the sectional area of the hollow in the casting position of the aforementioned first bracket 25*a* is designed the smallest.

Figure 19:
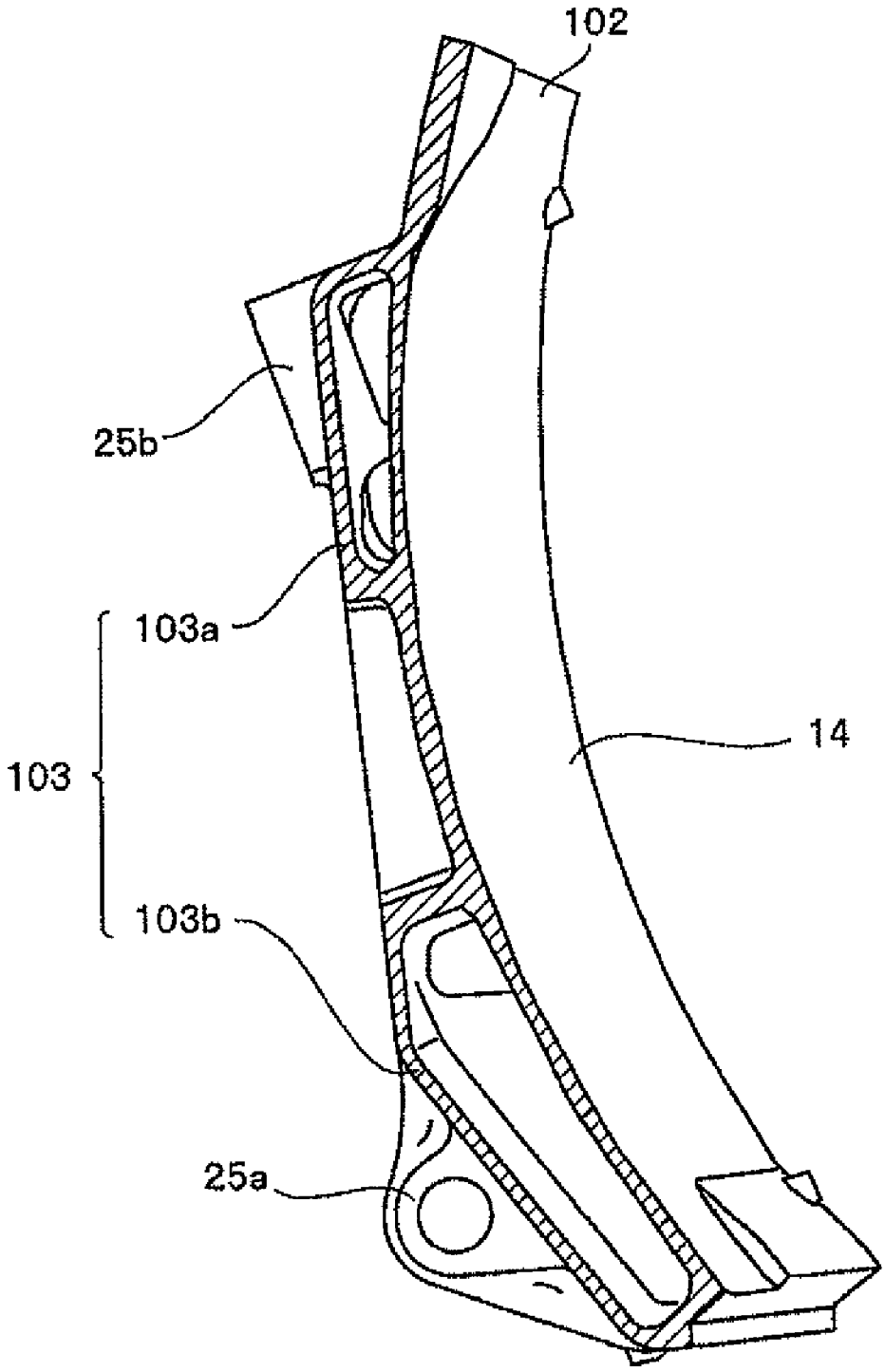
FIG. 19 is a cross-sectional view taken along the line XIX-XIX in FIG. 2.
Figure 20:
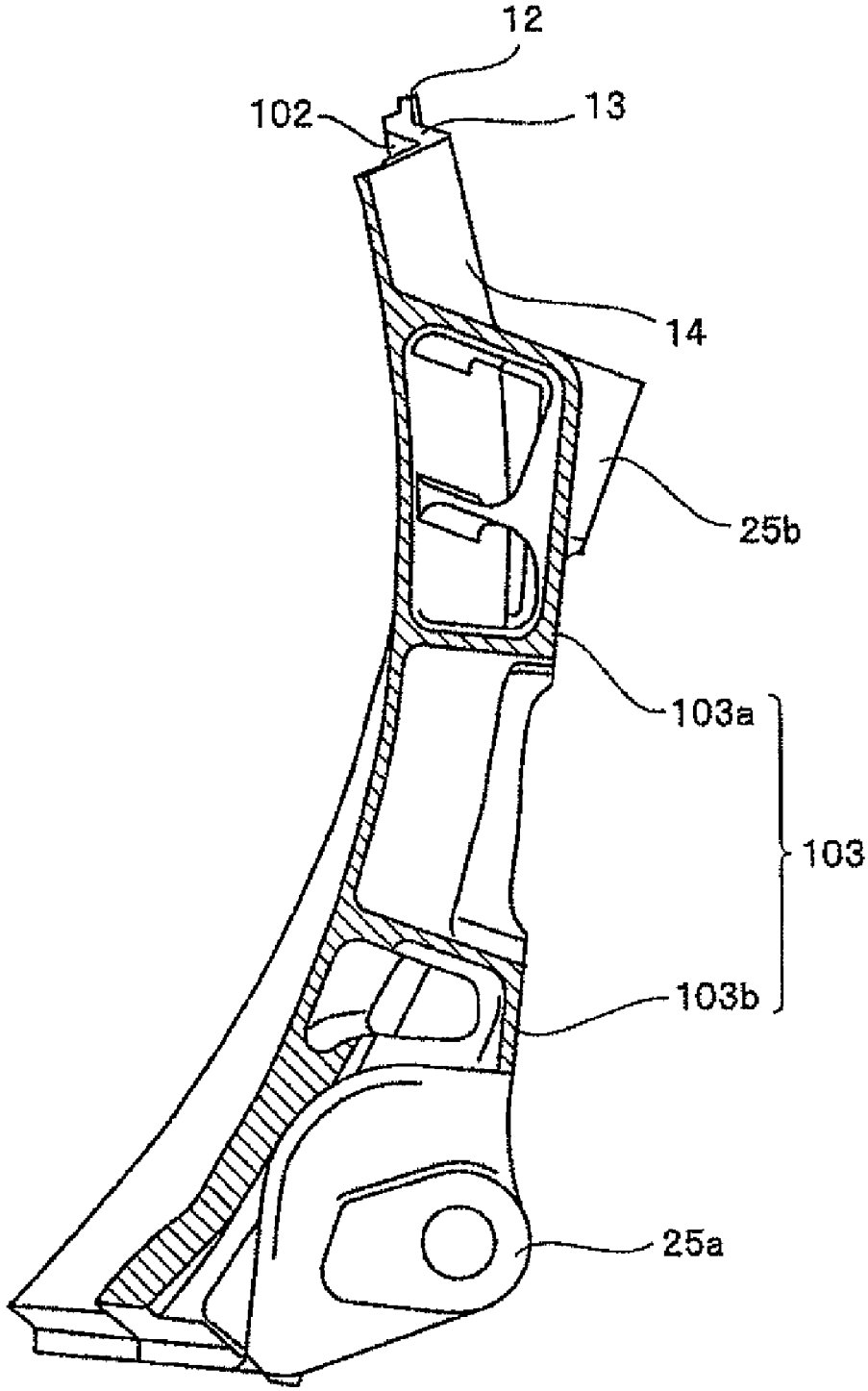
FIG. 20 is a cross-sectional view taken along the line XX-XX in FIG. 3.
Figure 21:
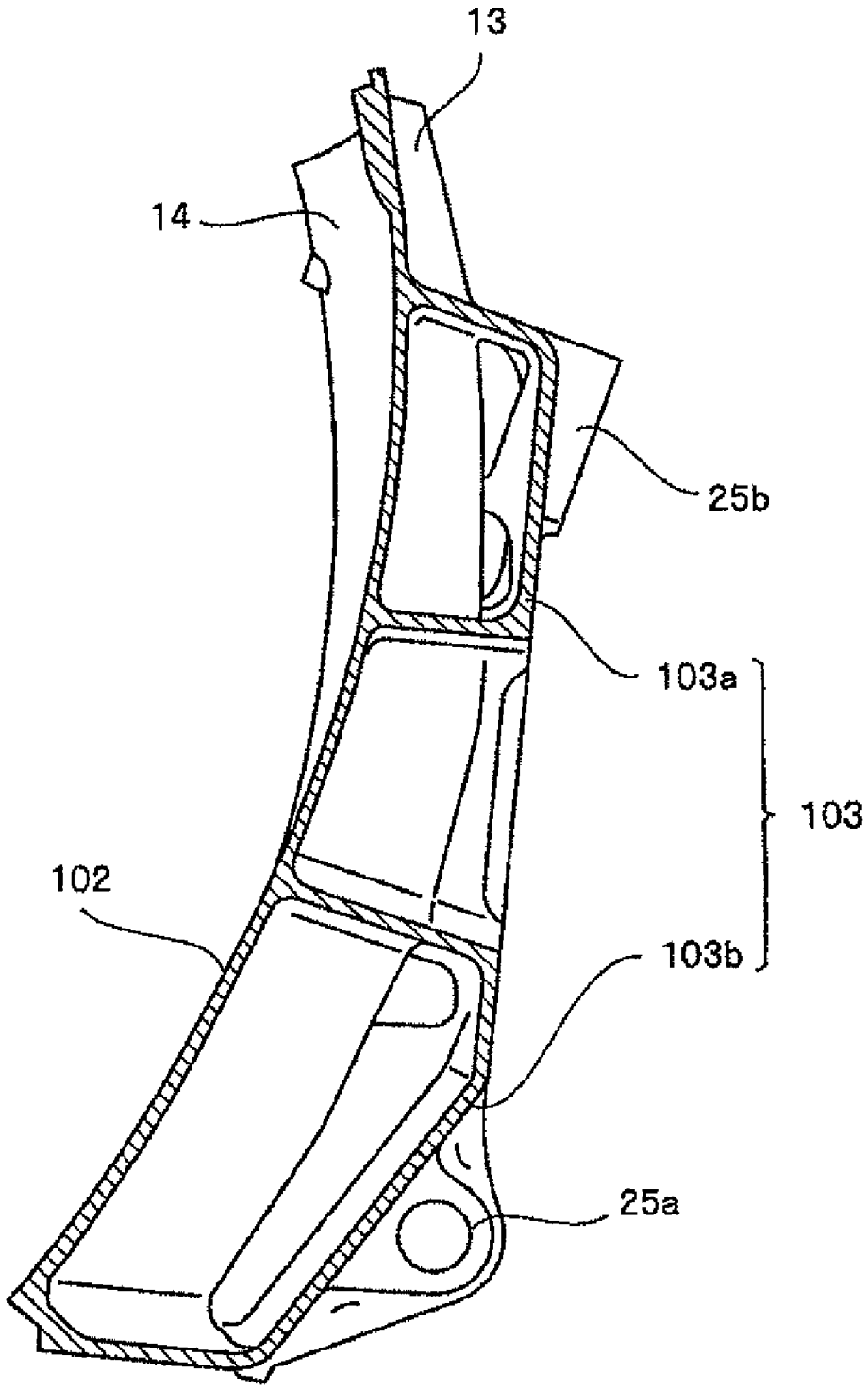
FIG. 21 is a cross-sectional view taken along the line XI-XXI in FIG. 3.

FIG. 19 is a cross-sectional view taken along the line XIX-XIX in FIG. 2. This cross-sectional view shows the sectional shapes of the hollows of the front plate-shaped portion 102 along the bending line between the aforementioned interposition front portion 13 and the side front portion 14. Also, FIG. 20 is a cross-sectional view taken along the line XX-XX in FIG. 3. This cross-sectional view shows the sectional shape along a vertical line that passes the center between the pair of, left and right first brackets 25*a* that are formed in the right end part in front view. FIG. 21 is a cross-sectional view taken along the line XXI-XXI in FIG. 3. This cross-sectional view shows the casting part sectional shape in proximity to the boundary line between the integrated casting part 101 and the plate-shaped portion 105.

Figure 22:
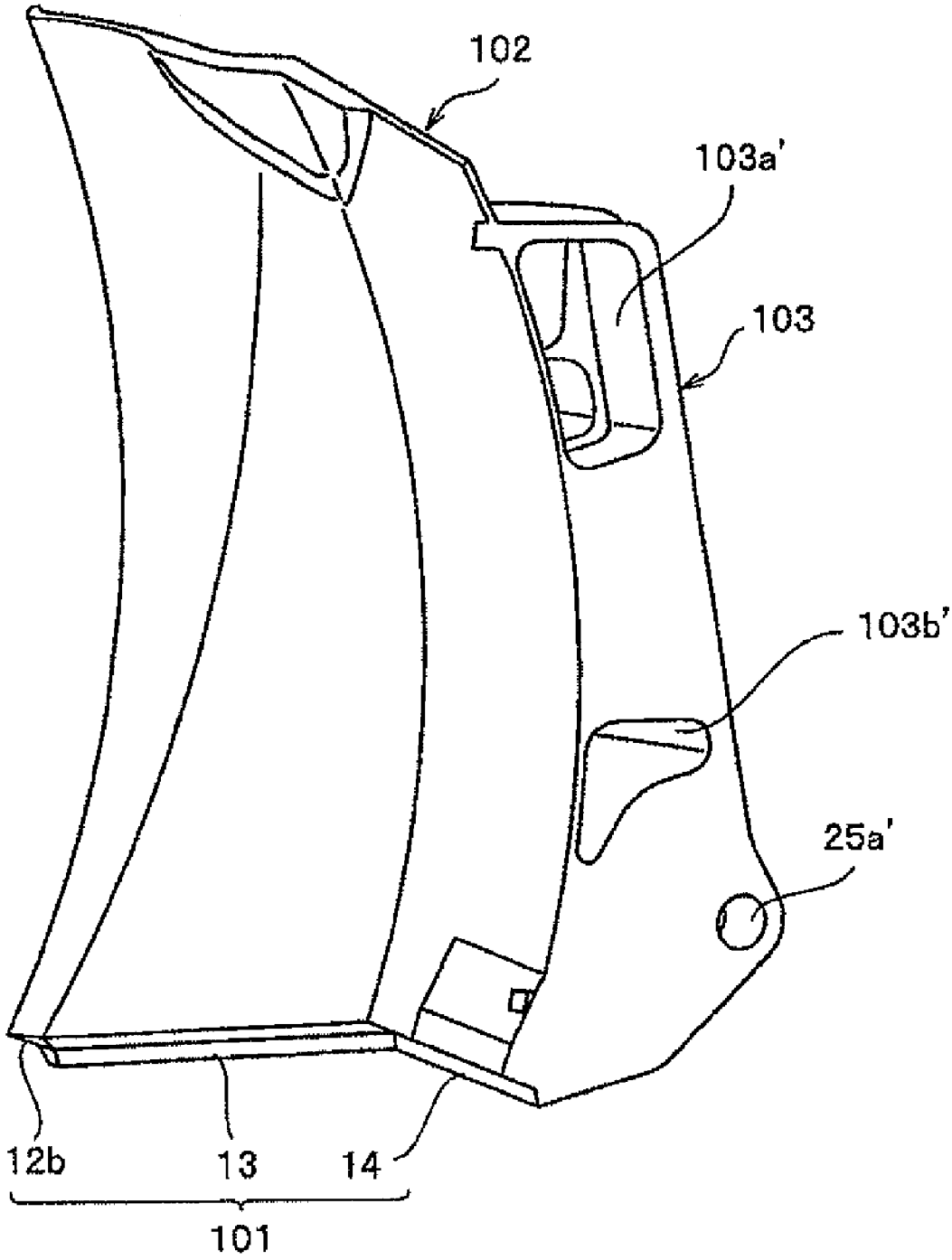
FIG. 22 is a perspective view showing the right integrated casting part as viewed diagonally from front right side.
Figure 23:
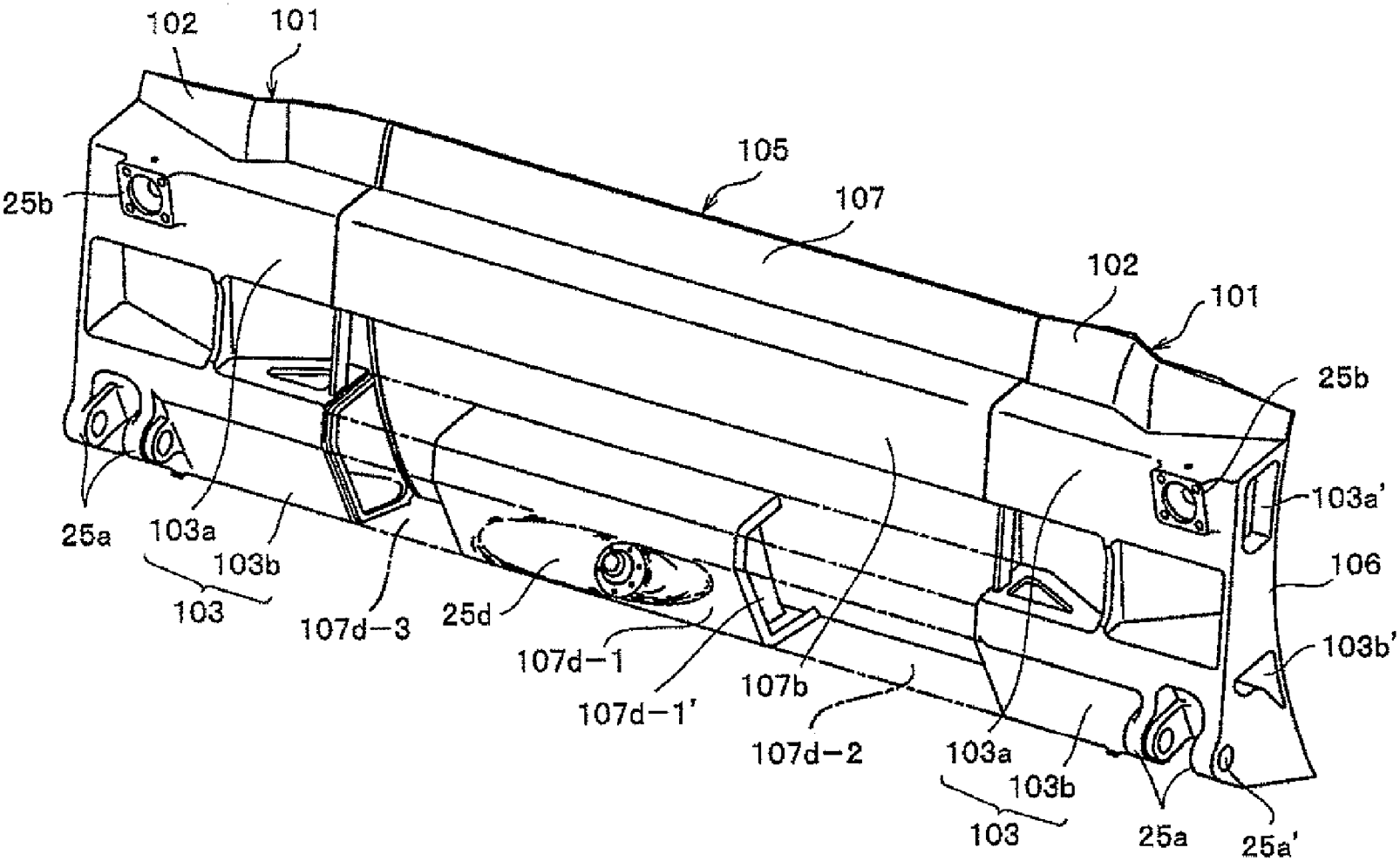
FIG. 23 is a perspective view entirely showing the rear of said blade device as viewed diagonally from rear side.
Figure 24:
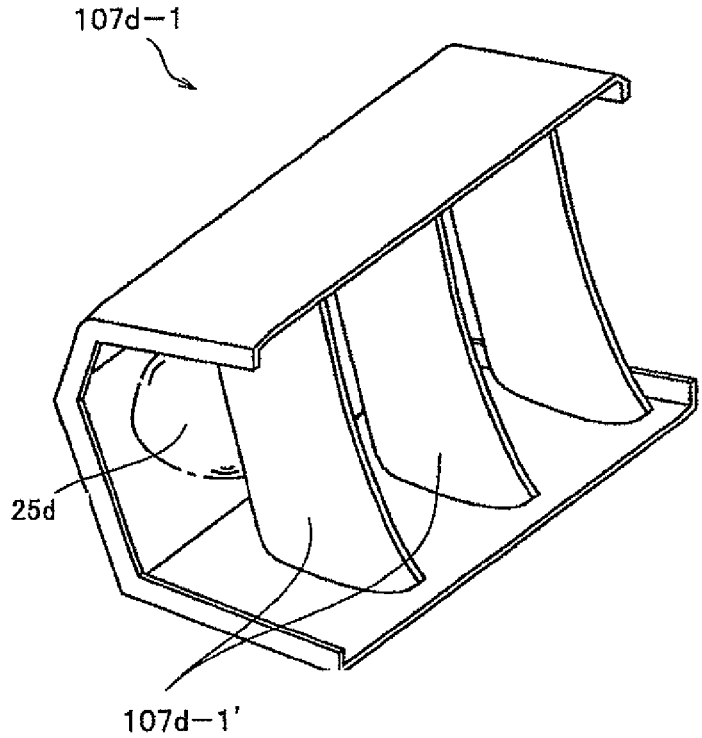
FIG. 24 is a perspective view showing a part of rear supporting member of the plate-shaped portion as viewed diagonally from front left side.
Figure 25:
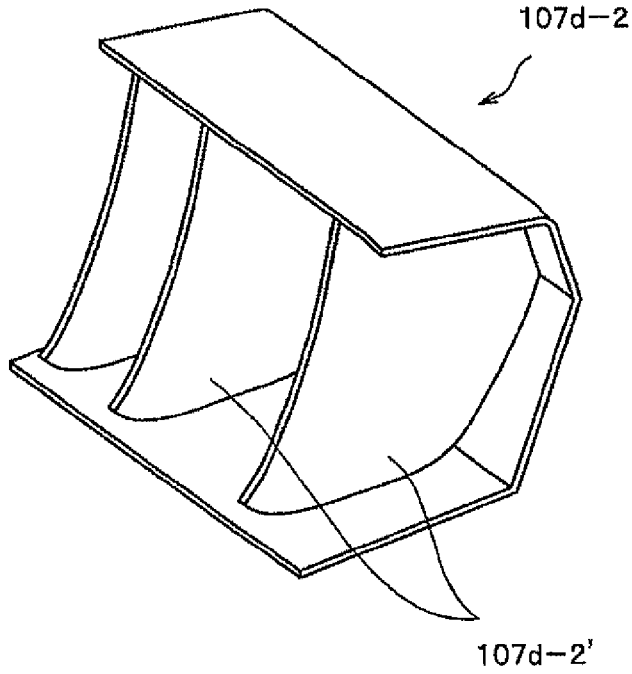
FIG. 25 is a perspective view showing a part of another rear supporting member of said plate-shaped portion as viewed diagonally from front side.
Figure 26:
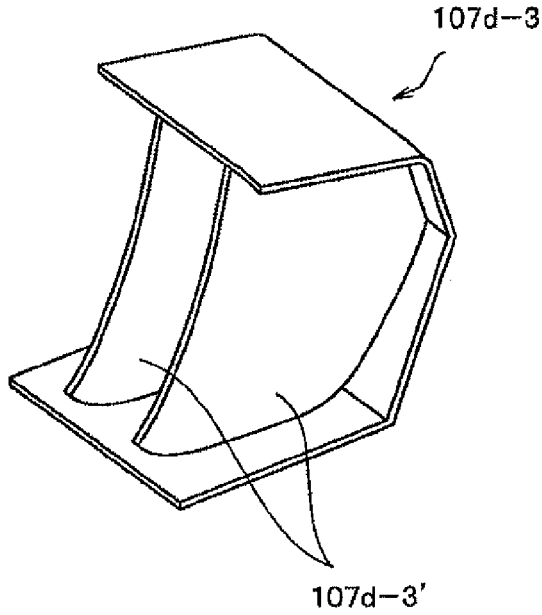
FIG. 26 is a perspective view showing a part of still another rear supporting member of said plate-shaped portion as viewed diagonally from front side.

As seen from these figures, in the boundary part between the interposition front portion 13 and the side front portion 14, the intervals of said hollows between the front plate-shaped portion 102 and the lower ends of the rear supporting sections 103*a* and 103*b* are the narrowest. The intervals of the hollows between the front plate-shaped portions 102 of the left and right side division sections 12*b* and 12*b* of the central front portion 12 where the lower end of said front plate-shaped portion 102 protrudes farthest frontward, and the lower ends of the rear supporting portions 103*a* and 103*b* are the widest. Also, on each of the both outside end surfaces of said left and right integrated casting parts 101, in order to ensure the rigidity and strength of the ends of the box-shaped rear supporting sections 103*a* and 103*b*, as shown in FIG. 22, except a shaft hole 25*a*' of the first bracket 25*a* that is arranged outside, an "inverted and inclined L-"shaped opening 103*b*', and a rectangular opening 103*a*' that is formed above the opening 103*b*', the other parts of outside end surface of the integrated casting part 101 is closed all in a predetermined thickness.

The aforementioned plate-shaped portion 105 includes the rectangular central division section 12*a* of the central front portion 12. As shown in FIGS. 2, 3 and 23 to 26, the aforementioned plate-shaped portion 105 includes the front plate 106 that is made of a steel plate, and the rear supporting member 107 that is composed of a steel plate part and a casting part that are integrally fixed on the rear surface of the front surface plate 106 by welding. The rear supporting member 107 includes a first rear supporting member 107*a*, a second rear supporting member 107*b*, a third rear supporting member 107*c*, and a fourth rear supporting member 107*d*. The first rear supporting member 107*a* is composed of a flat trapezoid plate of metal that is fixed to be inclined by welding from the top end edge of the blade device 10 to the top end edge of the tube-shaped first rear supporting portion 103*a* that is formed in the upper part of the aforementioned integrated casting part 101 as viewed from the rear side of the blade device 10 shown in FIG. 3. The second rear supporting member 107*b* is coupled to the tube-shaped upper rear supporting portions 103*a* of said pair of, left and right integrated casting parts 101 by welding to interpose the central rectangular part of said central front portion 12 between the left and right integrated casting parts 101. The third rear supporting member 107*c* is composed of a steel plate that closes space between said first rear supporting section 103*a* and the second rear supporting section 103*b* that is arranged under the first rear supporting section 103*a* from the left end to the right end of the blade 11 by welding. The fourth rear supporting member 107*d* is coupled to said left and right box-shaped second rear supporting sections 103*b* by welding between the left and right tube-shaped second rear supporting sections 103*b*.

The first and third rear supporting members 107*a* and 107*c* are made of steel plate. A plurality of reinforcing ribs (not shown) are interposed between the first and third rear supporting members 107*a* and 107*c*, and the front plate 106. The second rear supporting member 107*b* is a single, laterally elongated casting part that has a rectangular U shape in section. As shown in FIGS. 23 to 26, said fourth rear supporting member 107*d* is composed of three separated casting parts of left, center and right division members 107*d*-1, 107*d*-2 and 107*d*-3. Said center division member 107*d*-1 is composed of a block member that has a rectangular U shape in section. As shown in FIGS. 17 and 18, the fourth bracket 25*d* that supports one end of the aforementioned strut arm 7 is integrally formed by casting to protrude rearward from the central part of the center division member 107*d*-1. A plurality of reinforcing ribs 107*d*-1' are also integrally formed by casting on the inner wall surfaces of the center division member 107*d*-1. The side division members 107*d*-2 and 107*d*-3 that are arranged on the left and right sides are also composed of block members that have a rectangular U shape in section similar to said central division member 107*d*-1. A plurality of reinforcing ribs 107*d*-2' and 107*d*-3' are arranged on the inner wall surfaces of the side division members 107*d*-2 and 107*d*-3.

The blade device 10 according to this embodiment that includes the aforementioned components is assembled as follows.

First, the inner end surfaces of the front plate-shaped portions of the aforementioned pair of, left and right integrated casting parts 101, and both the left and right end surfaces of the rectangular front surface plate 106 of the central front portion 12 are brought into contact with each other, and the three components are integrally fixed by welding. In this case, the welding lines extend on vertical lines in front view. Accordingly, after the components are positioned, they can be easily welded by a welding robot. Prior to this welding process, side plates 108 are integrally fixed on the outside end surface of said integrated casting parts 101 to extend frontward relative to the curved front edges of the outside end surface of said integrated casting parts 101. The side plates 108 serve to hold carried soil to prevent the soil from falling from the sides of the blade, and also serve to reinforce the side front portions 14.

The aforementioned types of rear supporting members 107 are integrally assembled by welding on the rear surface of the thus-configured blade 11 one after another. After this assembling process is completed, crescent-shaped third brackets 25*c* are fixed by welding over the aforementioned third rear supporting member 107*c* and the aforementioned left and right division member 107*d*-1 and 107*d*-3 of the fourth rear r supporting member 107*d* to support the piston rod ends of the pair of, left and right, two (hydraulic) lift cylinders 6 shown in FIGS. 3 and 4. The first to third edge sections 15 to 17 are secured along the lower ends of the central front portion 12, the interposition front portions 13, and the side front portions 14 of the thus-assembled blade 11 according to this embodiment in a conventional manner. Thus, the blade device 10 according to the present invention is produced. In this embodiment, said first edge section 15 has a flat straight shape along the lower end of the central front portion 12. Accordingly, the blade 11 can be effectively used for digging, soil carrying, and leveling without replacing the blade in accordance with digging, soil carrying, and leveling. Therefore, it is possible to smoothly and efficiently perform these types of work.

As for the thus-produced blade device 10, when the integrated casting parts 101 that include the triangular side division section 12*b* of the central front portion 12, the interposition front portion 13, and the side front portion 14 that are integrally formed by casting are integrally fixed to the left and right ends of the front plate 106 of the plate-shaped portion 105 as the rectangular central division section 12*a* of the central front portion 12 by welding, assembling of the front plate 106 of the central front portion 12, and the side triangle parts of the central front portion 12, the interposition front portions 13 and the side front portions 14 is completed. In this case, said triangular side division sections 12*b*, the interposition front portions 13, and the side front portions 14 are formed by casting integrally with the box-shaped first and second rear supporting sections 103*a* and 103*b* and the first and second brackets 25*a* and 25*b*. Accordingly, additional special processing and assembling are not required, and as a result ease of assembling is improved in cooperation with a welding robot. Therefore, assembling of the whole blade time is greatly reduced.

Also, in this integrated casting part 101, the bending boundary part between the interposition front portion 13 and the side front portion 14 where the front plate-shaped portion 102 and the rear portion 103 are the closest is brought to the minimum required for them. Also, in a part that requires rigidity and strength, particularly in the casting area of the first bracket 25*a* that pivotally supports the lift frame 3, the front plate-shaped portion 102 and the second rear supporting portion 103*b* are formed by casting to be connected to each other in a solid structure. Also, in other rear surface area, the front plate-shaped portion 102, and the rear portions 103*a* and 103*b* form a hollow structure. Accordingly, the width of the blade device 10 in the front-and-rear direction can be the minimum required for the blade device, and additionally the weight of the blade device can be reduced. In particular, in the case where the first and second brackets 25*a* and 25*b* are formed by casting integrally with the first and second rear supporting portions 103*a* and 103*b*, the base ends of the first and second brackets 25*a* and 25*b* are recessed inside the rear portion 103. In this case, the amount of rearward protrusion can be designed small. Accordingly, the maximum size of the blade 11 in the length in the front-and-rear direction can be further reduced. Also, in an area that does not require high rigidity and strength, the rear supporting member 107 of the plate-shaped portion 105 of the central front portion 12 is formed of plates of metal in a hollow structure. In an area that requires high rigidity and strength, the rear supporting member 107 is formed of a casting part of a hollow structure that includes the reinforcing ribs 107*d*-1', 107*d*-2', and 107*d*-3'. Therefore, rigidity and strength that are required for the whole blade are ensured in these areas, and downsizing and weight reduction can be achieved. As stated above, since improvement of ease of assembling, and downsizing and weight reduction can be achieved, it is possible to suppress the increase of manufacturing cost.

Also, as stated above, the blade device 10 according to the present invention has a blade front surface shape similar to the foregoing WO2004/044337A1. Accordingly, in this embodiment, the front surface of said interposition front portion 13 also has function that smoothly gathers soil that moves from both the front surfaces of the central front portion 12 and the side front portion 14 in digging and soil carrying. In addition to this, said side front portion 14 has function that surely holds soil in digging and soil carrying so that the soil does not flows out from the sides of the blade. Since said interposition front portion 13 and the side front portion 14 hold soil so that the soil rises along the blade front surfaces, the loss of the amount of soil is reduced. In addition to this, the resistance of soil that flows from the side front portion 14 toward the central front portion 12 is reduced. Therefore, it is possible to greatly increase the amount of soil that stands on the blade front surface of the central front portion 12.

Also, the traction force and the amount of soil per traction force of the blade according to the present invention is increased as compared with conventional blades. In the blade according to the present invention, digging resistance is reduced, and soil carrying resistance is also reduced as compared with conventional blades. Accordingly, the consumption power of the blade according to the present invention in digging and soil carrying is reduced as compared with the consumption power of conventional blades in digging and soil carrying. From the viewpoints, as compared with conventional blades, the blade according to the present invention can efficiently perform desired dozer work for a shorter time, and with traction force and digging power smaller than conventional blades.

It will be clearly understood from the above description that, in particular, in the blade of the blade device according to the present invention, it is possible to easily determine a shape that has the highest digging efficiency in design, and additionally soil that stands on the blade does not flows out from the blade even when soil is carried in turning operation. In addition to this, in the case where the casting parts and steel plates are effectively combined, simplification of blade structure, improvement of ease of assembling and welding workability, and weight reduction and downsizing can be achieved. Also, since a blade according to the present invention has the blade structure that is described in the foregoing WO2004/044337A1 as stated above, similar to the blade device that is described in Patent Document 6, it is natural that the resistance against traction force is reduced, and the amount of soil per traction force is greatly increased. In addition to this, the consumption power in digging and the soil carrying can be greatly reduced. The amount of digging and soil carrying can be maximized with a minimum energy amount in a short time. The fuel efficiency of the aforementioned work machine is remarkably improved. As a result, it is possible to reduce cost.

Second Embodiment

With reference to FIGS. 27 to 33, the following description will describe a blade (work machine blade) 50 with a guard (guard member) 70 mounted thereto according to another embodiment of the present invention.

Note that, as for a "front and rear" direction used in the following description, the "front" refers to the advancing direction, and the "rear" refers to the reverse direction of a bulldozer.

Overall Configuration of Blade 50

Figure 28:
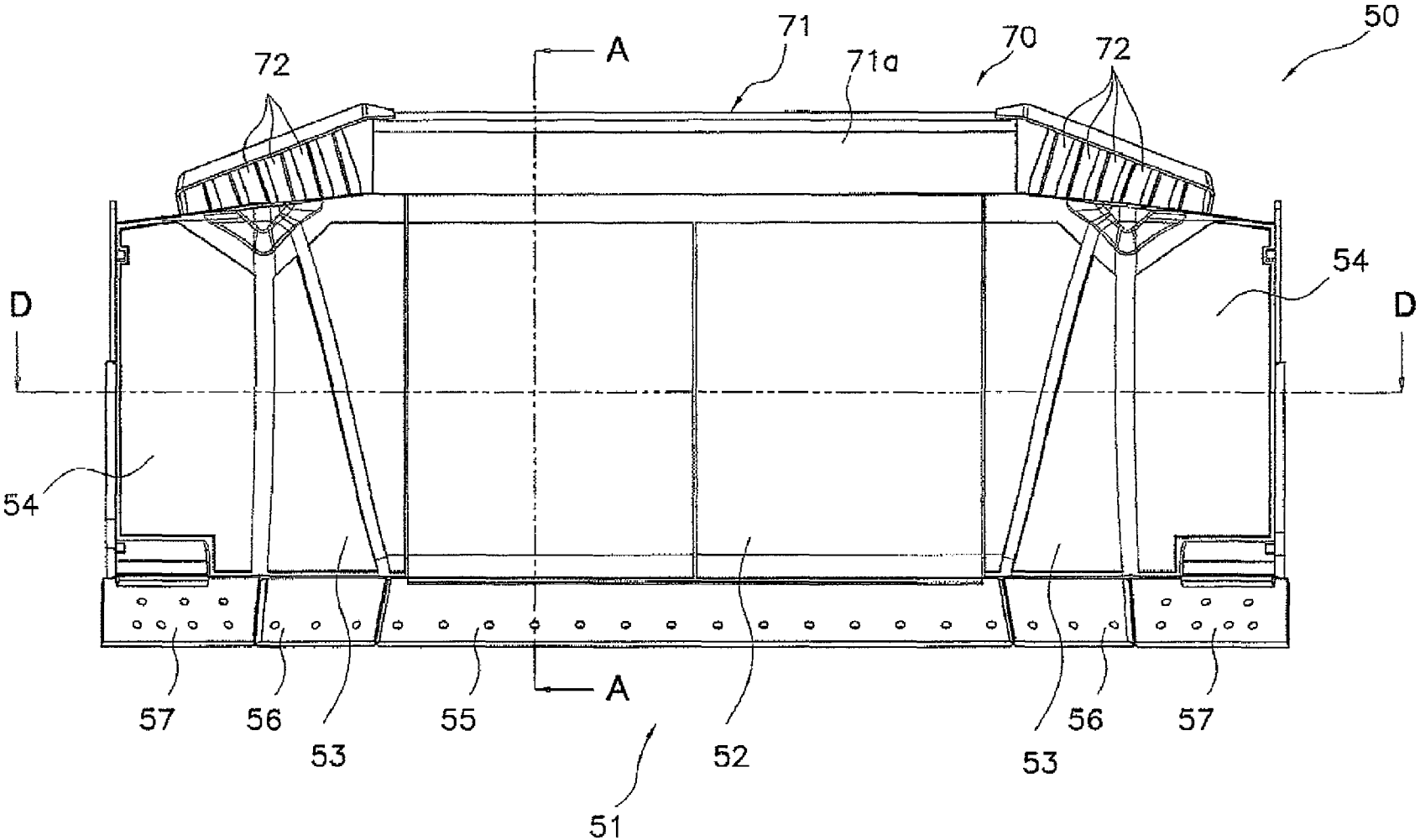
FIG. 28 is a front view showing the blade shown in FIG. 27.
Figure 29:
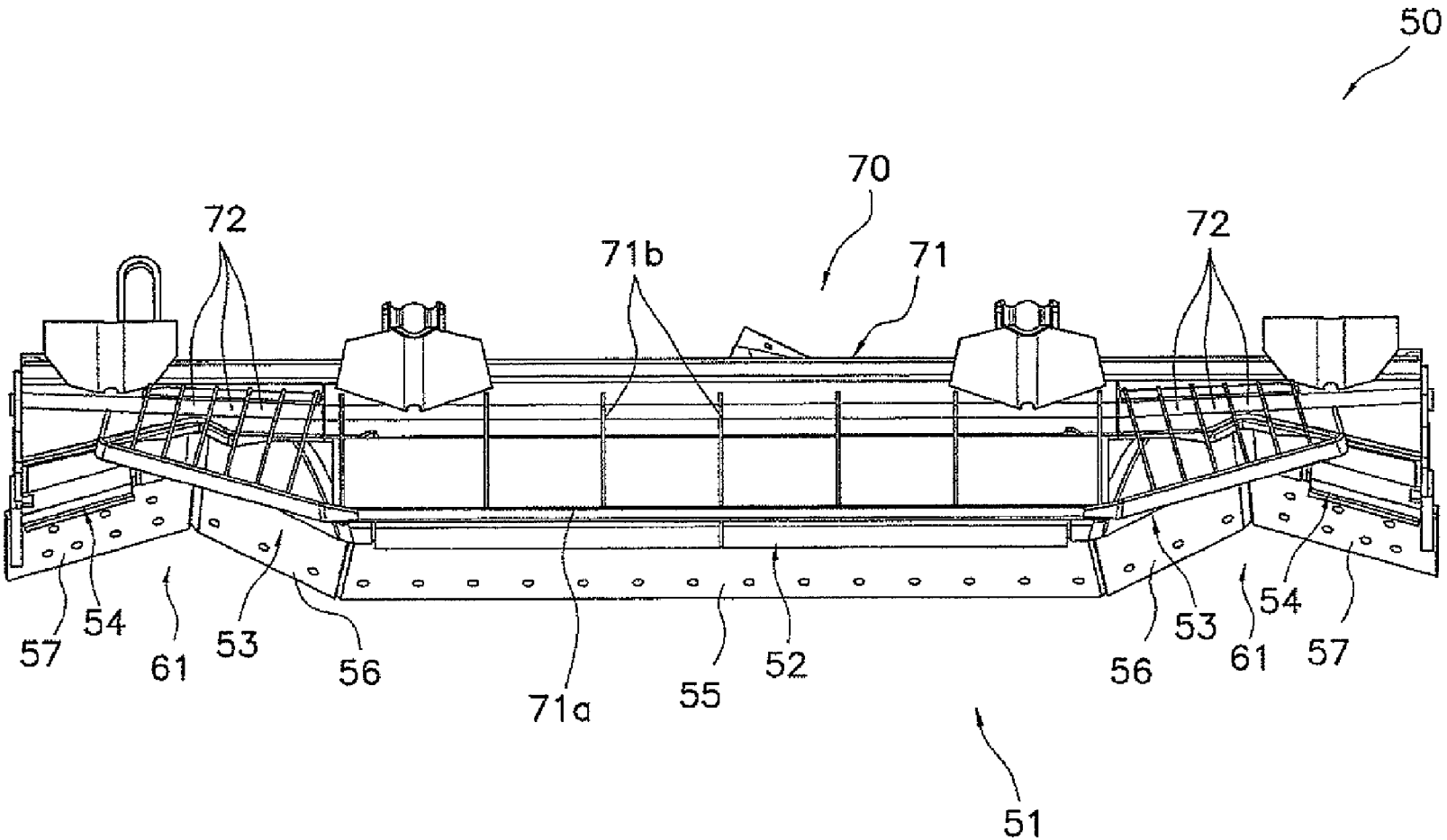
FIG. 29 is a top plan view showing the blade shown in FIG. 27.
Figure 30:
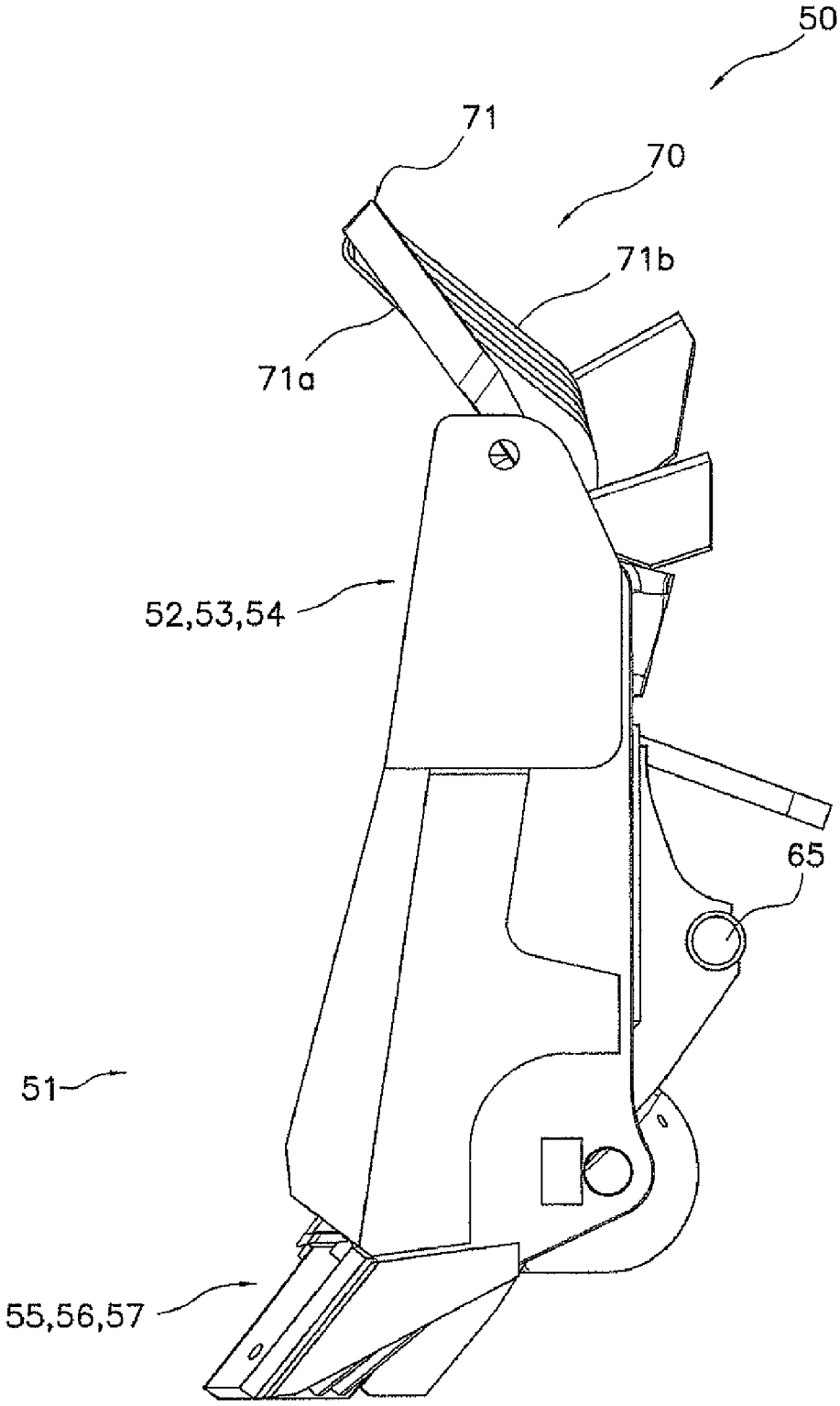
FIG. 30 is a side view showing the blade shown in FIG. 27.
Figure 31:
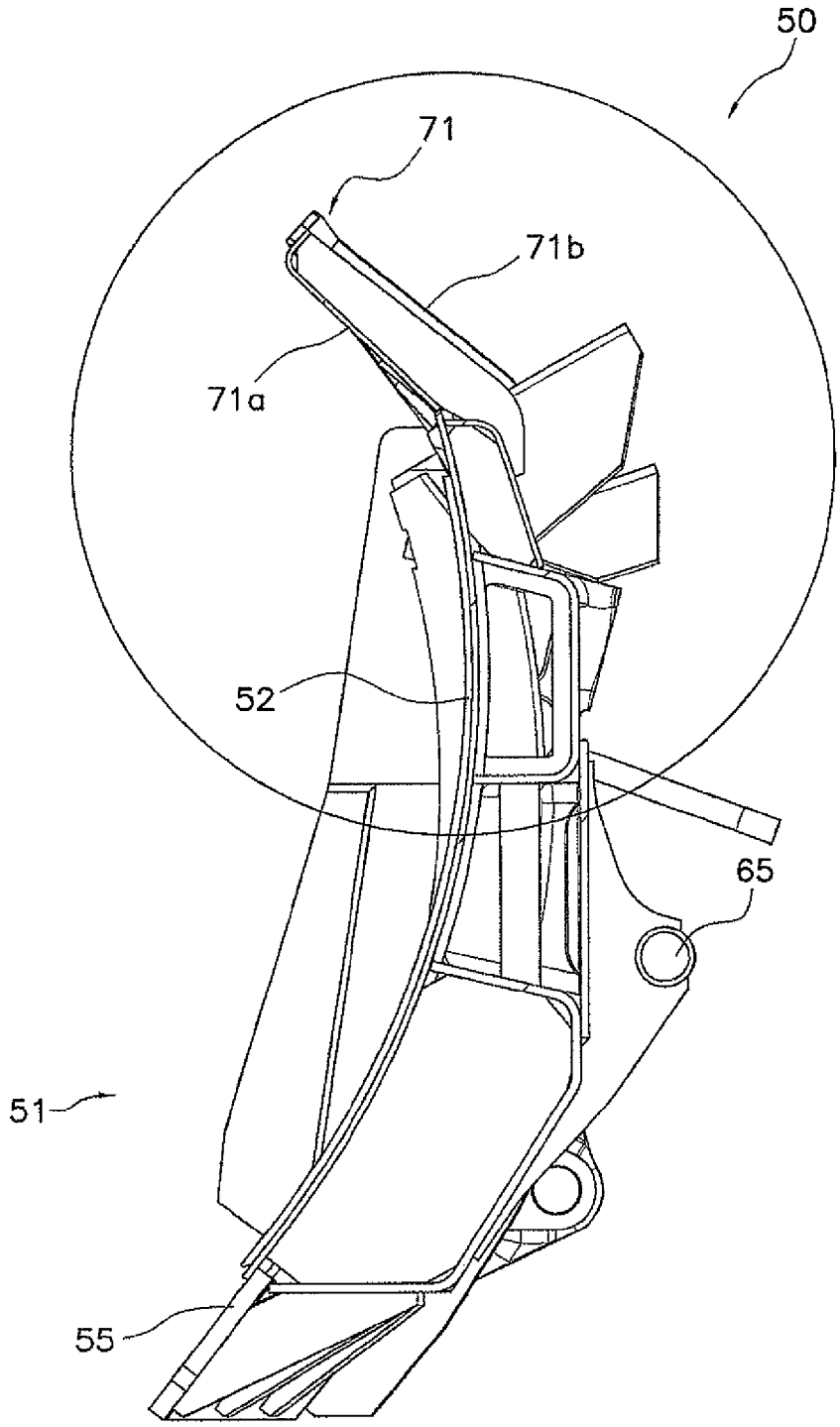
FIG. 31 is a cross-sectional view taken along the line A-A in FIG. 28.

The blade 50 according to this embodiment is a dozing plate for work that is mounted in the front part of a bulldozer (not shown), and includes a blade front surface portion (front portion) 51 and a guard 70, as shown in FIGS. 27 to 30. The blade front surface portion (front portion) 51 has a curved shape that is curved in a concave shape in the vertical direction. The guard 70 is fixed on the top end of the blade front surface portion 51. Also, the blade 50 is provided with a plurality of attachment flange portions (attachment portions) 65 that protrude rearward as shown in FIGS. 30 and 31. The attachment flange portions 65 receive lift frames, a strut arm, tilt cylinders, and lift cylinders that couple the blade 50 to the front part of the bulldozer.

Also, the tilt cylinders, the lift cylinders, the hydraulic pumps and the like (not shown) are controlled to control the posture of the blade 50. In soil dumping work, the blade 50 is controlled in a posture in that the blade 50 is inclined frontward in an angle of about 30 to 60 degrees relative to the digging posture. In soil carrying work, the blade 50 is controlled in a posture in that the blade 50 is inclined rearward in an angle of about 10 to 30 degrees relative to the digging posture. Accordingly, in soil dumping work, since the blade 50 is inclined frontward in an angle greater than conventional blades, soil dumping performance can be improved. In addition to this, in soil carrying work, the amount of soil carrying of the blade 50 can be increased.

Configuration of Blade Front Surface Portion 51

The blade front surface portion 51 is formed of a laterally elongated steel material with high rigidity, and a central front portion 52, a pair of, left and right interposition front portions 53, and a pair of, left and right side front portions 54. The interposition front portions 53 are arranged on the both ends of the central front portion 52. The side front portions 54 are arranged on the ends of the interposition front portions 53.

As shown in FIG. 31, the central front portion 52 has a curved surface that has a constant curvature in side view. A straight first edge section 55 is arranged on the lower end of the central portion 52. The central front portion 52 protrudes frontward relative to the interposition front portions 53 and the side front portions 54, as shown in a top plan view of the blade shown in FIG. 29. Also, the blade width of the lower end of the central front portion 52 is suitable for digging function, soil carrying function, and leveling function. The first edge section 55 is a flat and straight plate-shaped member that is mounted along the lower end of this central front portion 52. According to this configuration, the blade 50 can be effectively used for digging, soil carrying, and leveling without replacing the blade in accordance with digging, soil carrying, and leveling. Therefore, it is possible to smoothly and efficiently perform these types of work.

The interposition front portions 53 include second edge sections 56. The second edge sections 56 are connected to and extend from the first edge section 55 of the central front portion 52, and are inclined rearward at a predetermined angle. Also, the one side edge of the interposition front portion 53 extends and is inclined in the same direction as the side edge of the central front portion 52. As shown in FIG. 28, in front view, the width of the interposition front portion 53 is getting wider from the top end to the lower end of the interposition front portion 53. The interposition front portions 53 have function that smoothly gathers soil that moves from both the central front portion 52 and the side front portions 54 in digging and soil carrying.

The side front portions 54 include straight third edge sections (side edge sections) 57. The third edge sections 57 are connected to and extend from the second edge sections 56 of the interposition front portions 53, and are inclined frontward at a predetermined angle. Also, as shown in FIG. 28, the side front portions 54 are formed in a constant width from the top end toward the lower end. In addition to this, the side front portions 54 have function that surely holds soil in digging and soil carrying so that the soil does not flow out from the sides of the blade.

Figure 32:
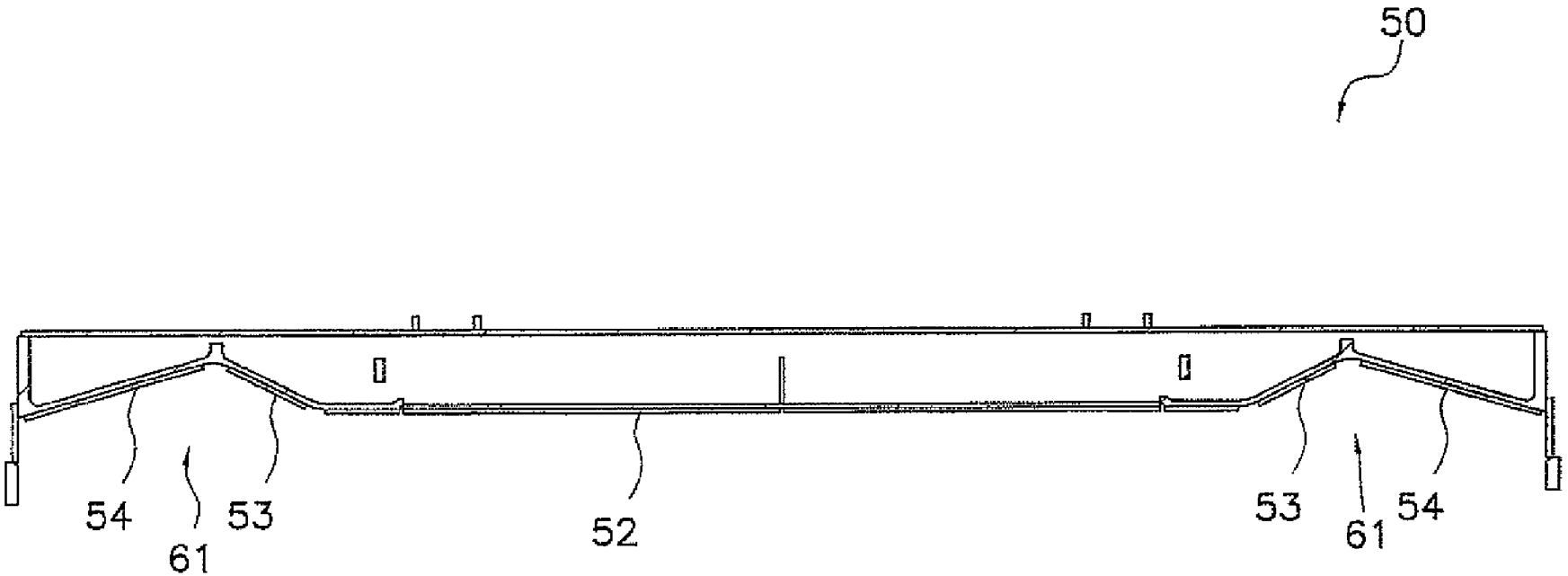
FIG. 32 is a cross-sectional view taken along the line D-D in FIG. 28.

As shown in FIGS. 29 and 32, in plan view, the connection part between the interposition front portion 53 and the side front portion 54 is positioned in a recessed position that is located rearward relative to the connection part between the central front portion 52 and the interposition front portion 53, and the outside end of the side front portion 54. The interposition front portions 53 and the side front portions 54 are coupled to each other to form a substantially V shape so that the side front portions 54 extend in a direction perpendicular to the front and rear direction. Note that the outside end of the side front portion 54 can be positioned at the same position as the connection part between the central front portion 52 and the interposition front portion 53 in the front-and-rear direction in plan view, or can be positioned rearward relative to the connection part between the central front portion 52 and the interposition front portion 53. Thus, recessed portions 61 are formed by the interposition front portion 53 and the side front portion 54 in the both sides of the blade 50. Accordingly, soil that rises along the front portions 52, 53, and 54 is held on the front surfaces of the interposition front portion 53 and the side front portion 54, and a part between the interposition front portion 53 and the side front portion 54 in work. It is possible to reduce the loss of the amount of soil. Also, since, in plan view, the connection part between the interposition front portion 53 and the side front portion 54 is positioned in a recessed position that is located rearward relative to the connection part between the central front portion 52 and the interposition front portion 53, and the outside end of the side front portion 54, the resistance of soil in digging is reduced, and it is possible to greatly increase the amount of soil that stands on the front surface of the central front portion 12.

Note that although, in this embodiment, the interposition front portion 53 and the side front portion 54 are illustratively described to be arranged to form a substantially V shape in plan view, the present invention is not limited to this. For example, the interposition front portion and the side front portion may be arranged to form a substantially U shape.

The first edge section 55, the second edge section 56, and the third edge section 57 are made of an excellent wear resistant, damage resistant and tough material (e.g., boron steel). Also, since the first edge section 55, the second edge section 56, and the third edge section 57 are thus arranged, the first edge section 55 cuts earth prior to the second edge section 56 and the third edge section 57. Accordingly, since the first edge section 55 excavates earth near the other edge sections 56 and 57 prior to the other edge sections 56 and 57, actual digging power required for the second and third edge sections 56 and 57 can be smaller than the digging power of the first edge section 55. In addition to this, the amount of digging by the second and third edge sections 56 and 57 can be smaller than the first edge section 55.

In this embodiment, the front surfaces of the central front portion 52, the interposition front portions 53, and the side front portions 54 have a curved surface that is continuously formed in a concave surface with the same curvature in the vertical direction in side view. Since the front surfaces of the front portions 52 to 54 thus have a curved surface that has the same curvature in the vertical direction, soil can smoothly move frontward on the front surface of the blade 50, and it is possible to prevent that the holding amount and the rising height of soil are limited.

Configuration of Guard 70

The guard 70 is fixed by welding on the top end of the blade front surface portion 51, as shown in FIGS. 27 to 30. Also, the guard 70 has a main portion 71 and openings (front viewing openings) 72, 72.

The main portion 71 includes a soil contact surface 71*a*, and a plurality of ribs 71*b*. The soil contact surface 71*a* comes in contact with soil that stands on the front surface of the blade 50 in soil carrying work or the like, and provides a flow of the soil that returns frontward. The ribs 71*b* stand on the opposite surface (rear surface) to the soil contact surface 71*a* of the main portion 71.

Figure 33:
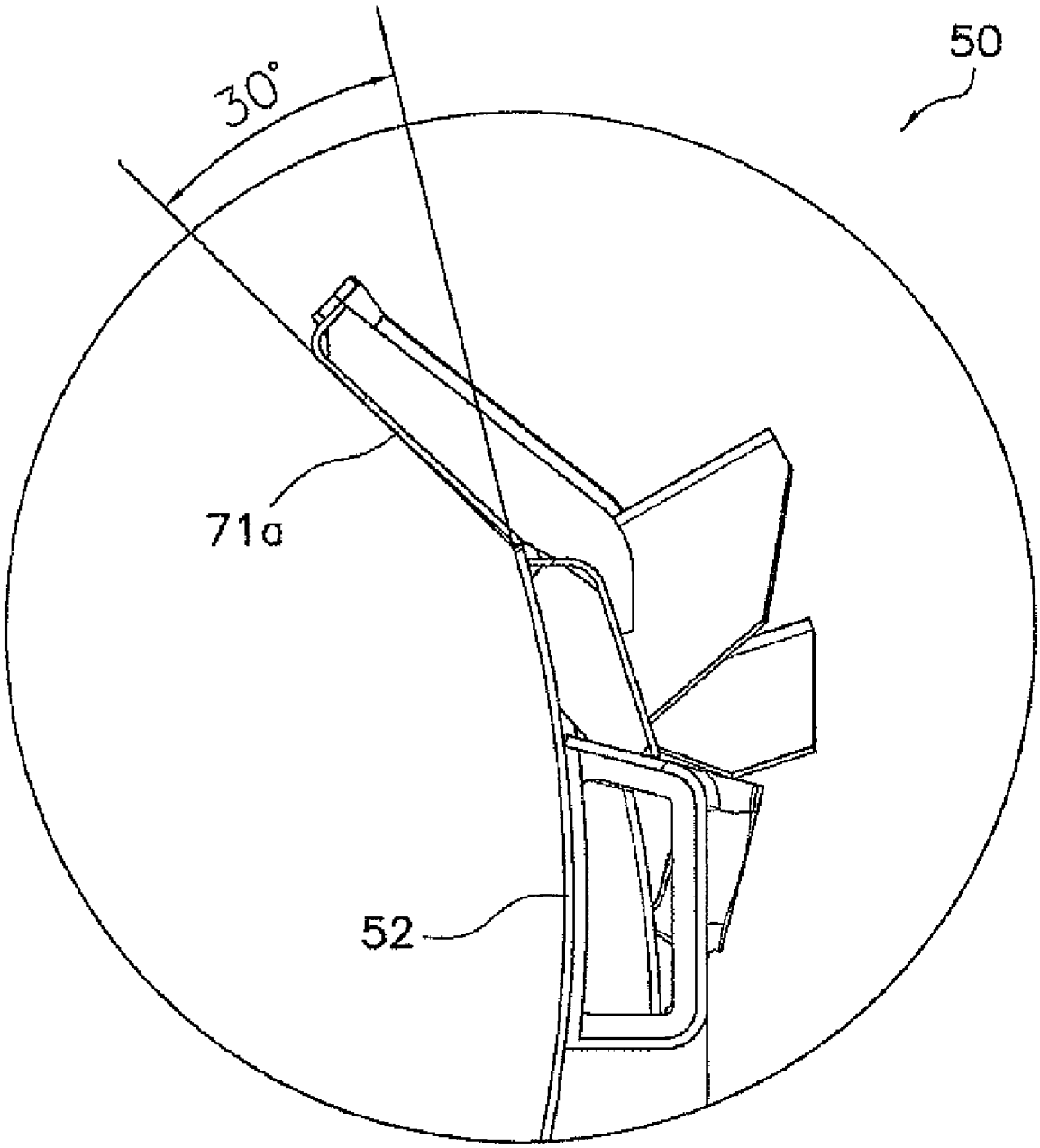
FIG. 33 is a partially enlarged view showing the upper part of the blade shown in FIG. 31.

As shown in FIG. 33, the soil contact surface 71*a* is a straight (flat) surface that is fixed to be inclined frontward about 30 degrees relative to the elongation line (tangential direction) of the top end of the central front portion 52 front surface of the blade 50 in side view. In the case where the guard 70 is fixed on the upper end of the blade 50 in a posture in that the front surface (soil contact surface 71*a*) of the guard 70 is inclined frontward relative to the elongation line in the upper end of the front surface of the blade 50, the soil contact surface 71*a* that is inclined frontward relative to the elongation line of the top end of the blade front surface of the blade 50 provides a flow of the soil that returns frontward. Accordingly, for example, in soil carrying work, even in the case where the work is performed in the state where the whole blade 50 is inclined rearward about 20 degrees, it is possible to greatly reduce the flowing-out amount of soil that has stood on the front surface of the blade 50 and flows out rearward.

The ribs 71*b* are a plurality of plate-shaped members that stand substantially perpendicular to the rear surface of the main portion 71, and support the rear surface of the soil contact surface 71*a* to support a load that is applied to the soil contact surface 71*a*.

The openings 72, 72 are apertures that are formed so that an operator of the bulldozer to which the blade 50 is attached sees the amount of soil that stands on the front surface of the blade 50 from the operator's seat in work. The openings 72, 72 are arranged on the both ends of the main portion 71 of the guard 70. Accordingly, even in the case where the guard 70, which interrupts the operator's field of front view of the blade 50, is fixed on the upper end of the blade 50, it is possible to suppress reduction of the visibility of the operator in work.

Features of Blade 50

Figure 27:
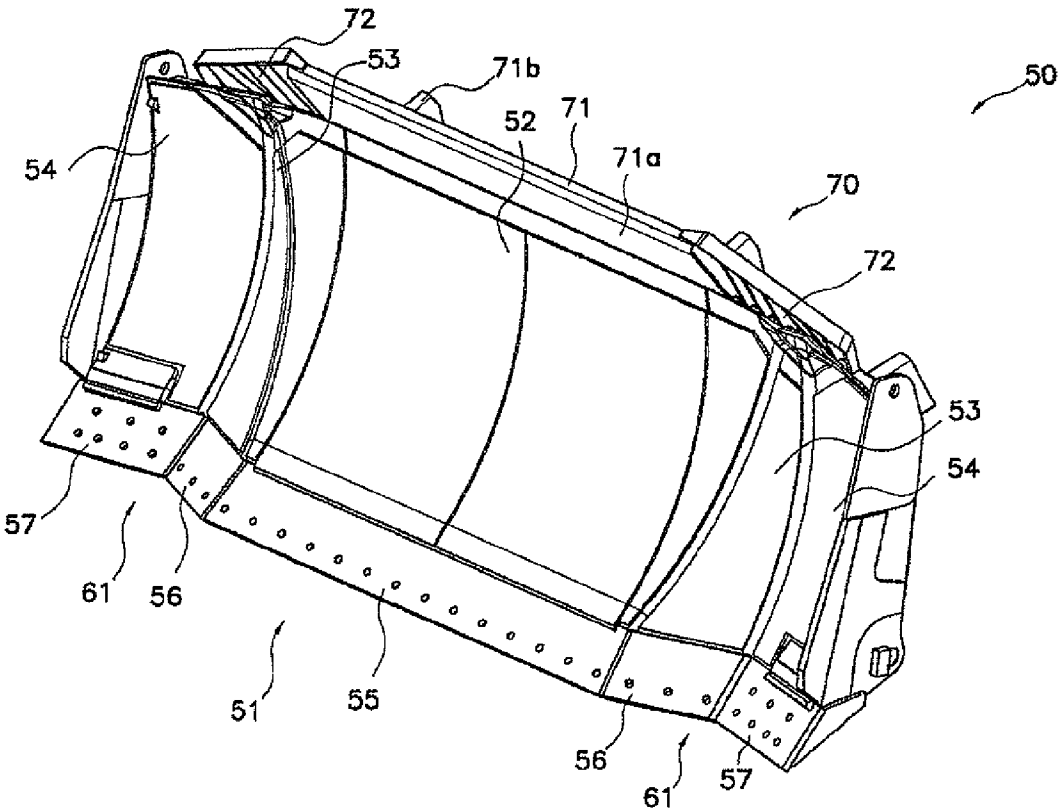
FIG. 27 is a perspective view showing a blade to which a guard member according to another embodiment of the present invention is fixed.

(1) In the blade 50 according to this embodiment, as shown in FIG. 27, etc., the guard 70 is fixed along the top end of the blade 50. As shown in FIG. 33, the guard 70 is fixed on the upper end of the blade 50 so that the soil contact surface 71*a* is inclined frontward relative to the elongation line of the upper end of the central front portion 52 of the blade 50 in side view.

Generally, in the case of soil carrying work of a large amount of soil that is excavated by a blade of a bulldozer or the like, when the large amount of soil that stands on the front surface of the blade reaches a part close to the guard that is mounted on the upper end of the blade 50, the movement direction of the soil depends on the inclination of the guard (soil contact surface) in the blade top end. For example, in the case where the guard (soil contact surface) is inclined rearward relative to the vertical direction, when the bulldozer runs forward, a large amount of soil in a part close to the guard will flow out rearward of the blade from the upper part or the left and right ends of the guard. Also, in the case where a guard (soil contact surface) is inclined frontward relative to the vertical direction, when the bulldozer runs forward, the front surface (soil contact surface) of the guard in the blade upper part provides a flow of soil that returns frontward. In particular, in the case where, in order to reduce the resistance of a lower end portion of a blade, the blade itself is inclined rearward for soil carrying, since the angle of the guard that is arranged in the blade upper part also inclines rearward, the rearward flowing-out amount of soil is likely to increase.

The guard 70 according to the present invention is fixed so that the soil contact surface 71*a* of the guard 70 is inclined frontward relative to the elongation line of the top end of the central front portion 52 of the blade 50.

Typically, the front surface of the blade 50 has a curved shape, and the top end is inclined frontward relative to the vertical direction. Accordingly, in the case where the guard 70 is fixed so that the soil contact surface 71*a* of the guard 70 is inclined frontward relative to the elongation line of this blade top end, in soil carrying work, when the bulldozer runs forward, the soil contact surface 71*a* of the guard 70 in the blade 50 upper part provides a flow of soil that returns frontward.

For this reason, in the case where the guard 70 is fixed to the top end of the blade 50 to adjust the fixation angle of the guard, this simple configuration can greatly reduce the amount of soil that falls rearward from the blade 50 in soil carrying work. Therefore, it is possible to improve the working efficiency of soil carrying work.

(2) In the blade 50 according to this embodiment, as shown in FIG. 33, the guard 70 is fixed on the upper end of the blade 50 so that the soil contact surface 71*a* is inclined about 30 degrees frontward relative to the elongation line of the upper end of the central front portion 52 of the blade 50 in side view.

Since the guard 70 is thus fixed to be inclined about 30 degrees frontward, it is possible to greatly reduce the rearward flowing-out amount of soil in the blade 50 without preventing a flow of soil on the front surface of the blade 50.

(3) In the blade 50 according to this embodiment, as shown in FIGS. 27 to 29, the front viewing openings 72, 72 are arranged on the both ends of the guard 70 to allow the operator on the seat to see a front part in the blade 50.

Accordingly, even in the case where the guard 70 is fixed to increase upwardly the height of the blade 50, the operator can see the state or the amount of soil of the front surface of the blade through the openings 72, 72. As a result, even in the case where the guard 70 is fixed, it is possible to suppress reduction of the visibility in the front part of the blade 50.

(4) In the blade 50 according to this embodiment, as shown in FIGS. 27, 29 and 32, in plan view, the interposition front portion 53 and the side front portion 54 are arranged to form a substantially V shape so that the recessed portions 61 are arranged in the both side parts of the blade 50.

Accordingly, in work such as digging, in the contact part of the lower end of the blade 50, the first edge section 55 that is mounted on the lower end of the central front portion 52 mainly comes in contact with the ground. Parts corresponding to the second and third edge sections 56 and 57 that are mounted on the lower ends of the interposition front portion 53 and the side front portions 54 almost do not provide resistance. As a result, the contact resistance of the lower end of the blade 50 is greatly reduced in digging or the like by the blade 50. Therefore, it is possible to improve workability. In addition to this, since a large amount of soil that is excavated by the first edge section 55 of the lower end of the central front portion 52, for example, is held in the recessed portions 61 that are formed on the both ends of the central front portion 52, it is possible to increase the amount of soil carrying per one cycle.

Other Embodiments

The foregoing description has described exemplary embodiments according to the present invention. However, the present invention is not limited to the foregoing embodiments. Various changes and modifications can be made without departing from the spirit of the present invention.

(A) In the foregoing second embodiment, the guard 70 and the blade 50 have been illustratively described as a guard and a blade to which the present invention is adopted. However, the present invention is not limited to this.

For example, the present invention can be adopted to a work machine blade control method. In the work machine blade control method, a guard member is arranged on the upper end of a work machine blade that is mounted to a work machine. Said guard member is inclined frontward relative to the elongation line of said work machine blade front surface in the upper end of said work machine blade. The angle of frontward inclination is adjusted relative to said elongation line of said guard member to control the amount of soil that flows out rearward of said work machine blade.

In the case where the present invention is adopted to a work machine blade control method, the following effect can be provided.

That is, the work machine blade control method according to the present t invention controls a work machine blade that is mounted in the front part of a work machine such as a bulldozer, and includes a guard member that is arranged in the upper end of the blade, for example. In the work machine blade control method, the guard member is fixed to the blade to be inclined at a fixation angle of a soil contact surface in side view frontward relative to the elongation line of the front surface of the work machine blade in the work machine blade upper end. This frontward angle of the guard member is adjusted to control the amount of soil that flows out rearward of the work machine blade.

The guard member is fixed to the top end of the work machine blade in order to increase the amount of soil carrying, and includes a plate-shaped member and a plurality of ribs that are mounted on the back surface side of the plate-shaped member, for example. The soil contact surface of the guard member refers to a surface that comes in contact with soil to push the soil frontward in a soil carrying work, and the like.

Generally, in the case where a guard member is fixed to a work machine blade, the guard member is fixed so that its soil contact surface extends along the elongation line of the front surface of the work machine blade in the top end of the work machine blade to which the guard member is fixed, or is inclined rearward relative to said elongation line in side view. Accordingly, when soil that is gathered in the front part of the work machine blade reaches the position of the guard member on the top end of the work machine blade top in a soil carrying work, the soil may ride over the guard member and may fall rearward. In particular, when soil is pushed in the state where the work machine blade is inclined rearward, the angle of the soil contact surface of the guard member is further inclined rearward. As a result, the amount of soil that falls rearward is increased.

For this reason, in the work machine blade control method of the present invention, the guard member is fixed to the work machine blade top end so that the soil contact surface is inclined frontward relative to the elongation line of the front surface of the work machine blade in the work machine blade top end in side view. This frontward inclination angle of the guard member is adjusted to control the amount of soil that flows out rearward of the work machine blade.

Accordingly, even when soil that is gathered in the front part of the work machine blade reaches the position of the guard member on the top end of the work machine blade in a soil carrying work, the soil contact surface of the guard member can provide a flow that returns the soil frontward. Therefore, it is possible to greatly reduce the amount of soil that falls rearward in a soil carrying work.

(B) In the foregoing second embodiment, the guard 70 has been illustratively described that is fixed to the upper part of the blade 50 so that the soil contact surface is inclined at 30 degrees frontward relative to the elongation line of the upper end of the central front portion 52. However, the present invention is not limited to this.

For example, the range of the frontward inclination angle of the soil contact surface 71*a* of the guard 70 can be specified more than 0 degree and not more than 50 degrees relative to the elongation line of the upper end of the central front portion 52 of the blade 50. In the case where the guard 70 is fixed so that the frontward inclination angle of the guard 70 falls within this range, it is possible to provide an effect similar to the effect that is provided by the blade 50 according to the foregoing embodiment.

However, in the case where the frontward inclination angle of the soil contact surface of the guard 70 is designed at 30 degrees relative to the aforementioned elongation line similarly to the foregoing embodiment, since it is possible to effectively provide a frontward flow that returns soil that gathered on the front surface of the blade 50, the frontward inclination angle is more preferably designed at about 30 degrees similarly to the foregoing embodiment.

(C) In the foregoing second embodiment, the guard 70 has been illustratively described that has the soil contact surface 71*a* that is inclined frontward relative to the elongation line of the upper end of the blade 50. However, the present invention is not limited to this.

For example, a guard according to the present invention can be defined that is fixed so that the soil contact surface is inclined frontward relative to the vertical direction in the inclination state of the blade in soil carrying work.

In this case, in soil carrying work, even in the state where the blade is inclined rearward, since the guard is fixed so that the soil contact surface is inclined frontward relative to the vertical direction in the state, in soil carrying work, irrespective of the posture of the blade, it is possible to surely reduce the amount of soil that flows out rearward of the blade.

Also, the guard may have a soil contact surface that is inclined frontward relative to the elongation line of the upper end of the central front portion of the blade in side view, and is inclined frontward relative to the vertical direction in the posture of the blade in soil carrying work.

In the case where the fixation angle of the soil contact surface is thus designed to satisfy the two conditions, it is possible to more surely reduce the amount of soil that falls rearward in a soil carrying work.

(D) In the foregoing second embodiment, as shown in FIG. 31, the soil contact surface 71*a* of the guard 70 has been illustratively described that is a straight and flat plate in side view. However, the present invention is not limited to this.

For example, the guard may have a soil contact surface that is curved frontward in side view, or a soil contact surface upper end of which is inclined frontward along the elongation line of the upper end of the central front portion of the guard (at frontward inclination angle of zero).

(E) In the foregoing second embodiment, the guard 70 has been illustratively described that has the front viewing openings 72 that are arranged on the both ends of guard 70. However, the present invention is not limited to this.

For example, the guard may have a front viewing opening that is arranged only one of the both ends of the guard, or may have no front viewing openings.

Also, in the foregoing embodiment, the guard 70 has been illustratively described that has the front viewing openings 72 that are arranged on the both ends of guard 70, and are grating-shaped openings. However, the present invention is not limited to this.

For example, the openings may be an aperture such as a punched hole in metal that is formed in a steel plate.

(F) In the foregoing second embodiment, the central front portion 52 of the blade 50 has been illustratively described that is formed in a curved shape that has a constant curvature over the whole surface in side view. However, the present invention is not limited to this.

For example, the work machine blade may have a central front portion that has a curved part in the central part of the central front portion, and a straight part in at least one of the upper and lower parts of the central front portion in side view.

In this case, the guard is fixed to the upper end of the blade so that the soil contact surface of the guard is inclined frontward relative to the elongation line of the straight part of the upper end of the central front portion. Accordingly, it is also possible to provide effects similar to the foregoing embodiment.

(G) In the foregoing second embodiment, as for the arrangement of the left and right interposition front portions 53 and the left and right side front portions 54, as shown in FIGS. 27, 29, etc., the arrangement of the left and right interposition front portions 53 and the left and right side front portions 54 have been illustratively described that are recessed relative to the central front portion 52 to form a substantially V shape. However, the present invention is not limited to this.

For example, in plan view, the central front portion, the interposition front portion, and the side front portion that compose the blade front surface portion may be arranged on a straight line.

However, the interposition front portions 53 and the side front portions 54 are preferably arranged to form the recessed portions 61 in a substantially V shape in the both sides of the blade 50 similarly to the foregoing embodiment in consideration that this arrangement can reduce the digging resistance of the lower end of the blade 50, and can improve working efficiency.

(H) In the foregoing second embodiment, the front portions 52 to 54 have been illustratively described that are separately formed. In the foregoing second embodiment, the left and right ends of the front portions 52 to 54 are fixed to each other by welding to form a continuous surface that extends in the lateral direction. However, the present invention is not limited to this.

For example, the blade may have the blade front surface portion that is composed of the front surface portions that are integrally formed by casting or the like. In the case where the blade front surface portion is designed to adjust its size, thickness and the like so that the front surface portions are thus integrally formed, since the number of the production processes can be reduced as compared with the case where the front surface portions are fixed to each other by welding after being formed, it is possible to greatly increase the manufacturing efficiency of a blade.

(I) In the foregoing second embodiment, the blade has been illustratively described that is attached to a bulldozer as a work machine. However, the present invention is not limited to this.

For example, the blade may be attached to other type of work machine (earthmoving machine) such as a wheel loader, a dozer shovel and a motor grader other than a bulldozer. Such a work machine includes a dozing plate for digging, leveling, cutting, soil pushing and the like. Such a dozing plate is attached in the front part of a work machine.

The invention claimed is:

1. A work machine blade device that is attachable to various types of work machines, the blade device comprising:

a blade including a central front portion;

interposition front portions that are bent with respect to the central front portion and connected to left and right ends of the central front portion, respectively; and side front portions that are connected to the left and right ends of the central front portion through the interposition front portions, respectively, said central front portion having a prescribed blade width at a lower end that extends in a left-and-right direction perpendicular to a digging direction, said central front portion including a first edge section at the lower end thereof, each of said interposition front portions including a second edge section at a lower end thereof, each of said side front portions including a third edge section at a lower end thereof, an intersection line formed between each of said interposition front portions and a corresponding one of said side front portions, and an intersection point between edges of each of said second edge sections and a corresponding one of said third edge sections being positioned rearward relative to an edge of said first edge section in top plan view, a front surface of each of said central front portion, said interposition front portions, and said side front portions being formed in an arc-shaped surface that continuously extends from a top end to the lower end of each of said central front portion, said interposition front portions, and said side front portions with the arc-shaped surface having a radius R2, each of said first, second and third edge sections extends in a tangential direction from the lower end of a corresponding one of said central front portion, said interposition front portions, and said side front portions, said radius R2 satisfying the following relationship $$R2=(0.7 \text{ to } 1.0)\times H,$$

where a value H represents a height from the edge of said first edge section to the top end of said central front portion in side view in a prescribed digging posture in which an edge angle α formed between a horizontal direction and the first edge section is in a range of 40° to 55°.

2. The blade device according to claim 1, wherein the prescribed blade width of the lower end of the front surface of said central front portion is substantially equal to an edge width of said first edge section, and said central front portion is formed so that a width of said central front portion becomes gradually wider from the lower end toward the top end of said central front portion.

3. A work machine comprising the blade device according to claim 1.

4. A work machine blade device that is attachable to various types of work machines, the blade device comprising:

a blade including a central front portion;

interposition front portions that are bent with respect to the central front portion and connected to left and right ends of the central front portion, respectively;

side front portions that are connected to the left and right ends of the central front portion through the interposition front portions, respectively; and a steel plate member extending substantially in a tangential direction at least from a top end of said central front portion, said central front portion having a prescribed blade width at a lower end that extends in a left-and-right direction perpendicular to a digging direction, said central front portion including a first edge section at the lower end thereof, each of said interposition front portions including a second edge section at a lower end thereof, each of said side front portions including a third edge section at a lower end thereof an intersection line formed between each of said interposition front portions and a corresponding one of said side front portions, and an intersection point between edges of each of said second edge sections and a corresponding one of said third edge sections being positioned rearward relative to an edge of said first edge section in top plan view, a front surface of each of said central front portion, said interposition front portions, and said side front portions being formed in an arc-shaped surface that continuously extends from a top end to the lower end of each of said central front portion, said interposition front portions, and said side front portions with the arc-shaped surface having a radius R2, said radius R2 satisfying the following relationship $$R2=(0.7 \text{ to } 1.0)\times H,$$

where a value H represents a height from the edge of said first edge section to a top end of said steel plate member in side view in a prescribed digging posture in which an edge angle α formed between a horizontal direction and the first edge section is in a range of 40° to 55°.

5. A work machine blade device that is attachable to various types of work machines, the blade device comprising:

a blade including a central front portion;

interposition front portions that are bent with respect to the central front portion and connected to left and right ends of the central front portion, respectively;

side front portions that are connected to the left and right ends of the central front portion through the interposition front portions, respectively; and a steel plate member having a soil contact surface that is inclined frontward relative to at least an elongation line extending from an upper end of said central front portion in side view, said central front portion having a prescribed blade width at a lower end that extends in a left-and-right direction perpendicular to a digging direction, said central front portion including a first edge section at the lower end thereof, each of said interposition front portions including a second edge section at a lower end thereof, each of said side front portions including a third edge section at a lower end thereof, an intersection line formed between each of said interposition front portions and a corresponding one of the side front portions, and an intersection point between the edges of each of said second edge sections and a corresponding one of said third edge sections being positioned rearward relative to an edge of said first edge section in top plan view, a front surface of each of said central front portion, said interposition front portions, and said side front portions being formed in an arc-shaped surface that continuously extends from a top end to the lower end of each of said central front portion, said interposition front portions, and said side front portions with the arc-shaped surface having a radius R2, said radius R2 satisfying the following relationship $$R2=(0.7 \text{ to } 1.0)\times H,$$

Where a value H represents a height from the edge of the first edge section to a top end of said steel plate member in side view in a prescribed digging posture in which an edge angle α formed between a horizontal direction and the first edge section is in a range of 40° to 55°.

6. The work machine blade device according to claim 5, wherein a frontward inclination angle of said steel plate member is more than 0 degrees and not more than 50 degrees relative to the elongation line of said central front portion.

7. A work machine blade device comprising:

a central front portion with a lower end having a prescribed blade width that extends in a left-and-right direction perpendicular to a digging direction, the central front portion including a first edge section that extends from the lower end of the central front portion along a tangential direction of an arc-shaped surface of the central front portion;

interposition front portions that are bent with respect to the central front portion and connected to left and right ends of the central front portion, respectively, each of the interposition front portions including a second edge section that extends from a lower end of the interposition front portion along a tangential direction of an arc-shaped surface of the interposition front portion; and side front portions that are connected to the left and right ends of the central front portion through the interposition front portions, respectively, each of the side front portions including a third edge section that extends from a lower end of the side front portion along a tangential direction of an arc-shaped surface of the side front portion, an intersection line formed between each of said interposition front portions and a corresponding one of said side front portions, and an intersection point between edges of each of said second edge sections and a corresponding one of said third edge sections being positioned rearward relative to an edge of said first edge section in top plane view, a front surface of each of said central front portion, said interposition front portions, and said side front portions has the arc-shaped surface that continuously extends from a top end to the lower end of each of said central front portion, said interposition front portions, and said side front portions with the arc-shaped surface having a radius R2, said radius R2 satisfying the following relationship $$R2=(0.7 \text{ to } 1.0)\times H,$$

where a value H represents a height from the edge of the first edge section to the top end of said central front portion in side view in a digging posture.

8. A work machine blade device comprising:

a central front portion with a lower end having a prescribed blade width that extends in a left-and-right direction perpendicular to a digging direction, the central front portion including a first edge section;

interposition front portions that are bent with respect to the central front portion and connected to left and right ends of the central front portion, respectively, each of the interposition front portions including a second edge section that extends from a lower end of the interposition front portion along a tangential direction of an arc-shaped surface of the interposition front portion;

side front portions that are connected to the left and right ends of the central front portion through the interposition front portions, respectively, each of the side front portion including a third edge section that extends from a lower end of the side front portion along a tangential direction of an arc-shaped surface of the side front portion; and a steel plate member extending substantially in a tangential direction at least from a top end of said central front portion, an intersection line formed between each of said interposition front portions and a corresponding one of said side front portions, and an intersection point between edges of each of said second edge sections and a corresponding one of said third edge sections being positioned rearward relative to an edge of said first edge section in top plan view, a front surface of each of said central front portion, said interposition front portions, and said side front portions has the arc-shaped surface that continuously extends from a top end to the lower end of each of said central front portion, said interposition front portions, and said side front portions with the arc-shaped surface having a radius R2, said radius R2 satisfying the following relationship $$R2=(0.7 \text{ to } 1.0)\times H,$$

where a value H represents a height from the edge of the first edge section to a top end of said steel plate member in side view in a digging posture.

* * * * *